US012752155B1

(12) United States Patent
Wu

(10) Patent No.: US 12,752,155 B1
(45) Date of Patent: Oct. 6, 2026

(54) GRIP STRENGTH ENHANCEMENT DEVICE

(71) Applicant: Xiaolu Wu, Shenzhen (CN)

(72) Inventor: Xiaolu Wu, Shenzhen (CN)

( * ) Notice: Subject to any disclaimer, the term of this patent is extended or adjusted under 35 U.S.C. 154(b) by 0 days.

(21) Appl. No.: 19/430,265

(22) Filed: Dec. 23, 2025

(51) Int. Cl.
*A63B 23/16* (2006.01)
*A63B 21/00* (2006.01)
*A63B 21/02* (2006.01)

(52) U.S. Cl.
CPC ..... *A63B 23/16* (2013.01); *A63B 21/00069* (2013.01); *A63B 21/023* (2013.01)

(58) Field of Classification Search
CPC . A63B 21/00069; A63B 23/16; A63B 21/023; A63B 21/0421; A63B 21/4035; A63B 21/4047; A63B 24/0062; A63B 71/0622; A63B 2071/0658; A63B 2220/17; A63B 2220/20; A63B 2220/51; A63B 2220/56; A63B 2220/58
See application file for complete search history.

(56) References Cited

U.S. PATENT DOCUMENTS

| | | | | |
|---|---|---|---|---|
| 9,415,262 | B2 * | 8/2016 | An | A63B 21/023 |
| 11,052,283 | B2 * | 7/2021 | An | A63B 23/16 |
| D1,080,421 | S * | 6/2025 | Gao | D10/46.1 |
| 2004/0003687 | A1 * | 1/2004 | An | A63B 21/0004 606/206 |
| 2019/0255383 | A1 * | 8/2019 | An | A63B 21/00072 |
| 2024/0123282 | A1 * | 4/2024 | Lu | A63B 21/0421 |
| 2026/0014417 | A1 * | 1/2026 | Gao | A63B 21/00069 |

* cited by examiner

*Primary Examiner* — Andrew M Kobylarz
(74) *Attorney, Agent, or Firm* — Ying-Ting Chen

(57) ABSTRACT

A grip strength enhancement device includes first and second arms pivotally coupled about an axis, with handles at their lower ends. A spring extends between upper portions of the arms. The spring is connected to the first arm via an upper loop and operatively coupled to a threaded adjustment mechanism on the second arm via a lower hook. The adjustment mechanism, driven by a knob and screw, includes a nut constrained within a limiting slot defined in the second arm. End stop surfaces cooperate with the nut and the spring hook to limit adjustment travel and reduce disengagement risk. A pivot region may include complementary engagement features for load sharing and axial restraint. The handles may feature asymmetric ergonomic cross-sections and offset bottom-end geometry to improve conformity during gripping.

7 Claims, 43 Drawing Sheets

| δS/mm | $D_x$/mm | δD/mm | Φ |
|---|---|---|---|
| 0 | 85 | 43 | 24 |
| 3 | 90 | 48 | 21 |
| 6 | 95 | 53 | 19 |
| 9 | 101 | 59 | 17 |
| 12 | 105 | 64 | 11 |
| 15 | 108 | 66 | 8 |
| 18 | 112 | 70 | 4 |
| 21 | 117 | 75 | 0 |

Fig.19

GRIP STRENGTH ENHANCEMENT DEVICE

TECHNICAL FIELD

The present disclosure relates to the fields of fitness equipment and rehabilitation training devices, and more particularly, to a grip strength enhancement device for training muscles of a hand and a forearm.

BACKGROUND

Hand grippers are common tools for strength training of the hand and forearm, and are widely used in professional fitness, sports rehabilitation, and daily exercise. However, existing hand grippers still suffer from various deficiencies in functional design, user experience, and structural reliability.

Many conventional hand grippers provide a fixed resistance and thus cannot satisfy progressive training needs of different users. Some adjustable hand grippers provide only coarse adjustment increments, making it difficult to set resistance with precision. More importantly, such adjustment mechanisms often lack reliable travel limiting and fail-safe design. As a result, when a user adjusts to an extreme position, components such as a screw and a nut may disengage or jam, or, when a core component such as a spring unexpectedly fails, the handle arms may violently collide, creating significant safety hazards during use.

The handle designs of existing hand grippers are generally simplistic and fail to fully account for the complex biomechanics of the human hand. Long-term training may readily cause localized pressure pain and numbness, and may force a user to adopt an unnatural wrist posture, thereby increasing the risk of sports injury.

In addition, with respect to the critical pivot structure, traditional designs typically rely on a single pin to bear substantially all shear loads. Under repeated high-intensity use, pin holes are prone to wear and looseness, causing the device to become wobbly and significantly shortening service life. In terms of assembly, the alignment of pivot holes depends on manual operation and is difficult to control with precision, which can readily cause installation binding and adversely affect manufacturing efficiency and product consistency.

Accordingly, there is a need in the art for a new grip-strengthening device that not only provides safe, reliable, and precise stepless resistance adjustment, but also achieves a breakthrough in ergonomic design to deliver superior gripping comfort and fit, while optimizing internal mechanical structures to improve durability and manufacturing efficiency.

SUMMARY

In one aspect, the present disclosure provides a grip-strengthening device for training hand muscles. The device includes a first arm and a second arm pivotally coupled about an axis, a first handle disposed at a lower end of the first arm, a second handle disposed at a lower end of the second arm, and a tension spring extending between upper portions of the two arms. The first handle has a bearing surface configured to conform to a thenar eminence of a user's palm, and a front surface opposite the bearing surface. The second handle has a gripping surface configured to conform to finger pads of the user, and an extension surface opposite the gripping surface. When no external force is applied, the spring biases the first arm and the second arm to open relative to each other under a tensile force thereof, thereby maintaining the two handles in an open state along a grip-training direction.

A lower end of the spring is operatively connected to a threaded adjustment mechanism disposed on a base arm portion of the second arm. The base arm portion defines an elongate limiting slot extending along a first direction. The threaded adjustment mechanism includes a screw arranged along an extending direction of the limiting slot, a knob fixed to an outer end of the screw for driving rotation of the screw, and a nut threadedly engaged with the screw. The nut, by cooperation with the limiting slot and the screw, is constrained to linearly reciprocate only along the first direction between a proximal stop position and a distal stop position. The nut includes a protruding portion received within the limiting slot, the protruding portion defining a fixing hole, wherein a hook at the lower end of the spring passes through the fixing hole. Thus, by rotating the knob to rotate the screw, the nut can be driven to move between the proximal stop position and the distal stop position, thereby changing an initial pre-extension amount of the spring.

In some embodiments, an upper portion of the limiting slot is formed with a through slot, and a stepped portion is formed at an end adjacent to a pivot joint. An end face of the stepped portion constitutes a first end stop surface, against which the nut abuts when the nut is at the proximal stop position. A retaining ring is installed at the other end of the limiting slot, the retaining ring defining, at a side facing the limiting slot, a second end stop surface, against which the spring hook abuts when the spring hook is at the distal stop position. In some embodiments, a chamber is formed within the stepped portion to accommodate a stop mechanism disposed at a tail end of the screw. The stop mechanism may include a stop shoulder formed on the screw, a connecting post extending from the stop shoulder along an axial direction of the screw, and a stop post fixed at a distal end of the connecting post. A second pin passes through a second pin hole provided on the base arm portion and transversely spans the chamber, with the stop shoulder and the stop post respectively located on opposite sides of the second pin so as to form a generally "U"-shaped configuration around the second pin. Cooperation among the chamber, the second pin, and the "U"-shaped stop mechanism limits axial play and lateral offset of the screw during adjustment, thereby improving stability and reliability of resistance adjustment operation.

BRIEF DESCRIPTION OF THE DRAWINGS

FIG. 19 is a schematic table showing a relationship among adjustment travel, an initial stop angle, and grip travel of the grip strength enhancement device according to an embodiment of the present disclosure;

DETAILED DESCRIPTION

Figure 1:
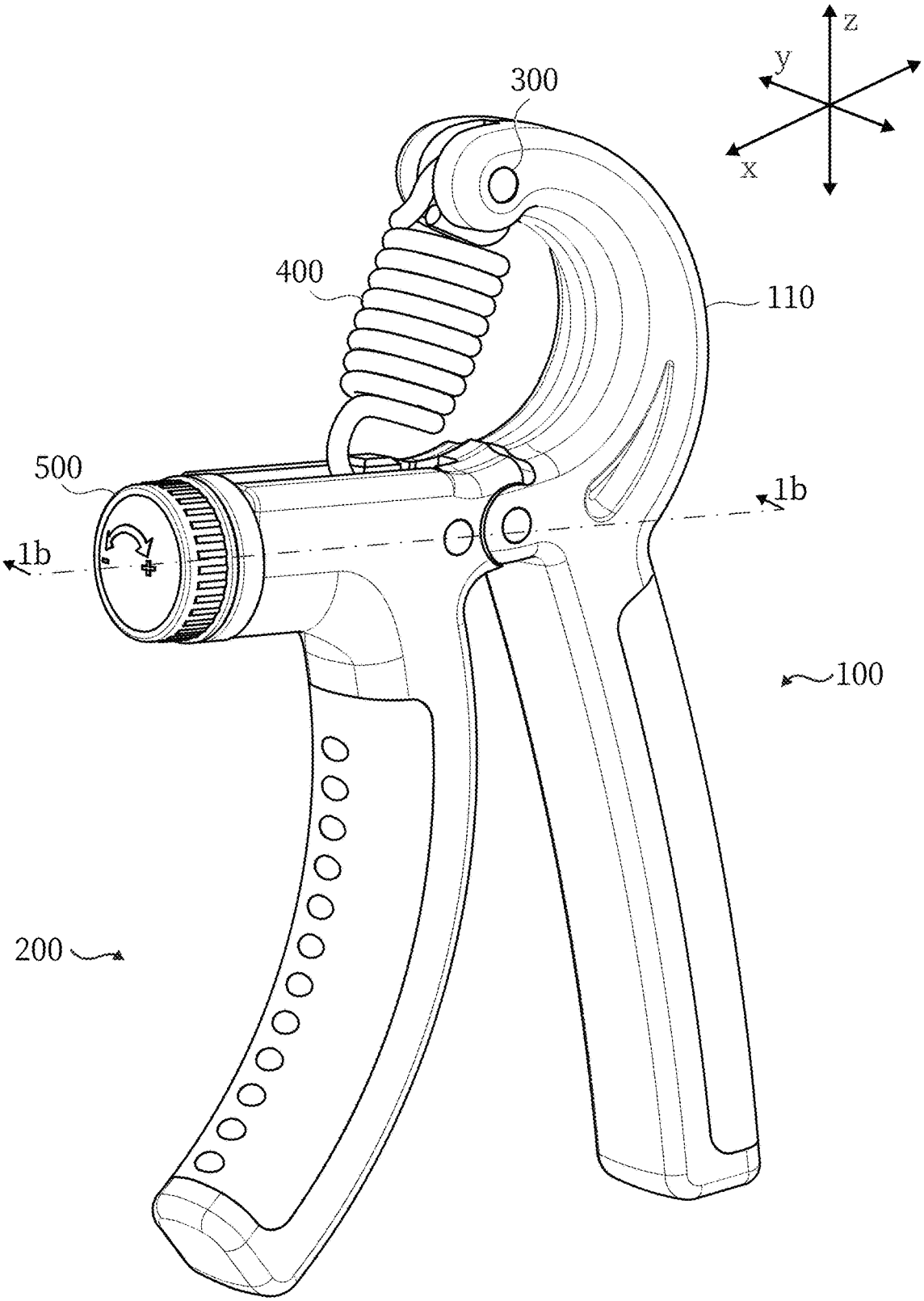
FIG. 1 is a perspective view of a grip strength enhancement device according to an embodiment of the present disclosure.

In order to make the objectives, technical solutions, and advantages of the present disclosure more apparent, embodiments of the present disclosure are described in detail below with reference to the accompanying drawings.

For ease of clearly describing relative positional relationships, structural orientations, and directions of motion of components of the present disclosure, a right-handed Cartesian coordinate system xyz is defined with reference to the grip strength enhancement device of the present disclosure in conjunction with the drawings.

In this embodiment, an origin O of the coordinate system may be set at any point within a space in which the grip strength enhancement device is located. A direction of a y-axis may be defined to coincide with a central axis of any pin in a pin assembly 300 (e.g., a first pin 310, a second pin 320, or a third pin 330). Accordingly, relative swinging motion of the first arm 100 and the second arm 200 toward each other or away from each other is rotation about the y-axis. A direction of a z-axis may be defined as a height direction of the device, that is, perpendicular to the y-axis. Specifically, a positive direction (+z) of the z-axis extends from the origin O generally toward an end of the device at which an adjustable elastic component is provided, and is typically regarded as an upper end or an upper side of the device; a negative direction (−z) of the z-axis extends from the origin O generally along an extending direction of handle portions of the first arm 100 and the second arm 200, and is typically regarded as a lower end or a lower side of the device. A width direction of the device is mainly distributed along the y-axis. A direction of an x-axis is determined by the y-axis and the z-axis according to the right-hand rule, such that the x-axis is perpendicular to a plane defined by the y-axis and the z-axis (a yz-plane). A length direction of the device is mainly distributed along the x-axis. Specifically, a positive direction of the x-axis extends from the origin O generally toward an opening of a limiting slot 220 of the device, and is typically regarded as a front end or a front side of the device, whereas an opposite direction is regarded as a rear end or a rear side. When a user grips the device and applies a force, handle portions of the first arm 100 and the second arm 200 mainly move relative to each other within an xz-plane toward each other (i.e., toward the x-direction).

Accordingly, spatial terms such as "upper," "lower," "front," and "rear" that may appear below, unless otherwise specified, are based on the above-defined Cartesian coordinate system xyz.

Figure 1A:
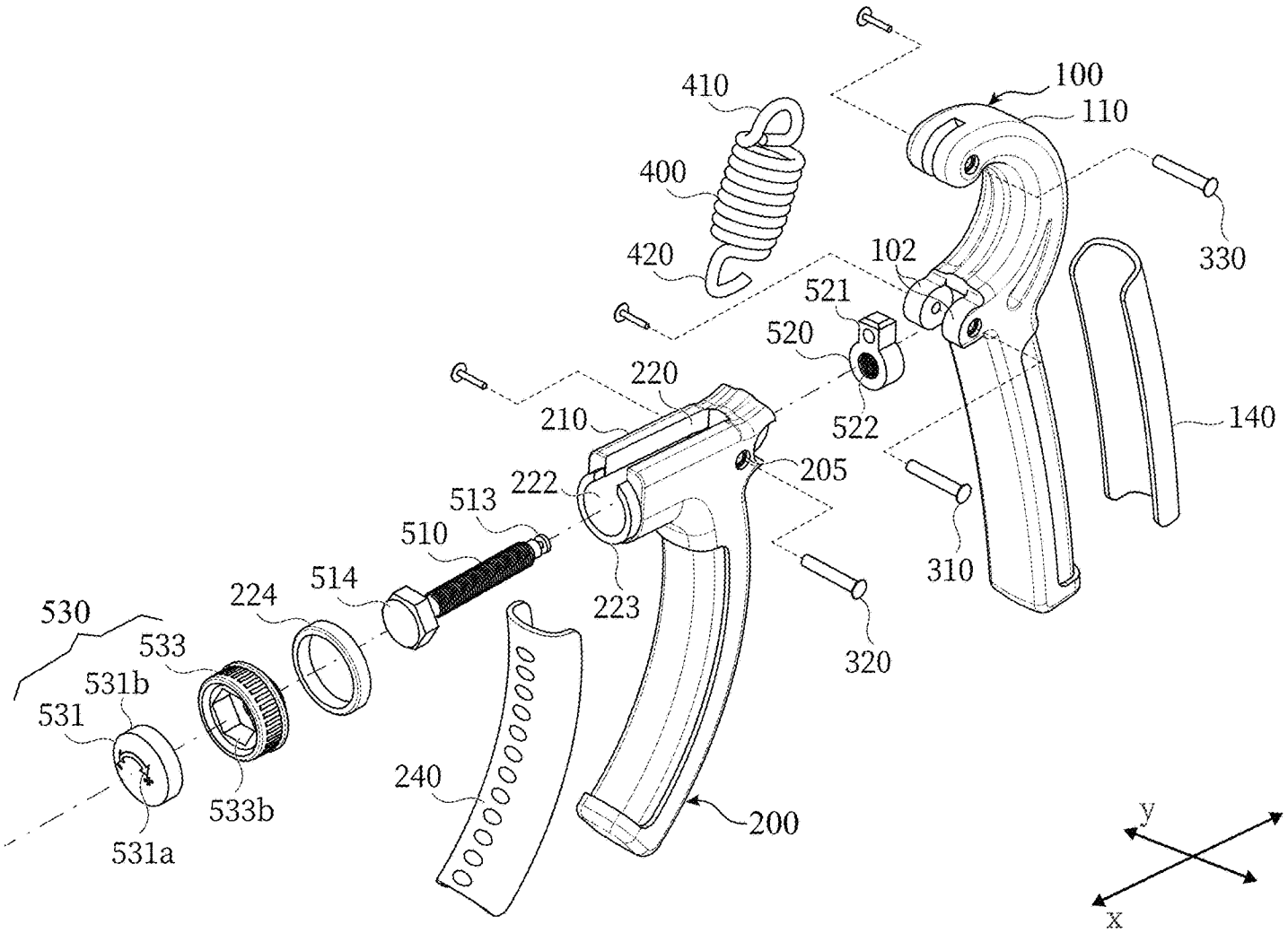
FIG. 1A is an exploded view of the grip strength enhancement device according to an embodiment of the present disclosure.

FIG. 1 and FIG. 1A illustrate a grip strength enhancement device, wherein a main body of the device includes a first arm 100 and a second arm 200. Mid-portions of the first arm 100 and the second arm 200 overlap with each other and are configured to rotate relative to each other by a pivot assembly.

Figure 2:
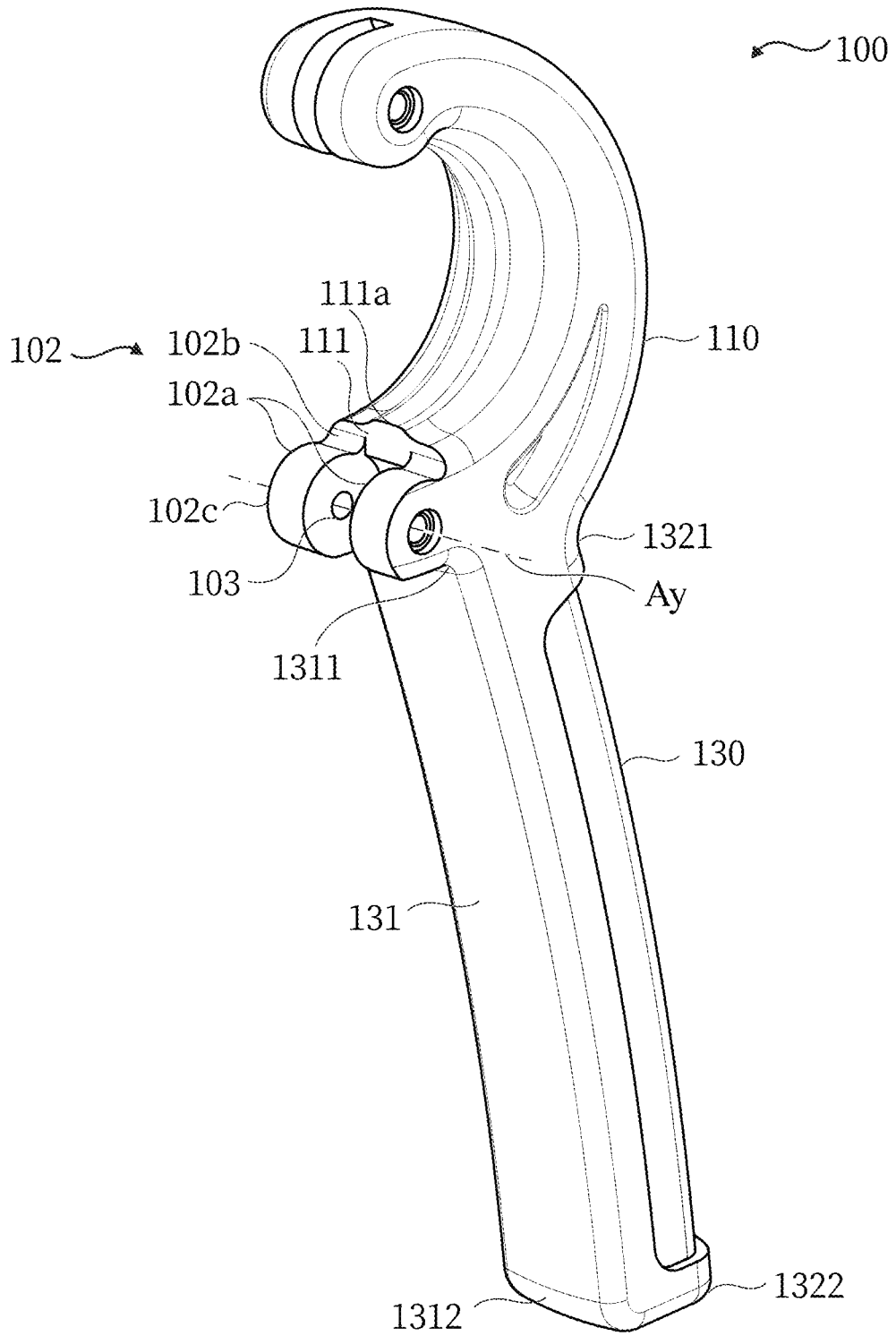
FIG. 2 is a perspective view of a first arm of the grip strength enhancement device according to an embodiment of the present disclosure.
Figure 3:
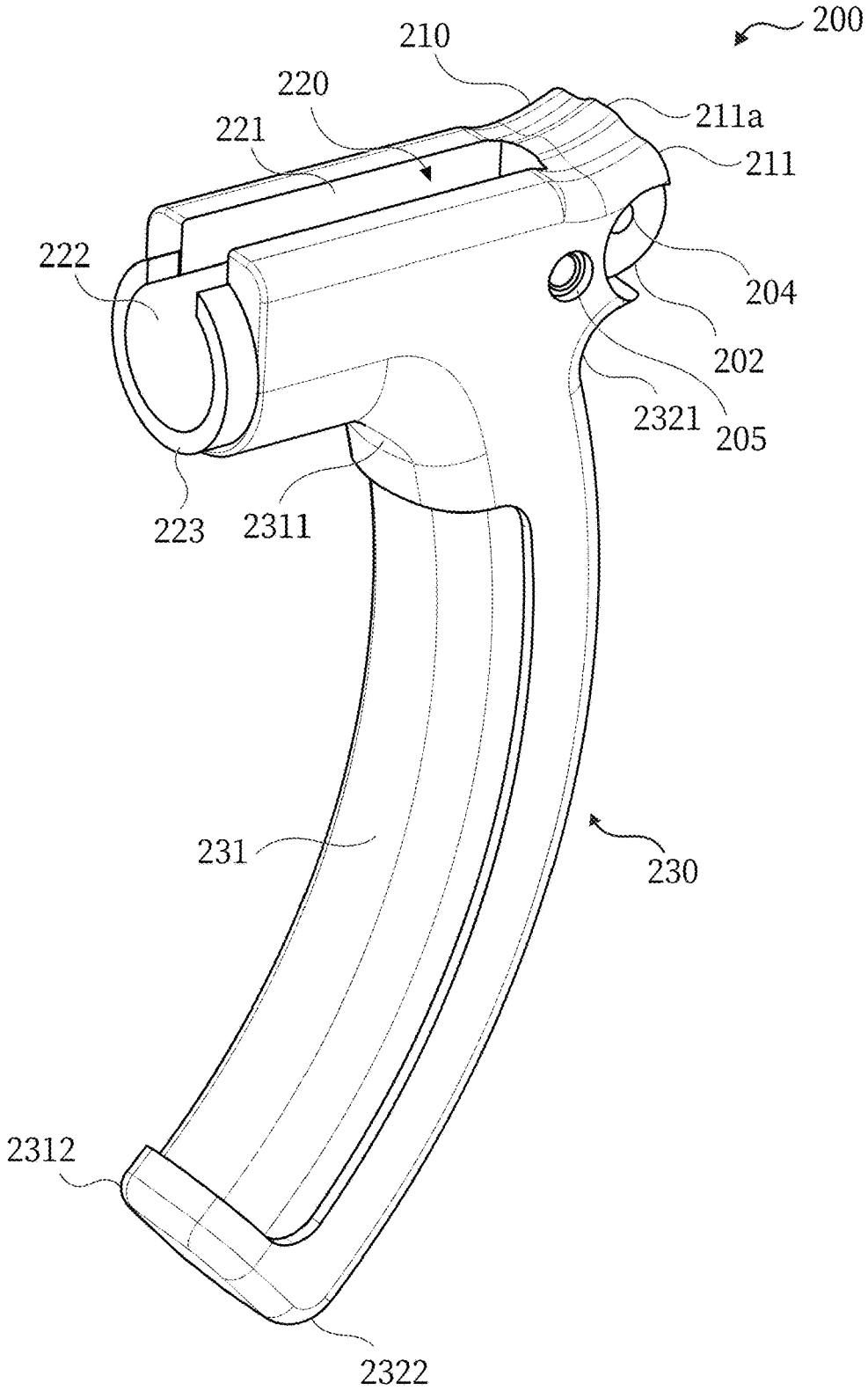
FIG. 3 is a perspective view of a second arm of the grip strength enhancement device according to an embodiment of the present disclosure.

As shown in FIG. 2, a first portion of the first arm 100 may be an arcuate arm 110, an inner arc of which faces an opening side of the gripper. The arcuate design of the arcuate arm 110 not only imparts a distinctive aesthetic appearance to the device, but more importantly provides a necessary structural basis and motion space for cooperation with a spring 400. A front side of the first arm 100 is provided with a clevis-type bearing seat 102, which may be formed by two lugs 102*a* that are parallel to and spaced apart from each other. A receiving groove having a predetermined width is formed between the two lugs 102*a*. To ensure connection stability and precision, inner sidewall surfaces of the two lugs 102*a* are smooth and parallel to each other. A first through hole 104 is provided in each lug 102*a*, and the two first through holes 104 are coaxial and jointly define a first pin hole 103.

The two arcuate lugs 102*a*, as portions of the clevis-type bearing seat, are parallel to each other and spaced apart by a predetermined distance in space, and jointly define an assembly groove for receiving a pivot shaft of the second arm. A "arcuate" feature of each lug 102*a* is mainly reflected in an outer contour thereof, which may present, along a direction away from a handle of the first arm 100, as a continuous circular-arc curve or free-form curve that protrudes upwardly or forwardly. Although the outer shape is arcuate, opposing inner sidewalls of the two lugs 102*a* may be planar and maintained with strict parallelism, so as to provide stable, laterally supportive, and wobble-free support for the pivot shaft of the second arm.

The arcuate lugs 102*a* are not separate components, but are integral parts of a main structure of the first arm 100, and are naturally formed by an integral molding process (such as injection molding or die casting). Specifically, a root of each arcuate lug 102*a* may be smoothly connected to an upper half main body of the first arm 100 through a preset fillet transition region 102*b* having a relatively large radius of curvature. This non-right-angle, non-sharp-corner connection ensures a continuous and smooth force-flow path from the main body to the lug, and effectively avoids stress concentration at a root of a pivot load point, thereby greatly improving fatigue strength and overall durability of this critical load-bearing portion. A radius of curvature R of the fillet transition region 102*b* may be greater than 0 and not exceed 3.0 mm, preferably 1.0 mm to 2.0 mm, and more preferably 1.5 mm.

Further, as a main body of the clevis-type bearing seat, dimensions of the two lugs 102*a* are optimized. A thickness of each lug 102*a* may be 4.0 mm to 7.0 mm, preferably 5.0 mm to 6.0 mm, and more preferably 5.8 mm, and a spacing between inner walls of the two lugs 102*a* may be 6.0 mm to 9.0 mm, preferably 7.5 mm to 8.5 mm, and more preferably 8.0 mm, so as to ensure that the pivot structure remains high-strength and highly stable under a large torque while achieving compactness and weight reduction.

As shown in FIG. 1 and FIGS. 3-4E, the grip strength enhancement device further includes a second arm 200. A first portion of the second arm 200 is a base arm 210, which is generally columnar and extends along an x-axis direction. A limiting slot 220 is formed at a mid-portion of the base arm 210. One end of the limiting slot 220 is open, and an upper portion thereof may also be open. The limiting slot 220 may be used to accommodate or guide an end portion of an elastic component, or to cooperate with a resistance-adjustment mechanism, thereby jointly realizing core functions of the device.

Figure 4:
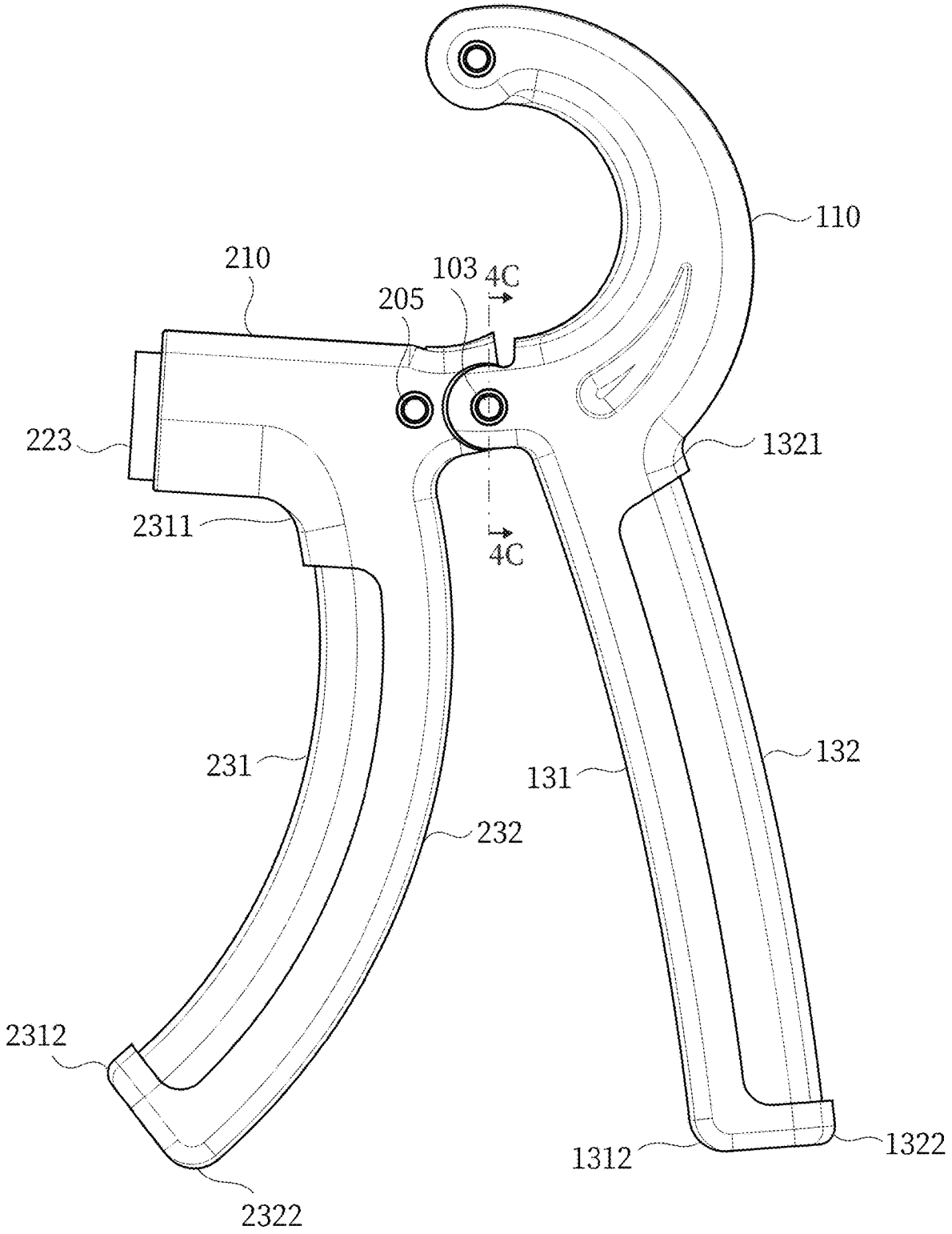
FIG. 4 is a first schematic view of an assembled state of the first arm and the second arm of the grip strength enhancement device according to an embodiment of the present disclosure.
Figure 4A:
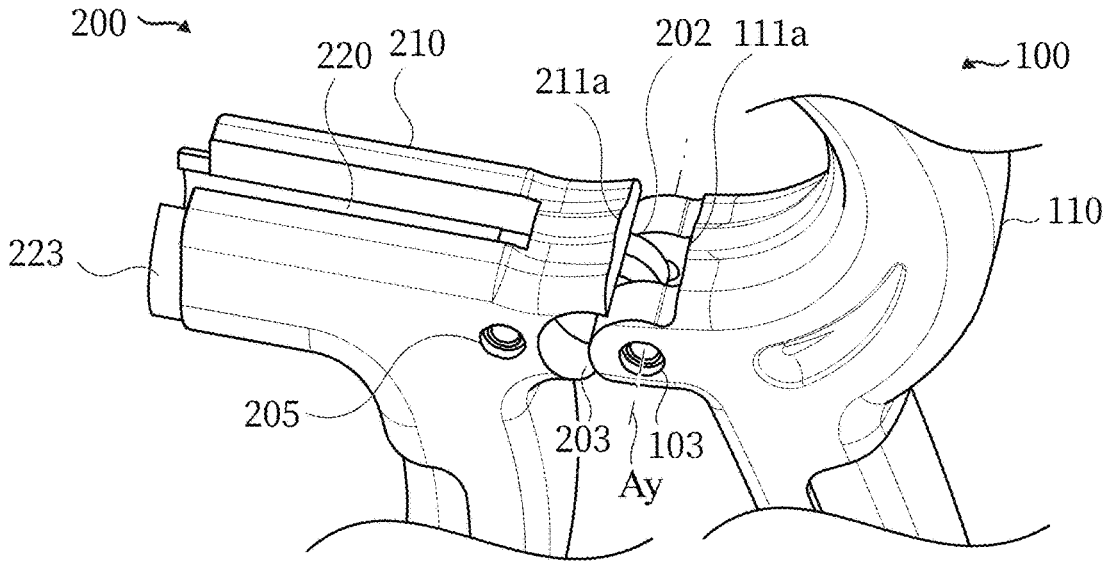
FIG. 4A is a second schematic view of the assembled state of the first arm and the second arm of the grip strength enhancement device according to an embodiment of the present disclosure.

FIG. 4 and FIG. 4A show schematic perspective views of a structure in which an upper portion of the first arm 100 cooperates with an upper portion of the second arm 200. The second arm 200 is integrally formed, at a pivot end thereof (i.e., a portion corresponding to the bearing seat 102 of the first arm 100), with a pivot portion 202. The pivot portion 202 has a cylindrical or tubular protruding structure, an axial length of which is precisely controlled to be slightly less than a width of the receiving groove between the two lugs of the bearing seat 102 of the first arm 100. A second through hole 204 extends through a center of the pivot portion 202 along an axial direction thereof. A structure and dimensions of the second through hole 204 are identical to a structure and dimensions of the first pin hole 103 of the first arm 100. When the second arm 200 is assembled with the first arm 100 in place, the second through hole 204 and the first pin hole 103 are coaxially aligned and in communication with each other, so that the first pin 310 can be inserted to realize a rotatable connection.

Two limiting recesses 203 are symmetrically provided on opposite sides of the pivot portion 202 of the second arm 200. In preferred embodiments, each limiting recess 203 may be arc-shaped. A radius of curvature of the arc matches an outer contour radius of an engaging end of the lug 102*a* of the first arm 100, so as to ensure surface contact, rather than point or line contact, upon engagement. Each limiting recess 203 has a predetermined arc length along a circumferential direction of the pivot portion 202, and a central angle θ203 corresponding to the arc length may be 170.0° to 200.0°, preferably 180.0° to 190.0°, and more preferably 186.2°.

A cooperation relationship between the lugs and the limiting recesses 203 is as follows.

In an assembled state, the two lugs 102*a* of the first arm 100 clamp the pivot portion 202 of the second arm 200. Meanwhile, an arc portion 102*c* of each lug 102*a* is received within a corresponding limiting recess 203 on a respective side of the pivot portion 202. When a user operates the gripper such that the first arm 100 and the second arm 200 rotate relative to each other about a pivot pin, the lugs 102*a* slide within an arc track defined by the limiting recesses 203.

This engagement-and-limiting structure provides reliable axial limiting. Specifically, an engaging protrusion and sidewalls of the limiting recesses 203 abut against each other to form an effective axial locking structure. This completely prevents relative sliding or play between the first arm 100 and the second arm 200 along a height direction (z-axis direction) of the device, thereby ensuring tightness of the pivot connection, eliminating a lateral looseness sensation that may occur during use, and improving overall quality and operational precision of the device. Further, during an instant of gripping and force application, a large shear force is not borne solely by the central pivot pin, but is also transmitted and shared through contact surfaces between the engaging protrusion and the limiting recesses 203. This large-area load-transmission path effectively reduces stress concentration borne by the central pivot pin and corresponding pin holes, significantly slows wear and deformation of the holes, and thereby greatly improves fatigue resistance and service life of the entire pivot structure under high-strength, high-frequency use.

A core of the pivot assembly is the first pin 310, which sequentially passes through the first pin hole 103 of the first arm 100 and the second through hole 204 of the second arm 200 to rotatably connect the two arms. To achieve both assembly convenience and locking reliability, pins used to connect key components in this embodiment are collectively configured as a pin assembly 300. The pin assembly 300 may include a plurality of pins having substantially the same structural form but different installation positions, such as the first pin 310, the second pin 320, and the third pin 330. These pins are preferably identical or at least partially identical in structure and main dimensions, and differ only in installation positions and associated mating components, thereby facilitating standardized manufacturing and spare-part management and reducing manufacturing and maintenance costs.

Specifically, any one of the pins (e.g., the first pin 310) includes a long pin segment extending along the y-axis and a limiting head portion disposed at one end of the long pin segment, a diameter of the limiting head portion being greater than a diameter of a corresponding pin hole so as to abut against an outer side surface of a component at that end to form an axial stop. Another end of the long pin segment is provided with a locking mating portion for detachable locking engagement with a short-pin clip, for example, a circumferential groove, a reduced-diameter portion, or a radial through hole. The short-pin clip mating therewith may be formed as a female clip structure by bending a metal nail, an elastic metal wire, or a sheet material, and a clip end thereof may pass through and snap into the locking mating portion to form a second axial stop opposite to the limiting head portion, thereby reliably preventing accidental axial withdrawal of the pin while allowing the pin to rotate within the corresponding pin hole.

With the above-described two-piece pin structure, the three pins can be conveniently disassembled and assembled when components such as the spring 400 and the threaded adjustment mechanism 500 require maintenance or replacement, which is beneficial to improving maintainability and service life of the overall device.

On the basis of the above-described pin assembly 300, in order to further optimize load bearing and assembly performance at a central pivot portion, an improvement to geometries of pin holes is provided in this embodiment as follows.

Figure 4B:
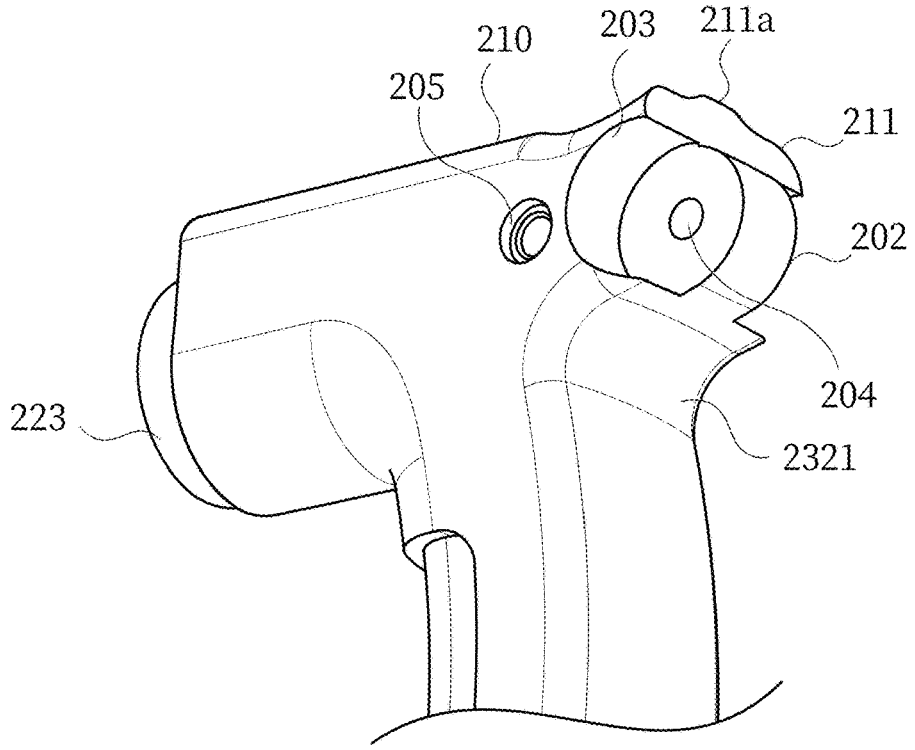
FIG. 4B is a partial perspective view of the second arm of the grip strength enhancement device of FIG. 4.
Figure 4C:
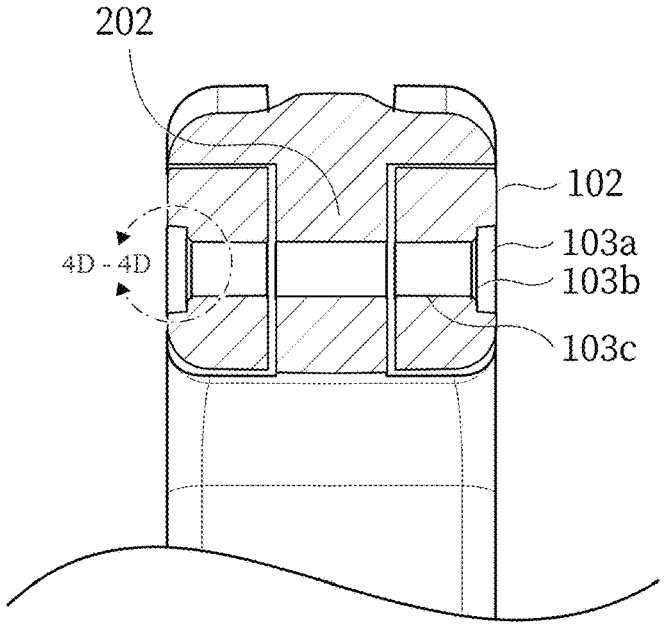
FIG. 4C is a partial sectional view of the assembled state of the first arm and the second arm of the grip strength enhancement device of FIG. 4.

FIG. 4 is a schematic side view of an assembled structure of the first arm 100 and the second arm 200 according to an embodiment of the present disclosure, and FIG. 4C is a sectional view taken along line 4C-4C in FIG. 4. As shown in FIG. 4C, in order to improve assembly efficiency of pivot pins and enhance connection stability and load-bearing performance, pin holes corresponding to respective pins are preferably designed as substantially identical stepped-hole structures. Hereinafter, the stepped-hole structure is described by using a first pin hole 103 (as used herein referring to an entire through hole forming the pivot structure) as an example.

Specifically, from an outer side surface of each lug toward an inner side thereof, the first pin hole 103 is sequentially divided along an axial direction thereof (i.e., along the axis Ay) into three coaxial sections, namely: a first stepped hole 103*a*, a second stepped hole 103*b*, and a third stepped hole 103*c*. Diameters D1, D2, and D3 of the three stepped holes satisfy D1>D2>D3, such that the diameter decreases from outside to inside, thereby forming an inwardly stepped profile on an inner wall of the hole.

In this preferred embodiment, to achieve desirable technical effects, parameter ranges of respective portions may be set as follows.

A diameter D1 of the first stepped hole 103*a* may be 4.0~6.0 mm, preferably 4.5~5.5 mm, and more preferably 5.0 mm. A primary function thereof is to provide a receiving seat for a head portion of a pivot pin (such as a rivet), such that after riveting or installation, the head portion can be flush with, or slightly recessed into, the outer side surface of the lug, thereby avoiding protrusion that may adversely affect appearance or cause scratching.

A diameter D3 of the third stepped hole 103*c* is preferably 2.0~4.0 mm, preferably 2.5 mm~3.5 mm, and more preferably 3.1 mm. The third stepped hole 103*c* forms a primary load-bearing region mating with a shank portion of the pivot pin, and its diameter forms a high-precision clearance fit or transition fit with an outer diameter of the shank portion, so as to ensure flexible rotation while minimizing radial play to the greatest extent.

A diameter D2 of the second stepped hole 103*b* is between D1 and D3, thereby providing an intermediate transition.

Figure 4D:
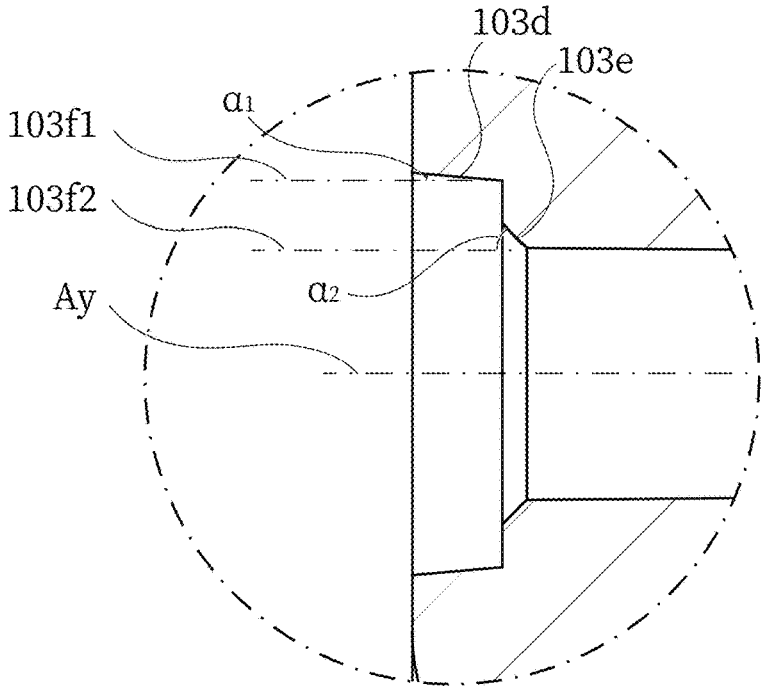
FIG. 4D is an enlarged view of a portion of the partial sectional view of FIG. 4C.
Figure 4E:
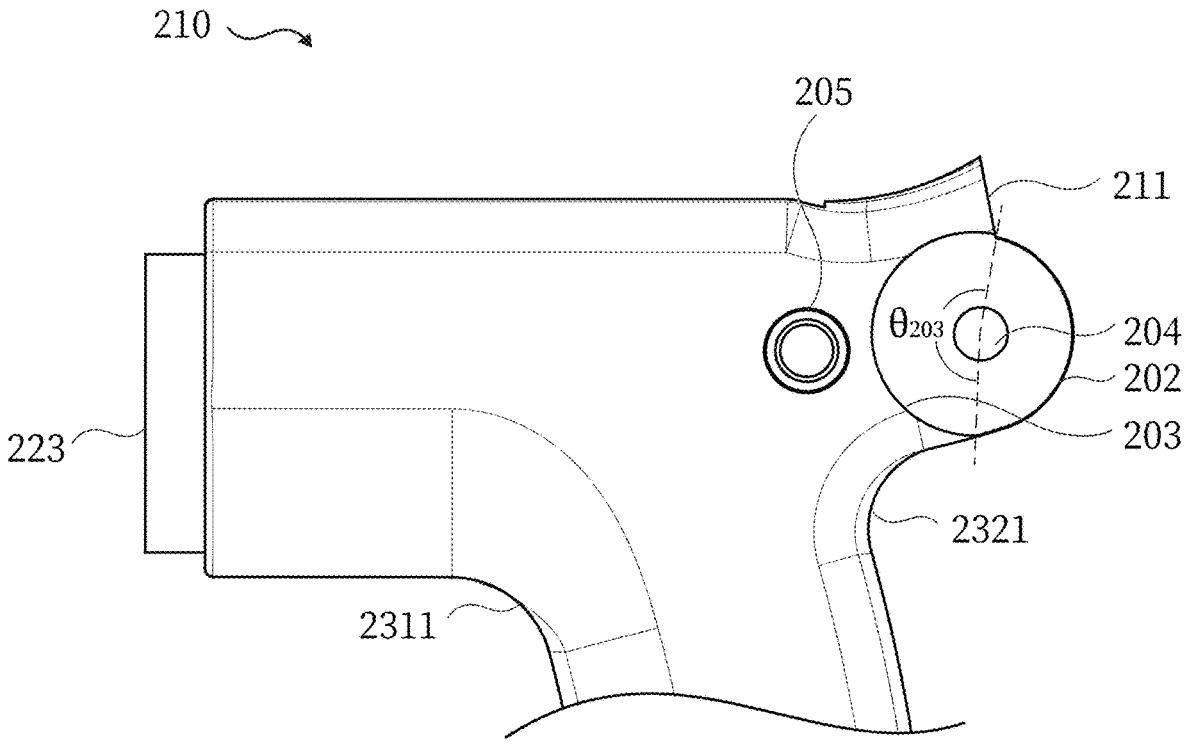
FIG. 4E is a partial side view of the second arm of the grip strength enhancement device of FIG. 4.

Critically, as shown in FIG. 4D, at junctions between stepped holes (i.e., transition interfaces between different diameters), instead of conventional 90-degree right-angle steps, inclined conical transition surfaces are provided. To achieve segmented guiding and positioning functions, different transition interfaces are designed with different angles in this embodiment.

A first conical transition surface 103*d* connects the first stepped hole 103*a* and the second stepped hole 103*b*. A first parallel line 103*f*1 parallel to the axis Ay of the third stepped hole 103*c* is drawn at a lower end of the first conical transition surface 103*d*, and an included angle between the first conical transition surface 103*d* and the first parallel line 103*f*1 is defined as $\alpha 1$. $\alpha 1$ is relatively small and may be set within a range of 3.0~10.0°, preferably 3.0°~6.0°, and more preferably 5.0°. Such a gentle slope primarily serves an initial coarse guiding function. A second conical transition surface 103*e* connects the second stepped hole 103*b* and the third stepped hole 103*c*. A second parallel line 103*f*2 parallel to the axis Ay of the third stepped hole 103*c* is drawn at a lower end of the second conical transition surface 103*e*, and an included angle between the second conical transition surface 103*e* and the second parallel line 103*f*2 is defined as $\alpha 2$. $\alpha 2$ is relatively large and may be set within a range of 30.0°~60.0°, preferably 40.0°~50.0°, and more preferably 45.2°. As can be seen, the two taper angles satisfy $\alpha 1<\alpha 2$.

Compared with a two-stage stepped-hole design in which only a single step is provided before the third stepped hole 103*c* (i.e., a hole structure including only 103*a* and 103*c*), the three-stage stepped-hole structure adopted in this embodiment, which includes the intermediate second stepped hole 103*b*, provides more significant technical advantages.

1. A step-by-step alignment function is achieved, thereby greatly improving assembly reliability: in a two-stage stepped-hole structure, a pivot pin needs to enter a smallest-diameter load-bearing hole directly from a largest-diameter guiding hole, and a large diameter span may cause the pivot pin to tilt or bind during insertion. In the present design, the second stepped hole 103*b* forms a critical "pre-alignment region." After initial guiding in the relatively large first stepped hole 103*a*, the pivot pin first enters the medium-diameter 103*b* for secondary alignment so that its posture is preliminarily corrected, and then precisely enters the third stepped hole 103*c* as a core mating region. This stepwise introduction mechanism of "coarse guidance-pre-alignment-precise positioning" greatly improves smoothness and first-pass success rate during assembly, and is particularly suitable for automated high-speed assembly scenarios.

2. Support is provided for special-profile pivot pins, thereby enhancing structural functionality: the intermediate stepped hole 103*b* provides a structural basis for using functionally more complex special-profile pivot pins (for example, a stepped rivet with a shoulder). A shoulder portion of the pivot pin can form a precise axial positioning surface or a radial load-bearing surface with a step surface of the second stepped hole 103*b*. This not only enables more precise control of axial clearance of the pivot, but also allows the shoulder portion to share part of a shear load, so that a load is more uniformly distributed over the pivot pin and the hole wall, rather than being concentrated only at the smallest third stepped hole 103*c*, thereby improving design flexibility and load-bearing capacity of the entire pivot structure.

3. A stepped stress-relief region is formed, thereby improving fatigue resistance: in load analysis, abrupt changes in cross-sectional size are a primary source of stress concentration. A single deep step from a largest diameter to a smallest diameter in a two-stage stepped hole can create a highly significant stress concentration point. By adding an intermediate step, the present design decomposes one major stress concentration point into two relatively gentle, discontinuous stress transition regions. When a load is transmitted from the pivot pin to the lug, it passes through "buffering" effects of two steps, so that a stress transmission path becomes smoother, effectively avoiding severe stress concentration caused by a single deep step, and thereby significantly improving fatigue strength and long-term reliability at this critical connection point.

Accordingly, adding the second stepped hole 103*b* is not a simple redundant design, but rather comprehensively optimizes and enhances the pivot structure in three dimensions, namely, assembly process, structural functionality, and mechanical performance, by constructing an intermediate transition region.

Figure 5:
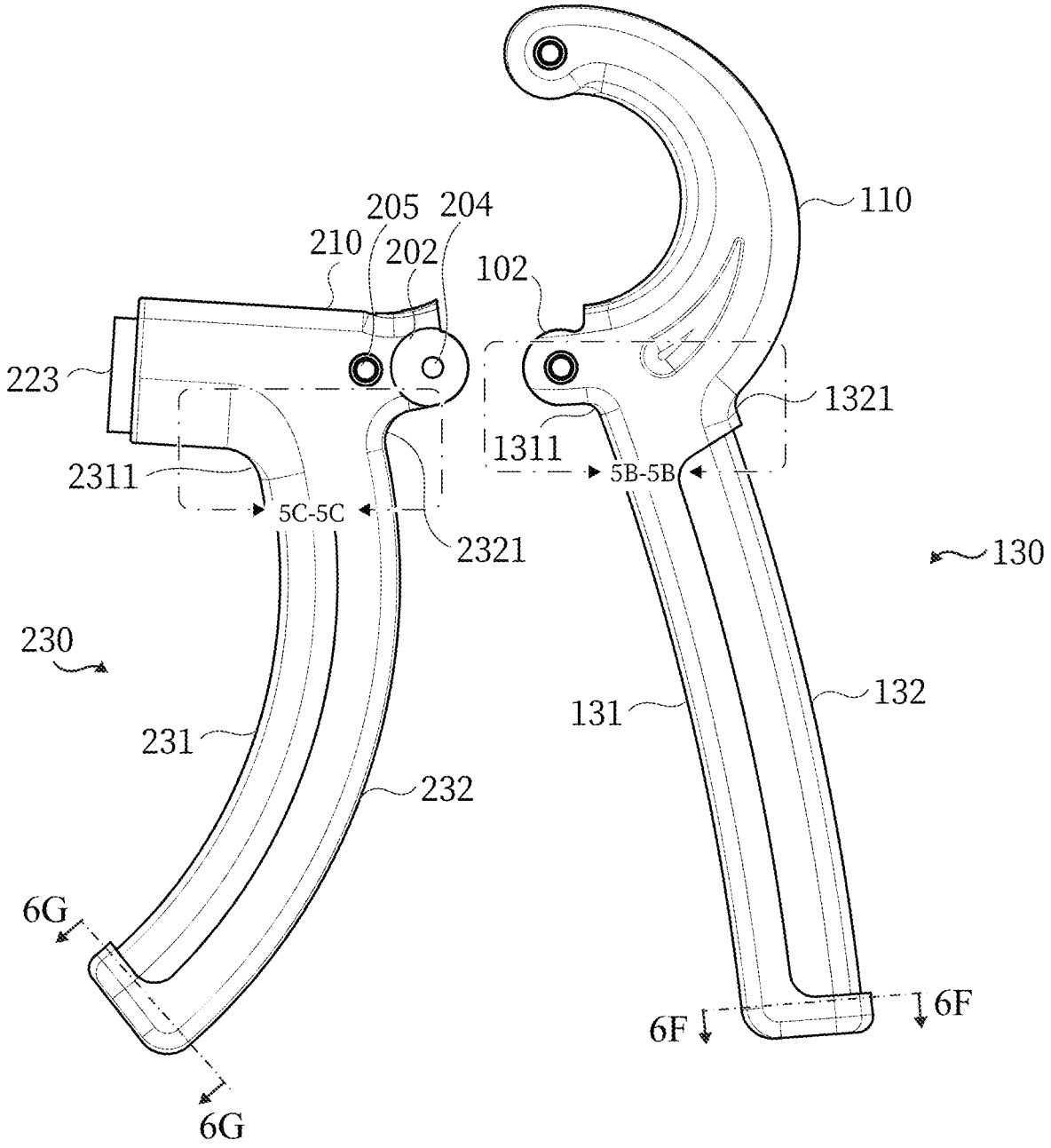
FIG. 5 is a side view of the first arm and the second arm of the grip strength enhancement device according to an embodiment of the present disclosure.
Figure 5A:
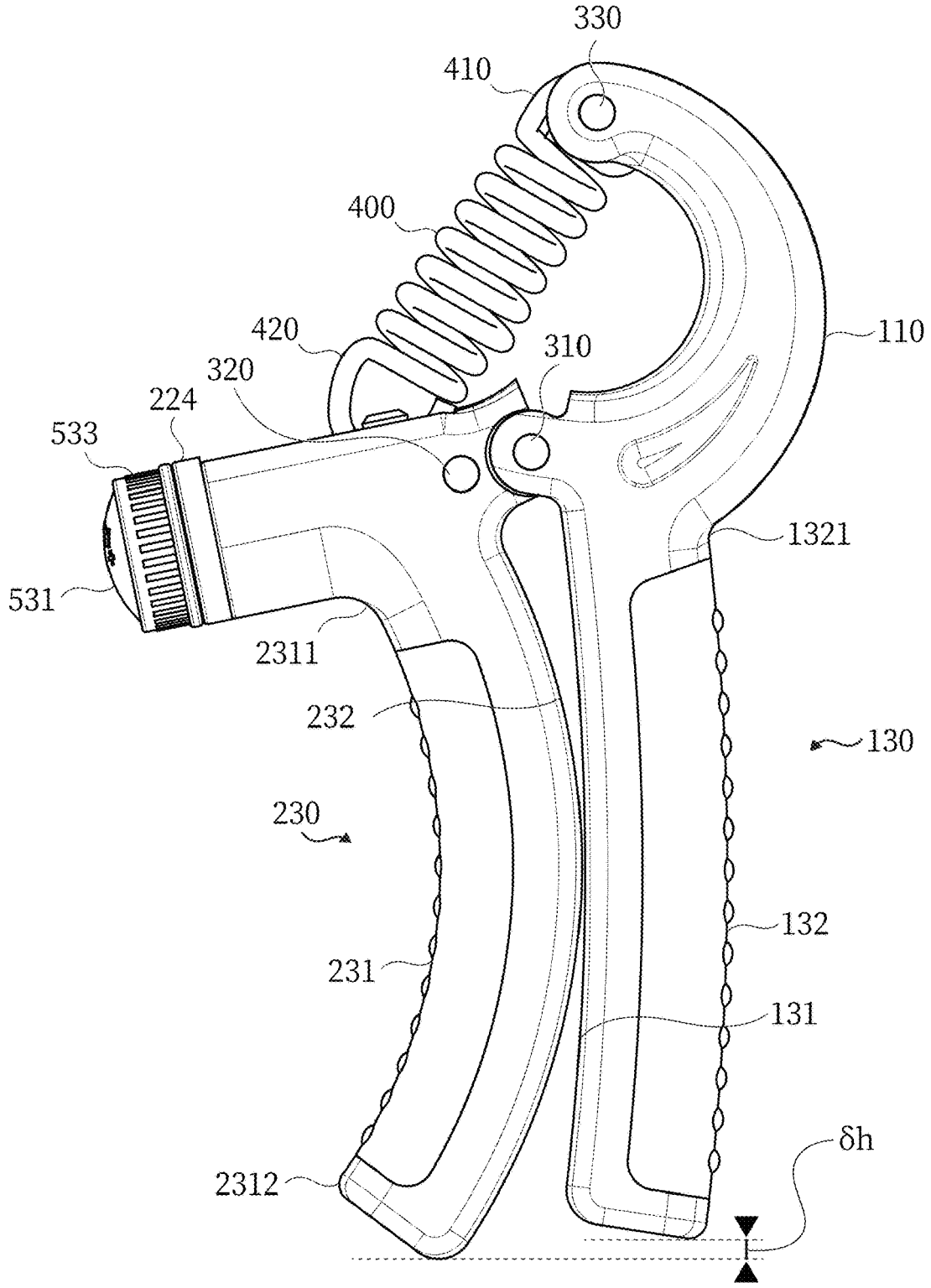
FIG. 5A is a side view of the first arm and the second arm of the grip strength enhancement device in a closed state according to an embodiment of the present disclosure.
Figure 5B:
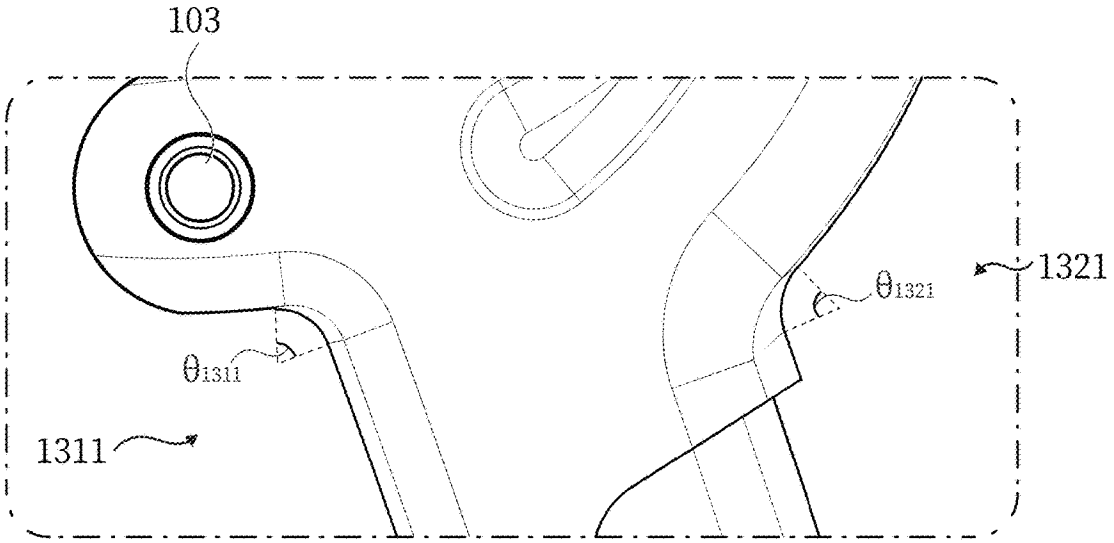
FIGS. 5B-5C are enlarged partial views of FIG. 5.
Figure 5C:
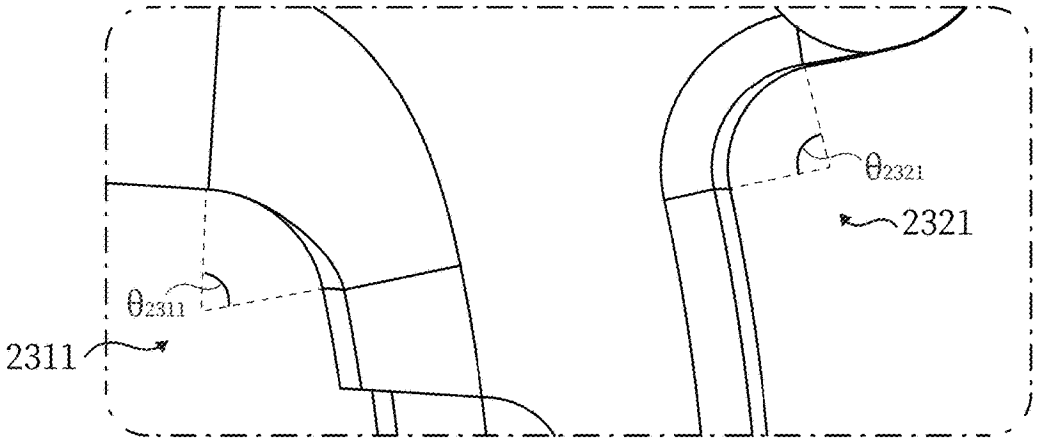

As shown in FIGS. 5-5C, to provide a comfortable and stable gripping experience, a second portion of each of the first arm 100 and the second arm 200 integrally extends downwardly to form an ergonomically contoured first handle 130 and second handle 230, respectively.

An outer layer of a base body of each of the first handle 130 and the second handle 230 is preferably covered with an elastic overmold layer, respectively a first elastic contact layer 140 and a second elastic contact layer 240. These overmold layers are precisely applied on the handle base bodies, and overall outer contours thereof conform to contour trends of the handle base bodies. This design adds an elastic tactile feel and anti-slip characteristics on the basis of an already-defined precise ergonomic geometry of the handle base bodies. Accordingly, ergonomic surfaces described in detail below (such as a bearing surface 132, a gripping surface 231, and the like) refer to final human-machine interaction surfaces formed by the overmold layers and directly contacting a user's hand 600.

Specifically, a rear side surface of the first handle 130 may be configured as an arcuate bearing surface 132, which, when the user grips the device, can abut against a thenar muscle region 610 of the hand 600. This configuration allows grip force to be smoothly transmitted to the device during exertion, and a relatively large contact area helps distribute pressure to avoid discomfort caused by excessive localized pressure.

Figure 6:
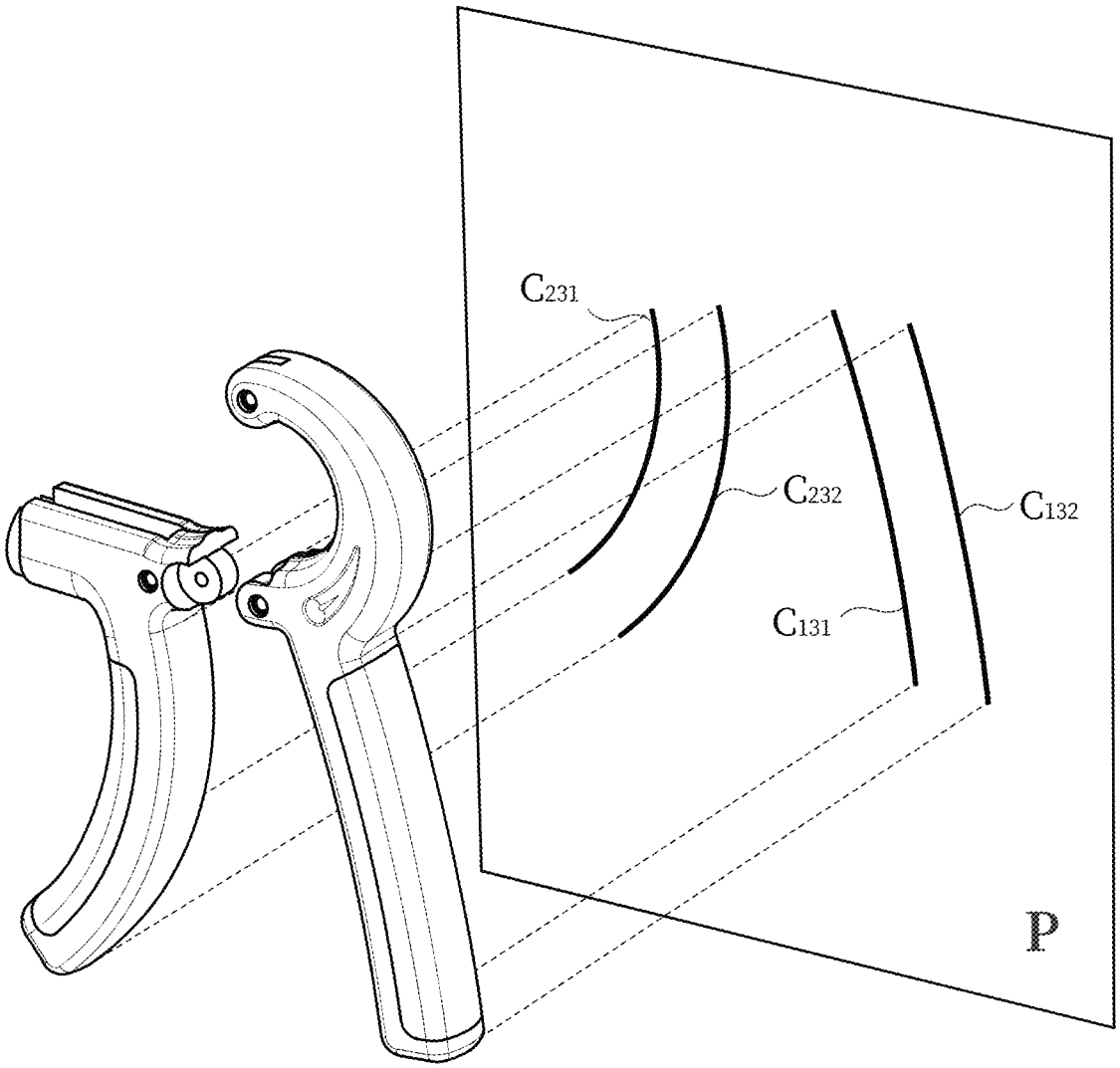
FIG. 6 is a first schematic projection view of outer contours of a first handle and a second handle of the grip strength enhancement device according to an embodiment of the present disclosure.
Figure 6A:
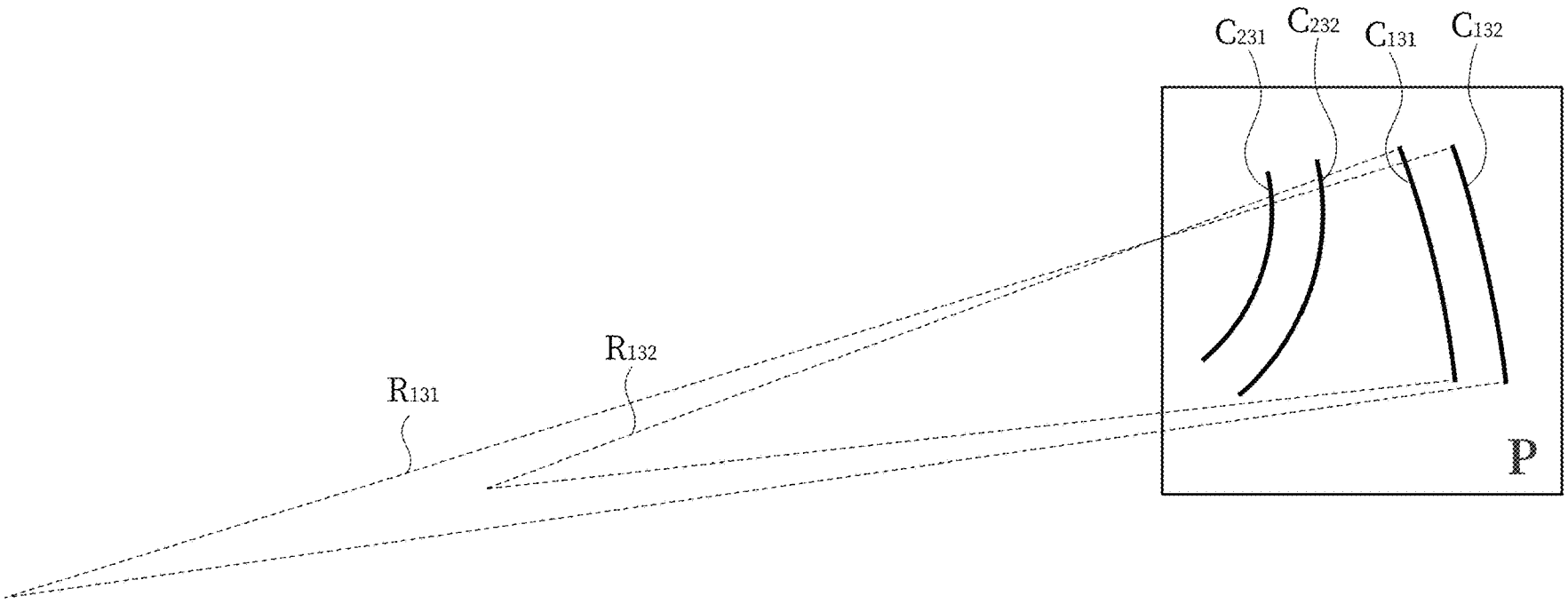
FIG. 6A is a second schematic projection view of the outer contours of the first handle and the second handle of the grip strength enhancement device according to an embodiment of the present disclosure.
Figure 6B:
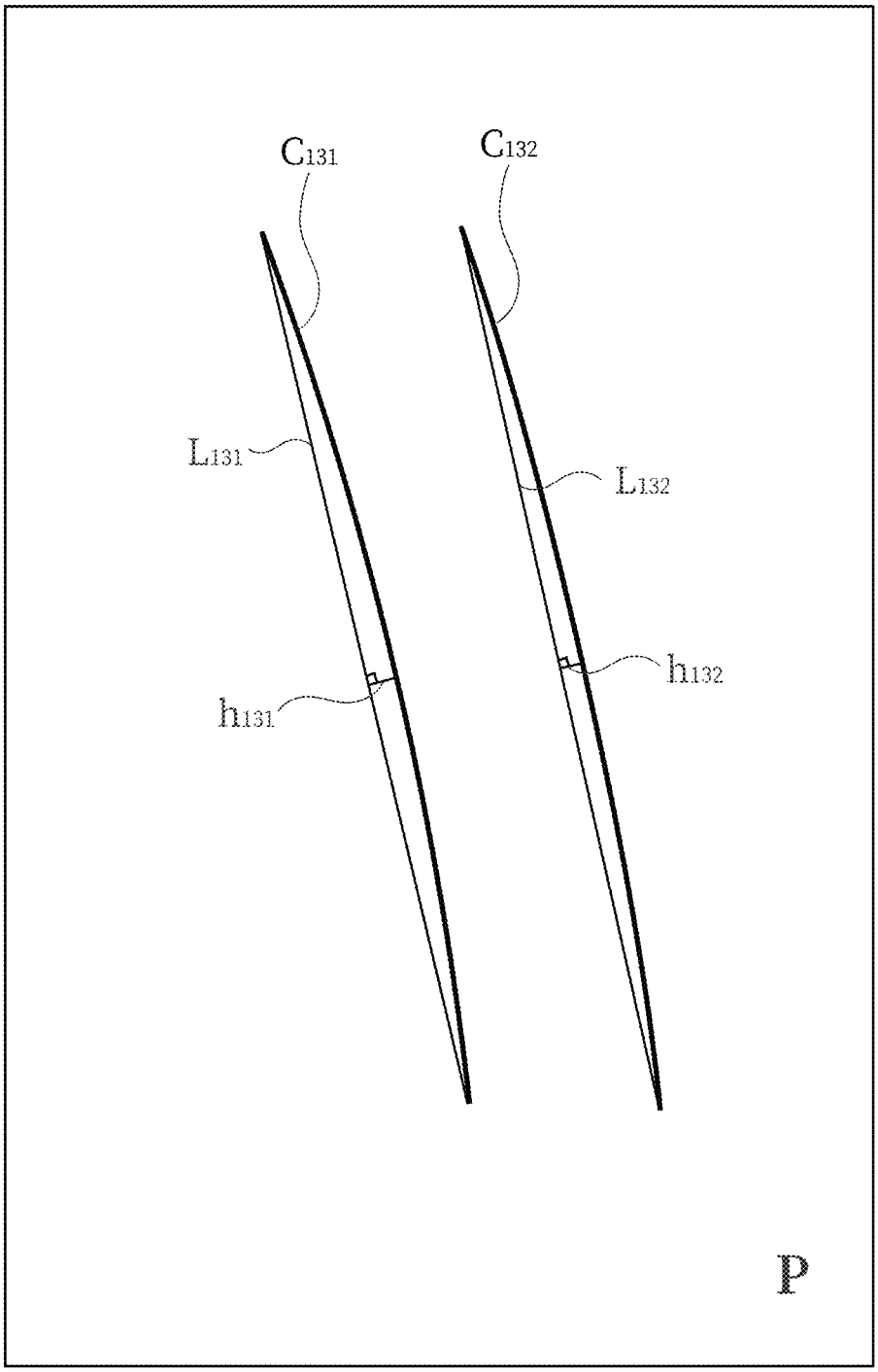
FIG. 6B is a schematic projection view of an outer contour of the first handle of the grip strength enhancement device according to an embodiment of the present disclosure.
Figure 6C:
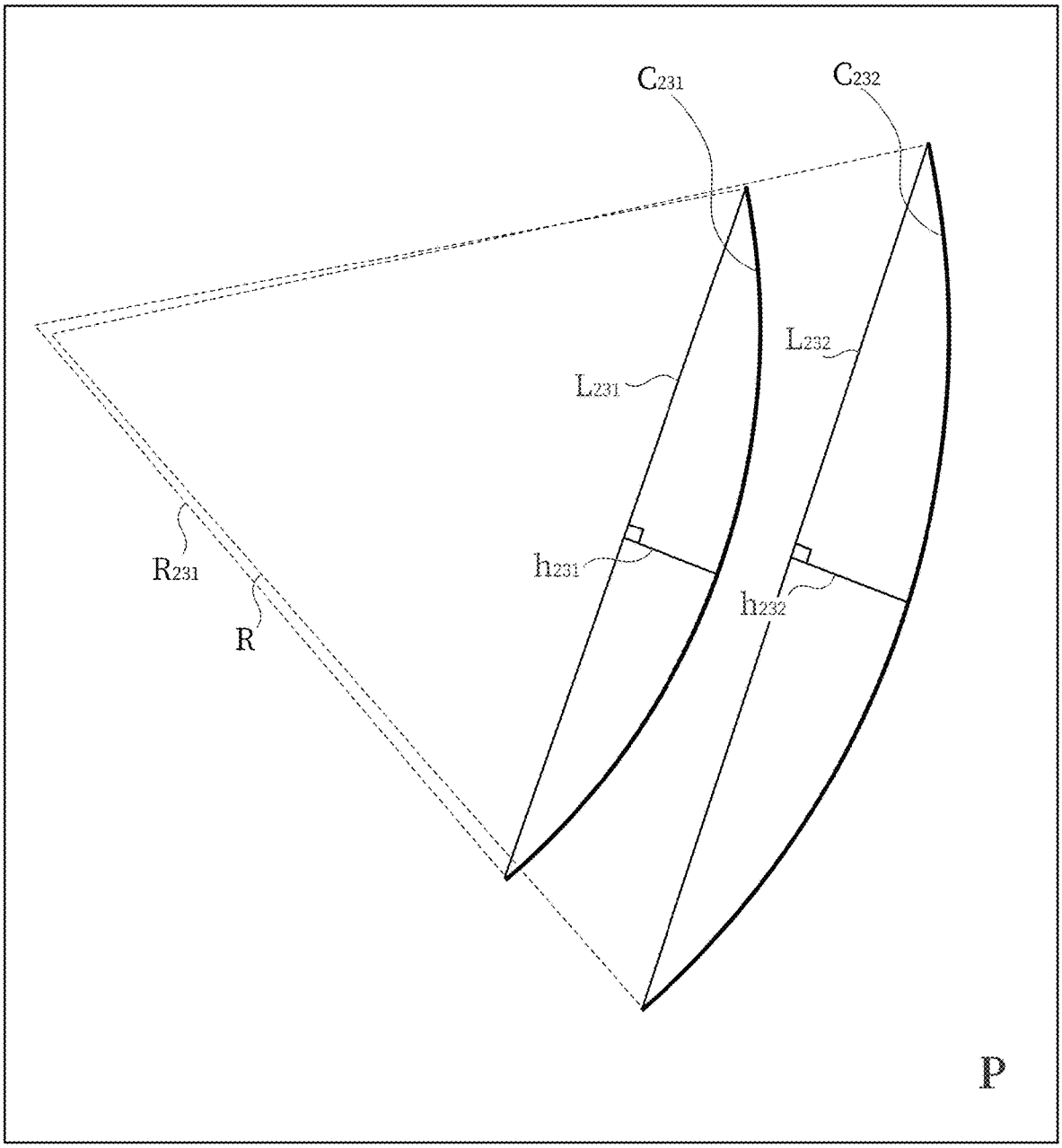
FIG. 6C is a schematic projection view of an outer contour of the second handle of the grip strength enhancement device according to an embodiment of the present disclosure.

Further, as shown in FIGS. 6-6C, this embodiment provides a refined ergonomic design for side-view profiles of the first handle 130 and the second handle 230.

First, a side-view reference plane P is defined as a plane in which side-view projections of two arms of the grip-strengthening device in a natural state lie. Within the plane P, four primary side-view contour curves of the two handles are defined as follows.

C131: a projected contour of a front side surface 131 of the first handle 130 in the plane P.

C132: a projected contour of the bearing surface 132 of the first handle 130 in the plane P.

C231: a projected contour of the gripping surface 231 of the second handle 230 in the plane P.

C232: a projected contour of an extension surface 232 of the second handle 230 in the plane P.

As shown in FIG. 6, the front side surface 131 forms a continuous smooth contour curve C131 in the side-view reference plane P. An effective range of the curve starts at an upper tangency point Tu (of a first transition fillet 1311, not shown) and ends at a lower tangency point Tl (of a bottom-end fillet of the handle). A chord connecting points Tu and Tl has a length LC131. A maximum normal distance from the chord to the contour curve C131 (i.e., a sagitta) is denoted as h131. Accordingly, a curvature degree of the front side surface 131 is defined as ζ131=h131/LC131.

Preferably, the contour curve C131 is concave along a front (+x) direction, and may be a single circular arc, or a combination of two circular arcs of different radii joined in a tangentially continuous (G1—continuous) manner. A range of the curvature degree ζ131 may be 0.020~0.040, preferably 0.025~0.035, and more preferably 0.030.

As shown in FIG. 6B, the contour curve C132 formed by the bearing surface 132 in the plane P is primarily configured to conform to the thenar muscle region 610 of the user. The curvature degree thereof is defined in the same manner as for the front side surface, that is, ζ132=h132/LC132. To form a fuller supporting surface for conforming to palm musculature, the curve C132 is convex along the +X direction, and an overall curvature degree thereof is greater than that of C131.

A range of the curvature degree ζ132 may be 0.01~0.03, preferably 0.015~0.025, and more preferably 0.02. When an effective handle length is 90~100 mm, a corresponding equivalent radius R132 is about 500.0~700.0 mm, preferably 550.0~650.0 mm, and more preferably 608.8 mm.

Further, to achieve initial conformance and end-region pressure relief with respect to the thenar muscle region, a local curvature-gain segment may be provided at a middle-upper portion of C132, such that curvature monotonically decreases from top to bottom (i.e., a radius of curvature monotonically increases with arc length). To ensure smoothness of the contact surface, the curve satisfies at least G1 continuity, and preferably G2 continuity.

Figure 16:
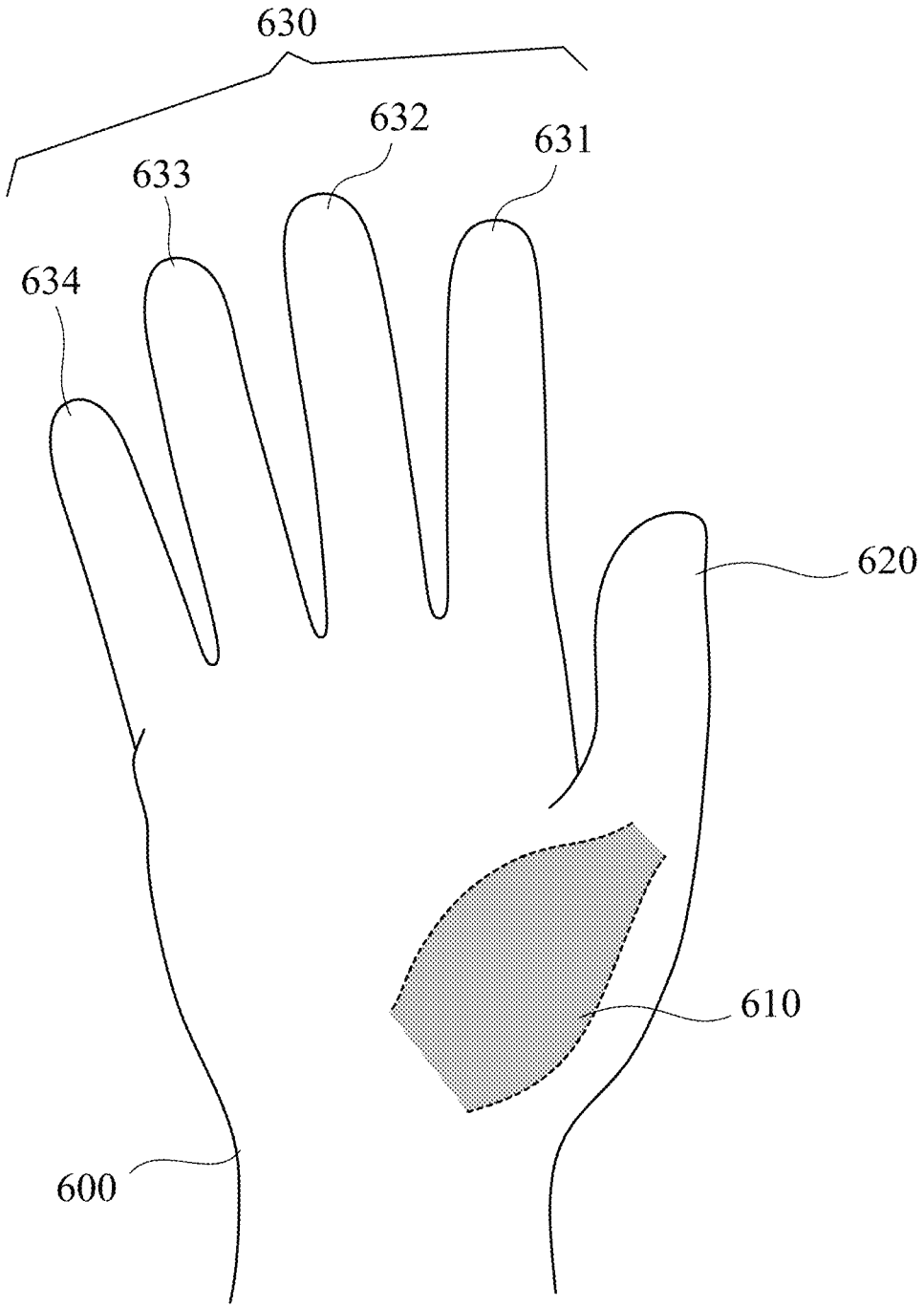
FIG. 16 is a schematic view of a palm.

As shown in FIGS. 6 and 16, the contour curve C231 formed by the gripping surface 231 in the plane P is primarily configured for conforming grip by four fingers 630 (including an index finger 631, a middle finger 632, a ring finger 633, and a little finger 634) of the user. The curve C231 is concave along the +x direction, and is preferably a single circular arc or a tangentially continuous combination of two circular arcs.

A range of the curvature degree ζ231 may be 0.12~0.16, preferably 0.13~0.14, and more preferably 0.135. When an effective handle length is 70~90 mm, a corresponding equivalent radius R231 may be 70~90 mm, preferably 75~85 mm, and more preferably 78 mm.

A range of the curvature degree (232 of the extension surface 232 may be 0.12~0.16, preferably 0.13~0.14, and more preferably 0.136.

Therefore, as shown in FIG. 5A, because both the extension surface 232 and the front side surface 131 are curved, when the first handle 130 and the second handle 230 are brought together, they are tangential at a point near a middle portion of the handles, that is, the first handle 130 and the second handle 230 do not tightly abut against each other. This design can avoid motion interference. If both the first handle 130 and the second handle 230 were not recessed along the +x direction, the two handles would collide with each other prematurely before reaching a fully closed limit position, thereby limiting a maximum compressible stroke of the gripper; further, if curvatures of the two handles were identical, a dangerous pinch region could readily be formed between a side surface of the handle and a user's palm. In this embodiment, different curvatures of the two handles reserve a necessary physical clearance for full closure, thereby greatly reducing a risk of pinching the user's palm.

In addition, when the first handle 130 and the second handle 230 are gripped to a closed or nearly closed state, bottom ends thereof are not aligned to be equal in a longitudinal (y-axis) direction. Specifically, the bottom end of the second handle 230 is designed to be slightly longer than the bottom end of the first handle 130, thereby forming a predetermined vertical height difference δh between them. According to a preferred implementation, the height difference &h may be 1.0~4.0 mm, preferably 2.5~3.5 mm, and more preferably 2.9 mm.

This seemingly minor unequal-length design is not arbitrary, but is a precise optimization based on an understanding of biomechanical characteristics of human grasping. When a human hand naturally forms a first from a relaxed state, metacarpophalangeal joints of four fingers do not lie on a straight line, but instead form a natural physiological arc rising obliquely from the index finger 631 toward the little finger 634. Accordingly, at completion of grasping, terminal positions of the little finger 634 and the ring finger 633 are naturally higher than terminal positions of the index finger 631 and the middle finger 632. If bottom ends of the two handles were equal in length, or if the second handle 230 were shorter than the first handle 130, in order to fully contact the handle with all fingers, the user's wrist might unconsciously perform ulnar deviation (a deflection toward the little finger 634) as compensation. Such an unnatural posture increases stress on the wrist joint, not only reducing force efficiency but also potentially increasing a risk of sports injury over time. A proper gripping posture requires pressure to be uniformly distributed over the entire palm and fingers, and the unequal-length design helps achieve this.

In the present device, the second handle 230 is primarily hook-gripped by the four fingers 630, whereas the first handle 130 is primarily pressed by the palm (the thenar eminence and the central palm). By configuring the second handle 230 to be slightly longer (i.e., with its bottom end positioned slightly lower), the design closely matches an end curvature formed when the fingers naturally close. As a result, the palm and all fingers can conform to the handles in a most natural and relaxed posture, thereby avoiding localized stress caused by adapting to an uneven contact surface. This ensures that, when the user exerts force, the forearm, wrist, and palm can remain substantially aligned in a straight line, and force can be transmitted more directly and efficiently from forearm muscle groups to the grip strength enhancement device. This not only improves training effectiveness, but also makes the overall grip more secure and stable, allowing the user to safely challenge higher resistance and fundamentally protecting wrist joint health.

To optimize structural integrity and mechanical performance, as shown in FIGS. 5B and 5C, the first handle 130 and an upper half of the first arm 100 may adopt an integrally formed design with smooth transitions. An upper end of the front side surface 131 of the first handle 130 is connected to a lower end of the lug 102*a* of the clevis-type bearing seat 102 through a first transition fillet 1311. Meanwhile, an upper end of the bearing surface 132 of the first handle 130 may be joined to a lower end of an arc portion of the arcuate arm 110 through a second transition fillet 1321.

A central angle of an arc corresponding to the first transition fillet 1311 is denoted as θ1311, and a central angle of an arc corresponding to the second transition fillet 1321 is denoted as θ1321, wherein θ1311 may be 60°~85°, preferably 70°~80°, and more preferably 72.4°; and θ1321 may be 40.0°~60.0°, preferably 50.0°~60.0°, and more preferably 50.3°.

Corresponding to the first handle 130, the second handle 230 likewise adopts an integral and ergonomic design. A front side surface of the second handle 230 is an arcuate gripping surface 231, on which the four fingers 630 of the user's hand 600 primarily grip during use. A rear side surface of the second handle 230 is an extension surface 232.

To ensure structural integrity and continuity of load transmission, the second handle 230 and an upper half of the second arm 200 likewise adopt smooth transitions. Specifically, an upper end of the gripping surface 231 of the second handle 230 is joined to a lower end of the base arm 210 through a third transition fillet 2311. Meanwhile, an upper end of the extension surface 232 is joined to a lower end of an outer arcuate surface of the pivot portion 202 through a fourth transition fillet 2321.

A central angle of an arc corresponding to the third transition fillet 2311 is denoted as θ2311, and a central angle of an arc corresponding to the fourth transition fillet 2321 is denoted as θ2321, wherein θ2311 may be 50.0°~70.0°, preferably 55.0°~65.0°, and more preferably 60.5°; and θ2321 may be 80.0°~95.0°, preferably 90.0°~95.0°, and more preferably 93.1°.

Such filleted transition designs can mitigate stress concentration and improve structural strength and durability. In a repeatedly loaded device such as a hand gripper, junctions between different geometries (such as junctions between a handle and a functional arm) are natural stress concentration points. Without smooth filleted transitions, stress may concentrate at sharp corners, and long-term use can readily lead to material fatigue and micro-cracks, ultimately resulting in structural fracture. Core functions of the first, second, third, and fourth transition fillets 1311, 1321, 2311, and 2321 are to replace such sharp corners with smooth arcuate surfaces, so that internal stress generated during gripping can be transmitted uniformly and smoothly along the arcs, thereby effectively dispersing stress peaks.

Because arm bodies of the device are preferably integrally formed by injection molding or die casting, designs of these four transition fillets, particularly the inner fillets 1311 and 2311, provide smooth flow paths for material flow, ensuring that a mold cavity can be completely and uniformly filled, thereby improving density, strength, and surface quality of the finished product. Meanwhile, smooth mold—cavity geometries reduce stringent requirements on process parameters such as injection pressure and temperature, making the production process more stable and ensuring dimensional and performance consistency across different product batches.

Central angles of the four transition fillets (θ1311, θ1321, θ2311, and θ2321) are set within different precise ranges and optimal values. This is not an arbitrary selection, but rather an optimization result based on finite element analysis (FEA) of load conditions at different locations. For example, front side and rear side surfaces exhibit different tensile and compressive stress modes under load, and thus require fillets with different curvatures to achieve optimal stress-relief effects.

Figure 6D:
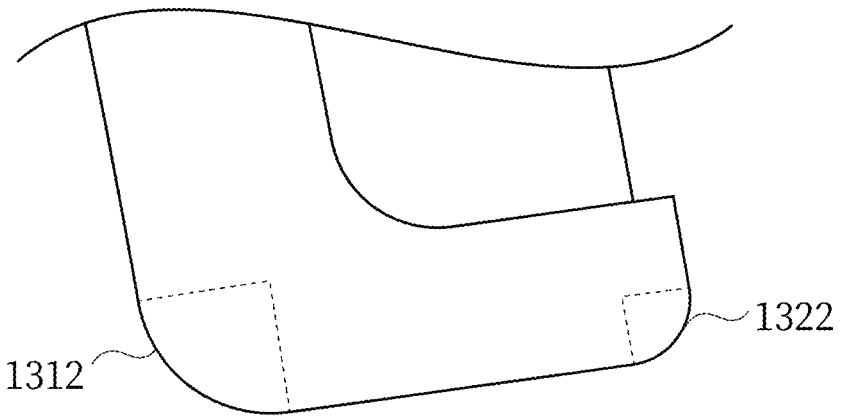
FIGS. 6D-6E are side views of a bottom end of the first handle and a bottom end of the second handle of the grip strength enhancement device according to an embodiment of the present disclosure.
Figure 6E:
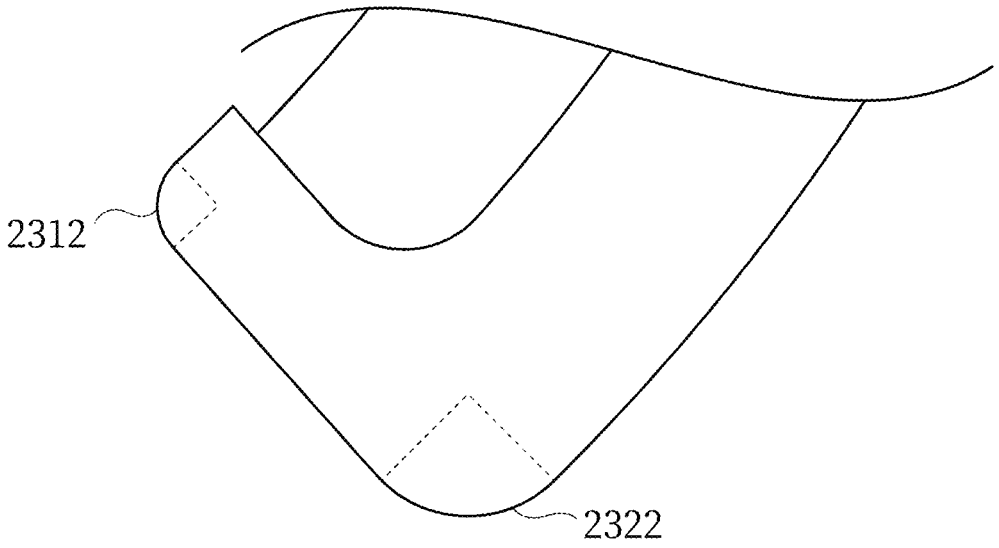

In addition, FIG. 6E and FIG. 6D show details at bottoms of the handles, and bottom ends of the first handle 130 and the second handle 230 are provided with specific bottom-end transition fillets. Specifically, these fillets include:

- a first bottom—end fillet 1312 at a bottom end of the front side surface 131 of the first handle 130.
- a second bottom—end fillet 1322 at a bottom end of the bearing surface 132 of the first handle 130.
- a third bottom—end fillet 2312 at a bottom end of the gripping surface 231 of the second handle 230.
- a fourth bottom—end fillet 2322 at a bottom end of the extension surface 232 of the second handle 230.

Figure 6F:
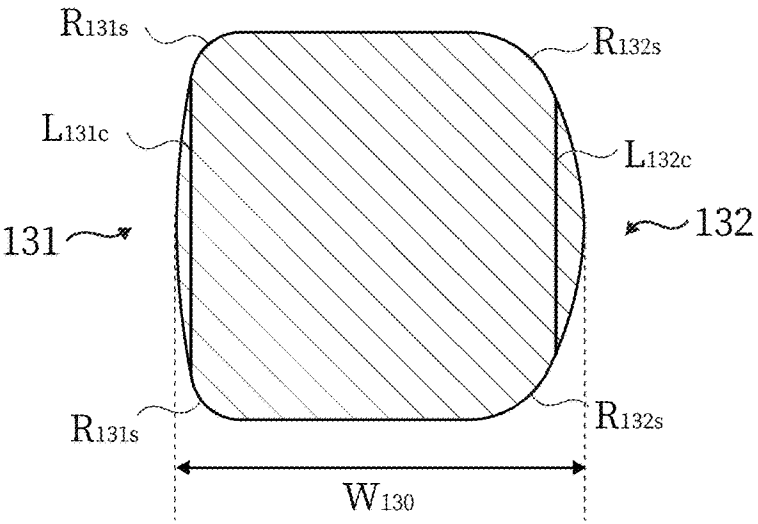
FIGS. 6F-6G are sectional views of the first handle and the second handle of the grip strength enhancement device according to an embodiment of the present disclosure.
Figure 6G:
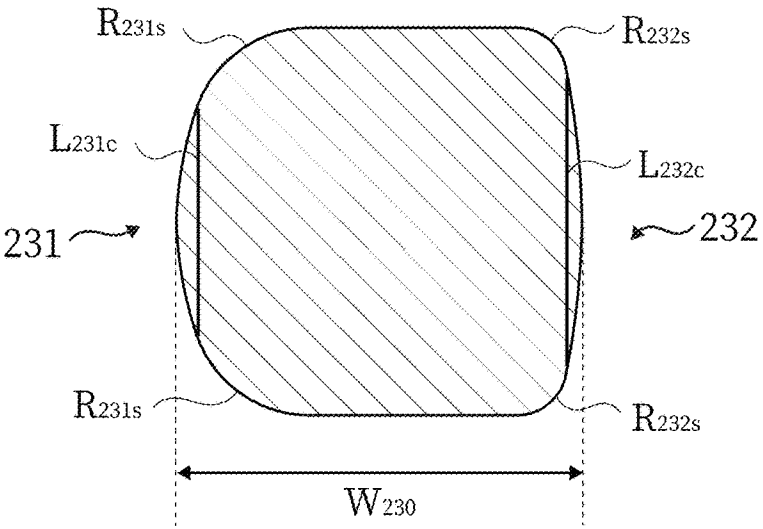

In this preferred embodiment, radii (R) and central angles (θ) of the above fillets are set with differentiated parameter values:

- A radius R1312 of the first bottom-end fillet 1312 may be 4.0~6.0 mm, preferably 4.5~5.5 mm, and more preferably 5.0 mm; and a central angle θ1312 may be 80°~100°, preferably 85°~95°, and more preferably 90°;
- A radius R1322 of the second bottom-end fillet 1322 may be 1.0~3.0 mm, preferably 2.0~3.0 mm, and more preferably 2.5 mm; and a central angle θ1322 may be 80°~100°, preferably 85°~95°, and more preferably 90°;
- A radius R2312 of the third bottom-end fillet 2312 may be 1.0~3.0 mm, preferably 2.0~3.0 mm, and more preferably 2.5 mm; and a central angle θ2312 may be 80°~100°, preferably 85°~95°, and more preferably 90°;
- A radius R2322 of the fourth bottom-end fillet 2322 may be 4.0~6.0 mm, preferably 4.5~5.5 mm, and more preferably 5.0 mm; and a central angle θ2322 may be 80°~100°, preferably 85°~95°, and more preferably 90°;

As shown in FIG. 5, the first handle 130 and the second handle 230 are sectioned along line 6F-6F and line 6G-6G, respectively, to obtain typical cross-sectional profiles shown in FIG. 6F and FIG. 6G. Each section plane is parallel to a local normal direction of a respective handle at the corresponding position, and is orthogonal to a longitudinal centerline of the handle. In cross sections shown in FIG. 6F and FIG. 6G, for ease of description, surfaces are defined as follows:

Contact surfaces: load-bearing surfaces that directly contact a user's hand during use, namely, the bearing surface 132 of the first handle 130 and the gripping surface 231 of the second handle 230.

Inner surfaces: surfaces opposite to the contact surfaces and not being primary contact surfaces, namely, the front side surface 131 of the first handle 130 and the extension surface 232 of the second handle 230.

Based on the above definitions, thicknesses of the handles can also be precisely described. Specifically, a thickness of the first handle 130 is defined as a distance W130 measured, in the cross section shown in FIG. 6F, between the bearing surface 132 and the front side surface 131 along the local normal direction of the section, wherein W130 may be 19~22 mm, preferably 20~21 mm, and more preferably 20.26 mm. Correspondingly, a thickness of the second handle 230 is defined as a distance W230 measured, in the cross section shown in FIG. 6G, between the gripping surface 231 and the extension surface 232 along the local normal direction of the section, wherein W230 may be 19~22 mm, preferably 20~21 mm, and more preferably 20.16 mm.

Such a slight dimensional difference in which W130 is slightly greater than W230 (as indicated by the most preferred values) constitutes an ergonomic optimization targeted to two different gripping regions. The first handle 130 serves as a supporting surface primarily pressed by the thenar muscle region of the palm, and a slightly fuller thickness helps distribute pressure more uniformly and provides a stable and comfortable support base. Meanwhile, the second handle 230 is primarily hook-gripped by the four fingers 630, and a slightly slimmer thickness facilitates full curling and secure gripping by the fingers, particularly the relatively shorter little finger 634 and ring finger 633. At the same time, to accommodate grip modes described below, a thickness difference between the first handle 130 and the second handle 230 should be as small as practicable, so that a user can obtain a high level of comfort regardless of a training posture used.

In the cross section of the first handle 130 (FIG. 6F), a fillet radius on two sides of the bearing surface 132 is denoted as R132*s*. A fillet radius on two sides of the front side surface 131 is denoted as R131*s*.

In the cross section of the second handle 230 (FIG. 6G), a fillet radius on two sides of the gripping surface 231 is denoted as R231*s*. A fillet radius on two sides of the extension surface 232 is denoted as R232*s*.

The above transitions are preferably implemented as standard circular arcs, and may also be implemented as spline curves defined by equivalent fillet radii. When a three-point fitting measurement method is used (points taken at two tangency points at opposite ends of a fillet and a point of maximum curvature), an equivalent radius should satisfy the following parameter ranges and relationships.

For the first handle 130, a range of the radius R132*s* on two sides of the contact surface may be 3.5~7.0 mm, preferably 4.0~5.5 mm, and more preferably 4.5 mm. A range of the radius R131*s* on two sides of the inner surface may be 1.0~3.0 mm, preferably 2.0~3.0 mm, and more preferably 2.5 mm. A ratio k1=R132*s*/R131*s* may be 1.2~3.0, preferably 1.5~2.0, and more preferably 1.8.

For the second handle 230, a range of the edge radius R231*s* of the contact surface may be 5.0~8.0 mm, preferably 5.5~6.5 mm, and more preferably 6.0 mm. A range of the edge radius R232*s* of the inner surface may be 1.0~3.0 mm, preferably 2.0~3.0 mm, and more preferably 2.5 mm.

A ratio K2=R231*s*/R232*s* may be 1.5~4.0, preferably 2.0~3.0, and more preferably 2.4.

To ensure continuity of tactile feel, a deviation of the above fillet radii along a longitudinal direction of the handle does not exceed ±15% of a nominal value thereof (except for large-radius bottom-end transition regions 1312/2322). Measurement may be performed using a contact profilometer or a three-point fitting method using a coordinate measuring machine (CMM). For structures including an overmold layer, unless otherwise specified, an equivalent radius is based on an outer surface of the overmold layer.

To achieve optimal conformance and mechanical performance at a human-machine interaction level, this embodiment further provides a refined design for circumferential curvature of cross sections of the two handles. This design cooperates with the above-described asymmetric edge-fillet design, and together forms an ergonomic gripping system of the present disclosure.

For any circumferential surface (for example, the bearing surface 132), curvature thereof is quantified according to the following procedure: two points that are tangent to adjacent transition fillets on both sides (such as R132*s*) are selected, and a chord connecting the two points is formed, with a chord length denoted as L; a maximum normal distance from a midpoint of the chord to a contour of the circumferential surface (i.e., a sagitta) is measured and denoted as h (not shown).

Accordingly, a dimensionless circumferential curvature coefficient is defined as $\zeta c=h/L$.

Note: The above measurement ranges do not include transition fillet regions on both sides. Locations of tangency points are preferably determined using a three-point fitting method. For structures including an overmold layer, all measurements are based on an outer-surface contour. To ensure continuity of tactile feel, an allowable fluctuation range of each circumferential curvature coefficient $\zeta c$ along a longitudinal direction of the handle should not exceed ±15% of its nominal value (except for large-radius bottom-end transition regions 1312/2322).

When a contour of the surface is approximately a circular arc, an equivalent circumferential radius may be estimated by: $R=L^2/(8h)+h/2$.

To achieve desirable conformance and pressure-distribution effects, circumferential curvature of each contact surface is preferably greater than circumferential curvature of a corresponding inner surface. This relationship is defined by the following measurable parameter ranges and ratios.

In the first handle 130, a circumferential curvature coefficient (132*c* of the bearing surface 132 may be 0.06~0.15, preferably 0.10~0.13, and more preferably 0.12. A chord length L132*c* may be 12~15 mm, preferably 13.5~14.5 mm, and more preferably 14.2 mm. A corresponding equivalent circumferential radius R132*c* may be 12.50~16.63 mm, preferably 14.06~15.10 mm, and more preferably 14.79 mm.

A circumferential curvature coefficient 2131*c* of the front side surface 131 may be 0~0.2, preferably 0~0.1, and more preferably 0 (i.e., the front side surface 131 is circumferentially flat). A chord length L131*c* may be 13~16 mm, preferably 14.5~15.5 mm, and more preferably 15.25 mm.

In the second handle 230, a circumferential curvature coefficient (231*c* of the gripping surface 231 may be 0.06~0.15, preferably 0.08~0.10, and more preferably 0.09. A chord length L231*c* may be 10~13 mm, preferably 10.5~12 mm, and more preferably 11 mm. A corresponding equivalent circumferential radius R231*c* may be 14.20~18.46 mm, preferably 14.91~17.05 mm, and more preferably 15.63 mm.

A circumferential curvature coefficient (232*c* of the extension surface 232 may be 0~0.07, preferably 0~0.05, and more preferably 0 (i.e., the extension surface 232 is circumferentially flat). A chord length L232*c* may be 13~16 mm, preferably 14.5~15.5 mm, and more preferably 15.25 mm.

By combining the circumferential curvature design of the present device with the above-described "asymmetric edge fillets," a synergistic technical effect is achieved.

A larger circumferential curvature (i.e., a larger (c value) of each contact surface cooperates with a larger edge-fillet radius to form an ideal "high-arch+blunt-edge" contact model for a thenar muscle region and finger pads. Under this model, gripping pressure is distributed extremely uniformly over a broader curved surface, effectively eliminating pressure concentration points and significantly reducing both peak pressure and pressure gradients, thereby fundamentally addressing issues such as localized pressure pain, numbness, and even blisters that may occur during long-duration, high-intensity training. Meanwhile, a smaller circumferential curvature (a flatter surface) on the inner side cooperates with a smaller edge-fillet radius (a sharper outline) to provide a clear "boundary feel" without cutting the hand.

Under high-load exertion, this boundary feel passively guides and positions a hand shape, effectively suppressing lateral slipping of the palm within the handle. At the same time, the highly rounded contact surface allows a palm to smoothly roll during slight posture adjustments, thereby avoiding discomfort caused by "edge biting."

The circumferential arch structure causes a distribution of normal reaction forces on the contact surface to be more diffuse, and together with the large edge fillets, effectively reduces stress concentration at four corners of the cross section. For structures including an overmold layer, this design can significantly reduce accumulation of shear deformation in a surface material under repeated loading, thereby greatly improving fatigue life of the overmold layer and bonding robustness between the overmold layer and a base body.

This design provides higher tolerance to minor dimensional deviations during manufacturing. On the most tactile-sensitive contact surface, the larger circumferential curvature and edge fillets make minor defects caused by non-uniform shrinkage during injection molding or overmolding less perceivable by a user. Meanwhile, on the visually more critical inner side, the smaller fillets maintain a crisp contour, thereby ensuring stable and refined product appearance.

As shown in FIG. 2, FIG. 4, and FIG. 4B, the second arm 200 is disposed opposite the first arm 100, and together they form force-applying members for a user's hand. A primary function of the base arm 210 is to provide a stable and reliable mounting base for subsequent installation of an adjustable elastic component. At an end of the base arm 210 proximate to the first arm 100, a flat or specially curved abutment portion is integrally formed or precisely machined, and this abutment portion constitutes a second stop portion 211. Correspondingly, a lower end of the arcuate arm 110 of an upper half of the first arm 100, i.e., a region proximate to a pivot center and opposing the base arm 210 of the second arm 200 along a motion path, is likewise provided with an integrally formed or precisely machined abutment surface, and this abutment surface constitutes a first stop portion 111.

When the present device is used for grip training, the first arm 100 and the second arm 200 rotate about the y-axis (a central axis of the pivot pin). During this process, the first stop portion 111 and the second stop portion 211 gradually move away from each other with rotation of the arms.

Provision of the first stop portion 111 and the second stop portion 211 provides significant technical advantages in both manufacturing and user safety. First, in manufacturing and assembly, these stop portions provide a clear alignment datum. By allowing the two arms to stably settle at a position where the stop portions contact each other (i.e., a "process zero position"), precise alignment of pivot holes is ensured. This makes installation of the pivot pin and the elastic component smoother, effectively addressing binding caused by hole misalignment, thereby improving production efficiency and simplifying quality inspection. Second, from a safety perspective, the stop portions serve an important fail-safe role. When the elastic component fails, a mechanical limiting function of the stop portions prevents the two arms from excessively closing inward. This design avoids violent impacts between components of the device and, more importantly, by ensuring that the device does not become completely "uncontrolled" or collapse, protects the user from squeezing or injury, thereby providing a reliable safety barrier in the event of an accident.

Further, a surface of the first stop portion 111 is configured with a special profile that is lower at two sides and raised in a middle, and a raised core portion constitutes a first protrusion 111*a*. The second stop portion 211 is similarly configured and includes a second protrusion 211*a*. With reference to a longitudinal sectional view shown in FIG. 1B (obtained by sectioning FIG. 1 along line 1*b*-1*b*), relative positions of these protrusions can be observed. In this section, an included angle φ is defined by two lines extending from a center of the first pin hole 103, with the two lines respectively pointing toward the first protrusion 111*a* and the second protrusion 211*a*. The included angle q is not fixed, and varies dynamically as a user applies force and the two arms open or close.

A resistance adjustment function of the present device is implemented by an adjustable elastic component. The adjustable elastic component is configured to provide progressive resistance when a user grips the two arms and moves them toward each other, and to provide a restoring force when released so that the two arms automatically open and return to an initial position. The adjustable elastic component may include a spring 400 and an adjustment member operatively coupled thereto. When the two arms move toward each other, the spring 400 is further extended, and elastic potential energy stored therein increases with an extension amount, thereby producing resistance opposing a user's grip force.

Figure 1B:
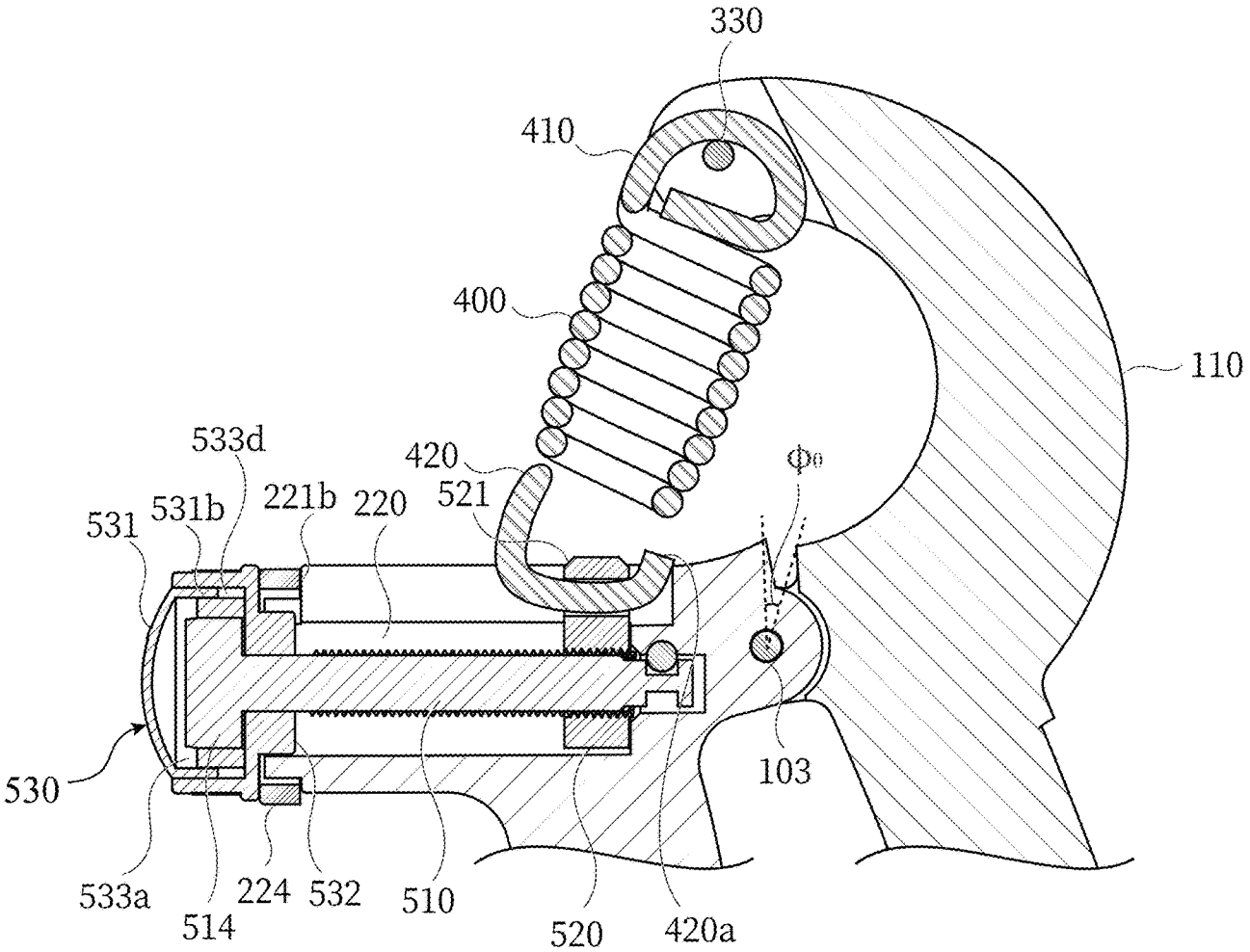
FIG. 1B is a partial sectional view of the grip strength enhancement device according to an embodiment of the present disclosure, showing a nut at a proximal stop position.

As shown in FIG. 1B, to reliably connect the spring 400 to the arm bodies, upper and lower ends of the spring 400 preferably integrally extend to form a loop and a hook, respectively. Specifically, an upper loop 410 of the spring 400 is configured to be pivotally hooked onto an outer surface of a third pin 330 mounted at a top end of the first arm 100 (wherein the third pin 330 is preferably a two-piece structure the same as the first pin 310), thereby forming a stable anchor point on the first arm 100. Correspondingly, a lower hook 420 of the spring 400 is operatively coupled with an adjustment mechanism, passes through a fixing hole 521*a* formed in an upper half portion of a nut 520, and is anchored thereat, thereby forming a connection anchor point on a side of the second arm 200. With this two-point anchoring configuration respectively coupled to the first arm 100 and the second arm 200 (via the adjustment mechanism), the spring 400 is effectively secured between upper portions of the two arms, thereby providing a core elastic force source for gripping and return of the device.

As shown in FIG. 1B, FIG. 1C, and FIGS. 10-10C, to accommodate, guide, and secure an adjustment mechanism, a limiting slot 220 is integrally formed within the base arm 210 of the second arm 200. The limiting slot 220 is preferably a cylindrical cavity. A front end thereof is provided with an opening 222 for installing a threaded adjustment mechanism, and an upper end thereof is formed with a through slot 221 extending therethrough. At an end of the through slot 221 proximate to the pivot portion 202 (in a-x direction), a stepped portion 2211 extends into the through slot 221, and an end face of the stepped portion 2211 proximate to the through slot 221 forms a first end stop surface 2211*a*. A retaining ring 224 is further sleeved on an outer wall of the above-mentioned flange 223, and a side of the retaining ring 224 facing the through slot 221 forms a second end stop surface 221*b*. A second pin hole 205 is further formed in a side portion of the base arm 210, and the second pin hole 205 extends through a side wall of the base arm 210 and the stepped portion 2211. A second pin 320 (the second pin 320 preferably having a two-piece structure the same as the first pin 310) is inserted into the second pin hole 205, and thus can limit the threaded adjustment mechanism described below to prevent the threaded adjustment mechanism from shifting in a front-rear direction.

Figure 7:
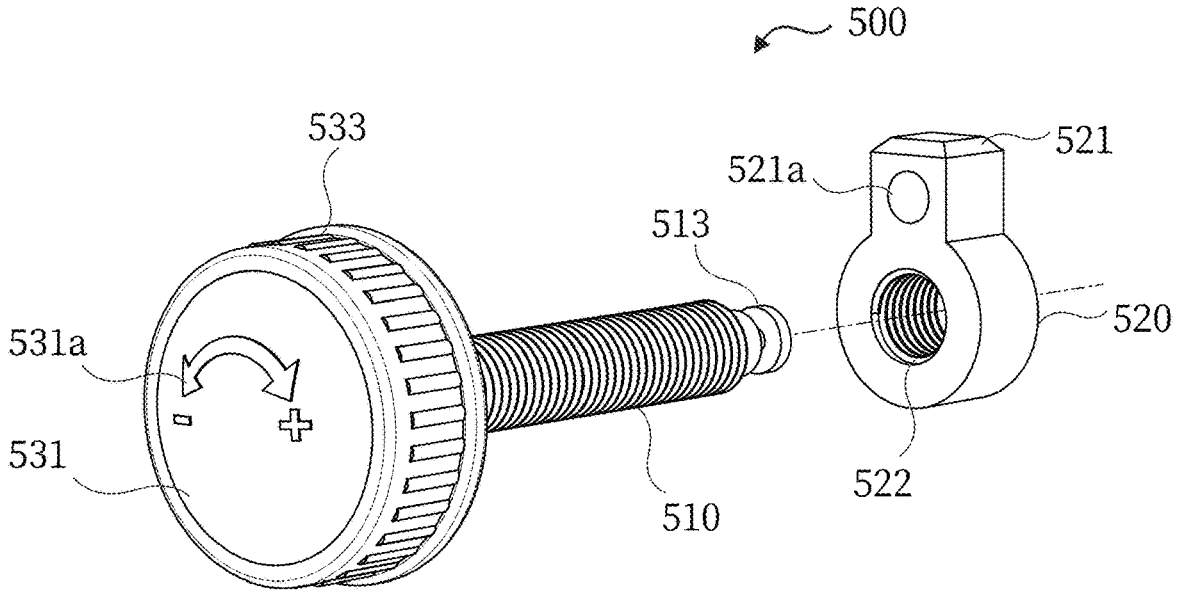
FIG. 7 is a first perspective view of a threaded adjustment mechanism of the grip strength enhancement device according to an embodiment of the present disclosure.
Figure 8:
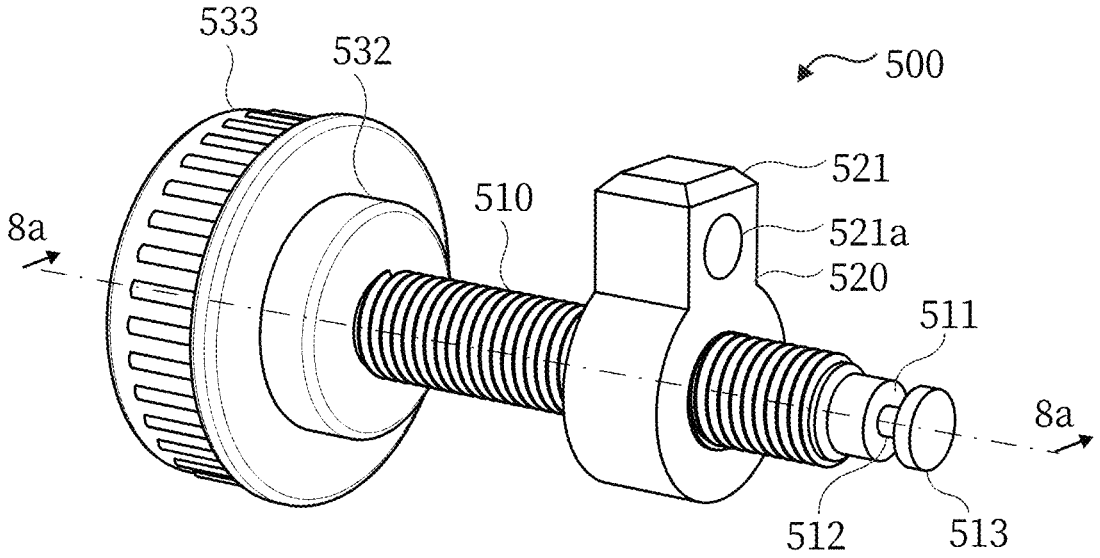
FIG. 8 is a second perspective view of the threaded adjustment mechanism of the grip strength enhancement device according to an embodiment of the present disclosure.
Figure 8A:
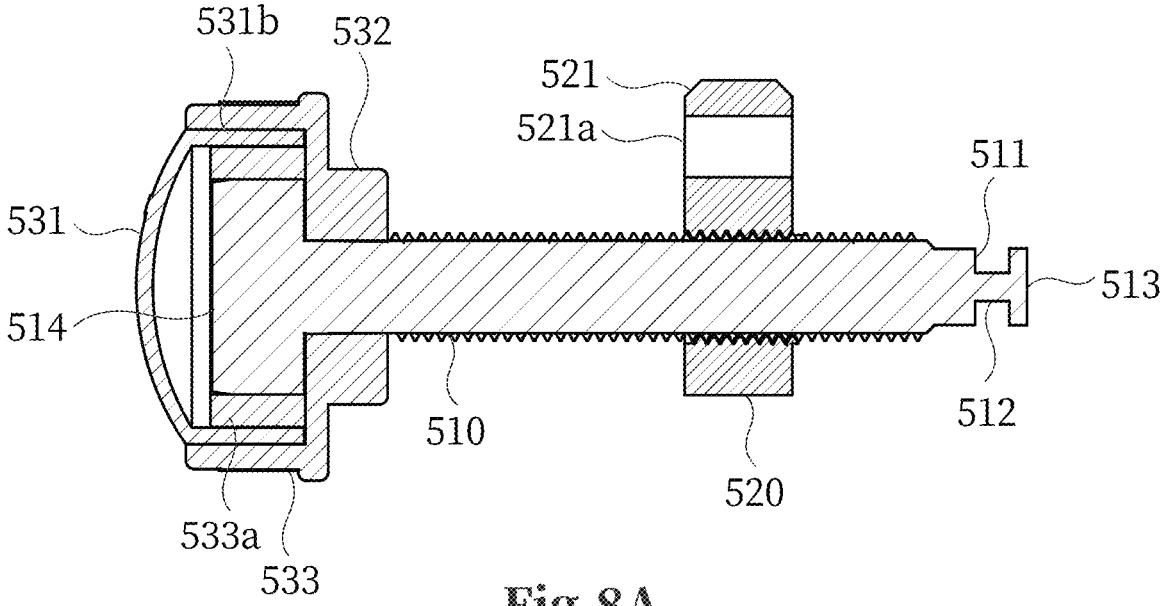
FIG. 8A is a sectional view of the threaded adjustment mechanism of the grip strength enhancement device according to an embodiment of the present disclosure.

As shown in FIGS. 7-8A, the threaded adjustment mechanism (a knob-type screw assembly) is installed within the limiting slot 220. The assembly includes a knob 530 disposed at a front end of the base arm for manual rotation by a user, a screw 510 coaxially fixed to the knob 530 and received in the cavity, and a nut 520 threadably engaged with the screw 510.

As a preferred implementation, the knob 530 is configured as a detachable hollow composite structure, mainly including a knob body 533 and a cover plate 531. The knob body 533 is a tubular structure having one closed end and one open end (defined as a closed end and an open end, respectively). To achieve reliable torque transmission with the screw 510, a coaxial annular boss 533*a* is integrally formed on an inner side of the closed end of the knob body 533 (i.e., a side facing the open end), and an inner hole 533*b* of the boss 533*a* is machined as a regular hexagon. An outer diameter of the boss 533*a* is smaller than an inner diameter of the knob body 533, thereby defining an annular mounting interlayer 533*d* therebetween. The cover plate 531 mainly provides indicating and decorative functions. An outer surface thereof is convex-mirror shaped and provided with a clear rotation-direction mark 531*a*. An annular positioning flange 531*b* is fixedly disposed at an inner edge of the cover plate 531, wherein a thickness of the positioning flange 531*b* matches a width of the interlayer 533*d*, and an axial depth thereof is preferably the same as a depth of the interlayer 533*d*, such that the positioning flange 531*b* can be tightly fitted into the interlayer 533*d* by snap-fit or press-fit, thereby providing a secure and detachable connection between the cover plate 531 and the knob body 533.

Figure 7A:
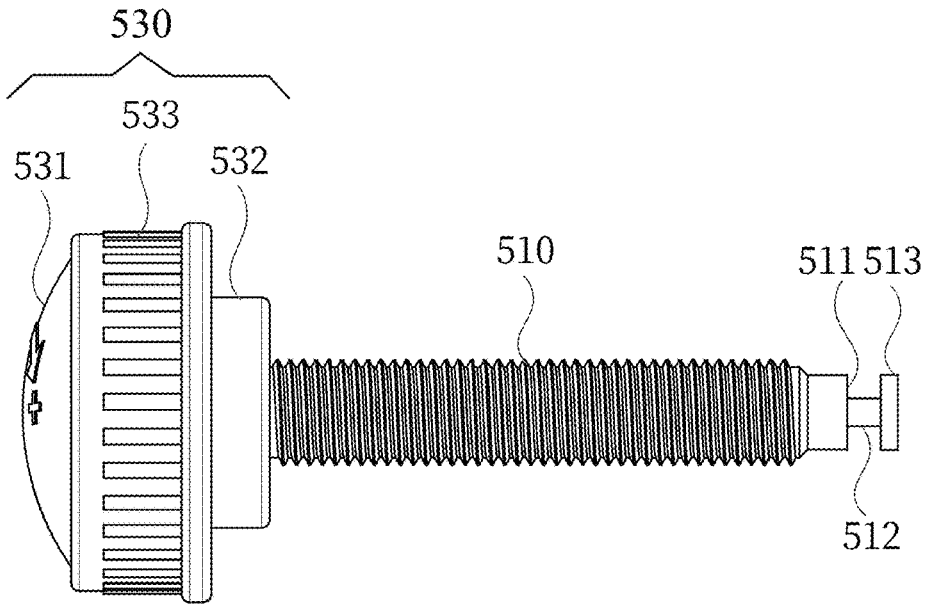
FIG. 7A is a side view of a knob and a screw of the grip strength enhancement device according to an embodiment of the present disclosure.
Figure 7B:
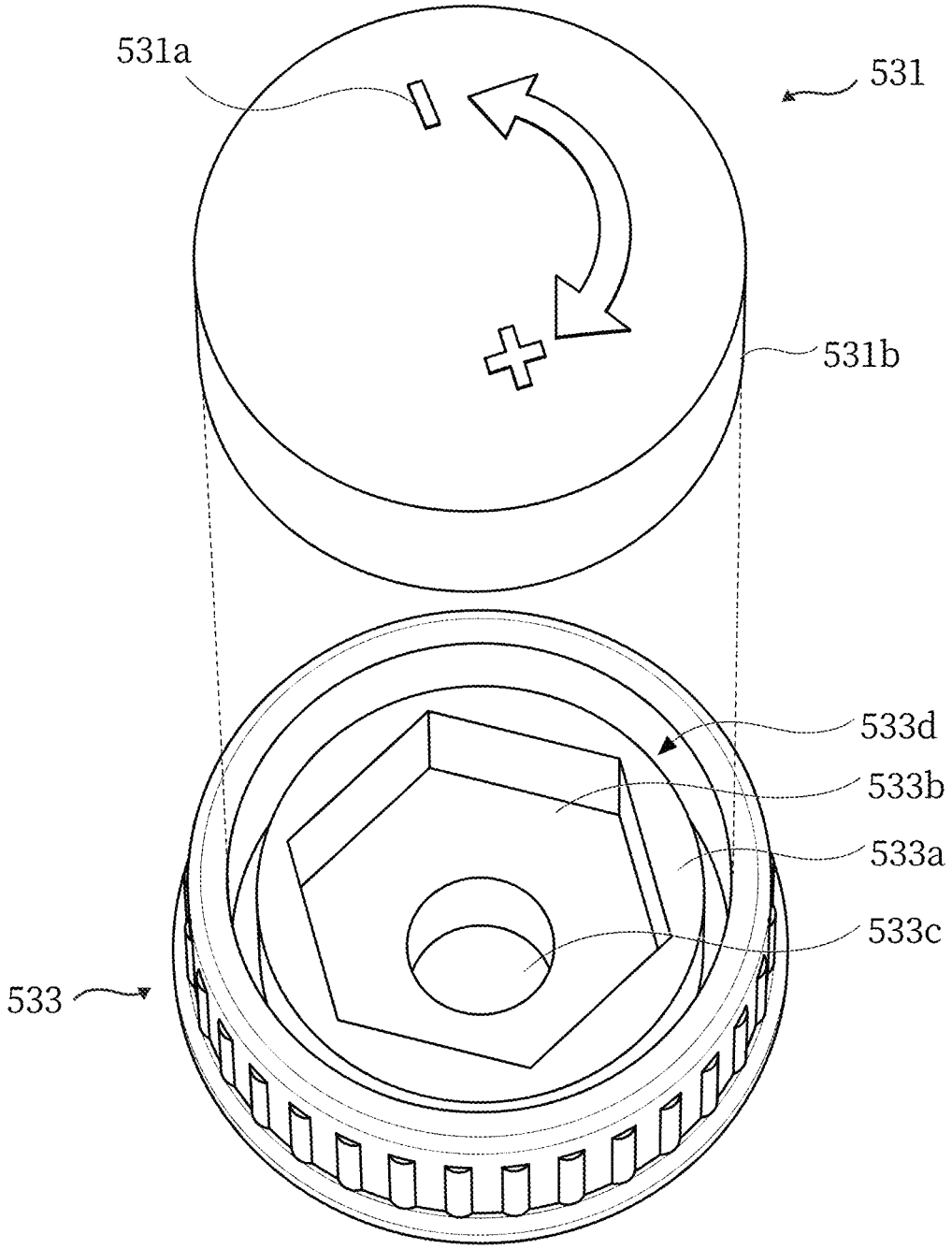
FIG. 7B is an exploded view of the knob of the grip strength enhancement device according to an embodiment of the present disclosure.

To ensure overall stability of the threaded adjustment mechanism, the screw 510 is also precisely configured. As shown in FIG. 7A, a head of the screw 510 is configured as a hexagonal nut head 514, which, during assembly, is received within the regular-hexagon inner hole 533*b* of the knob body 533. Meanwhile, a center hole 533*c* formed at a center of the closed end of the knob body 533 (and a guide post 532 at a rear side thereof) provides a through passage for a shank portion of the screw 510, thereby achieving coaxial fixing and torque transmission between the knob 530 and the screw 510.

To eliminate axial play at a tail end of the screw 510, a stop mechanism is provided at the tail end. The stop mechanism includes a stop shoulder 511 of the screw, a connecting post 512 extending from an axial center of an end face of the stop shoulder 511, and a stop post 513 fixed at a distal end of the connecting post 512, wherein the stop post 513 is parallel to an axis of the screw.

Figure 10:
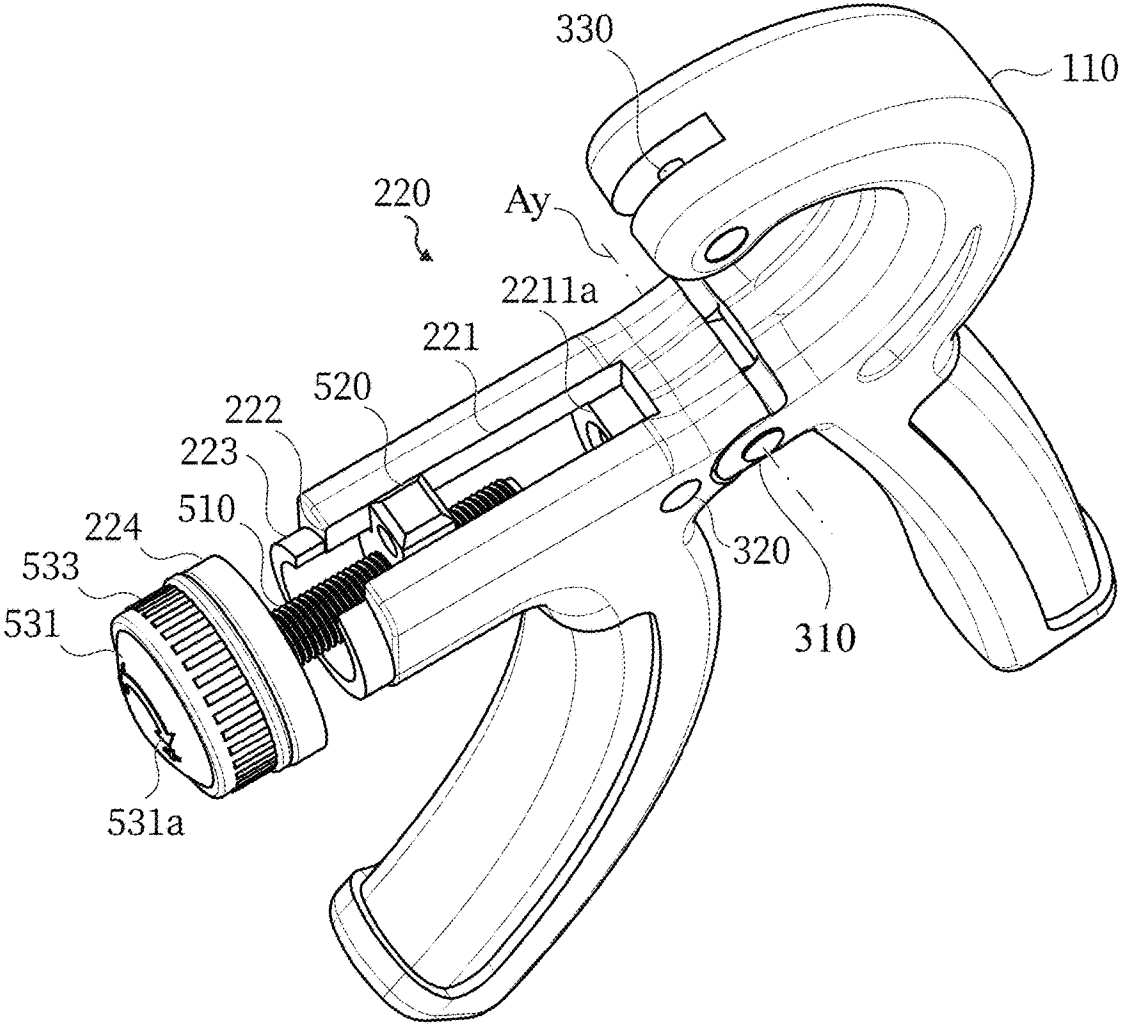
FIG. 10 is a schematic assembly view of the threaded adjustment mechanism of the grip strength enhancement device according to an embodiment of the present disclosure.
Figure 10A:
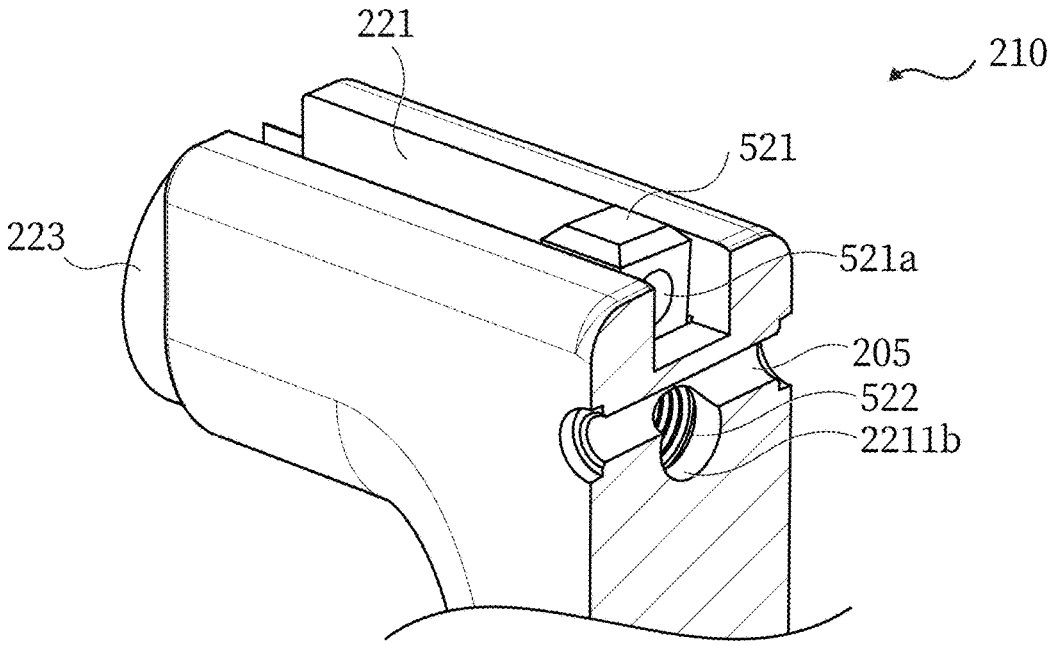
FIG. 10A is a schematic view of a structure of a second pin hole of the grip strength enhancement device according to an embodiment of the present disclosure.
Figure 10B:
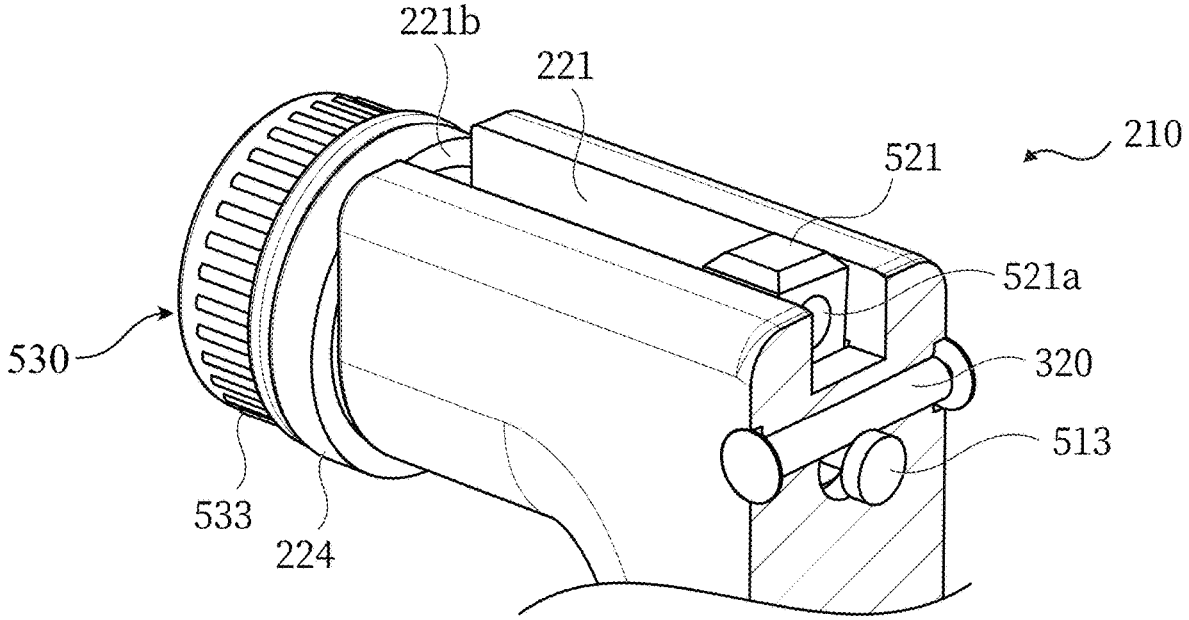
FIG. 10B is a schematic view of another structure of the second pin hole of the grip strength enhancement device according to an embodiment of the present disclosure.
Figure 10C:
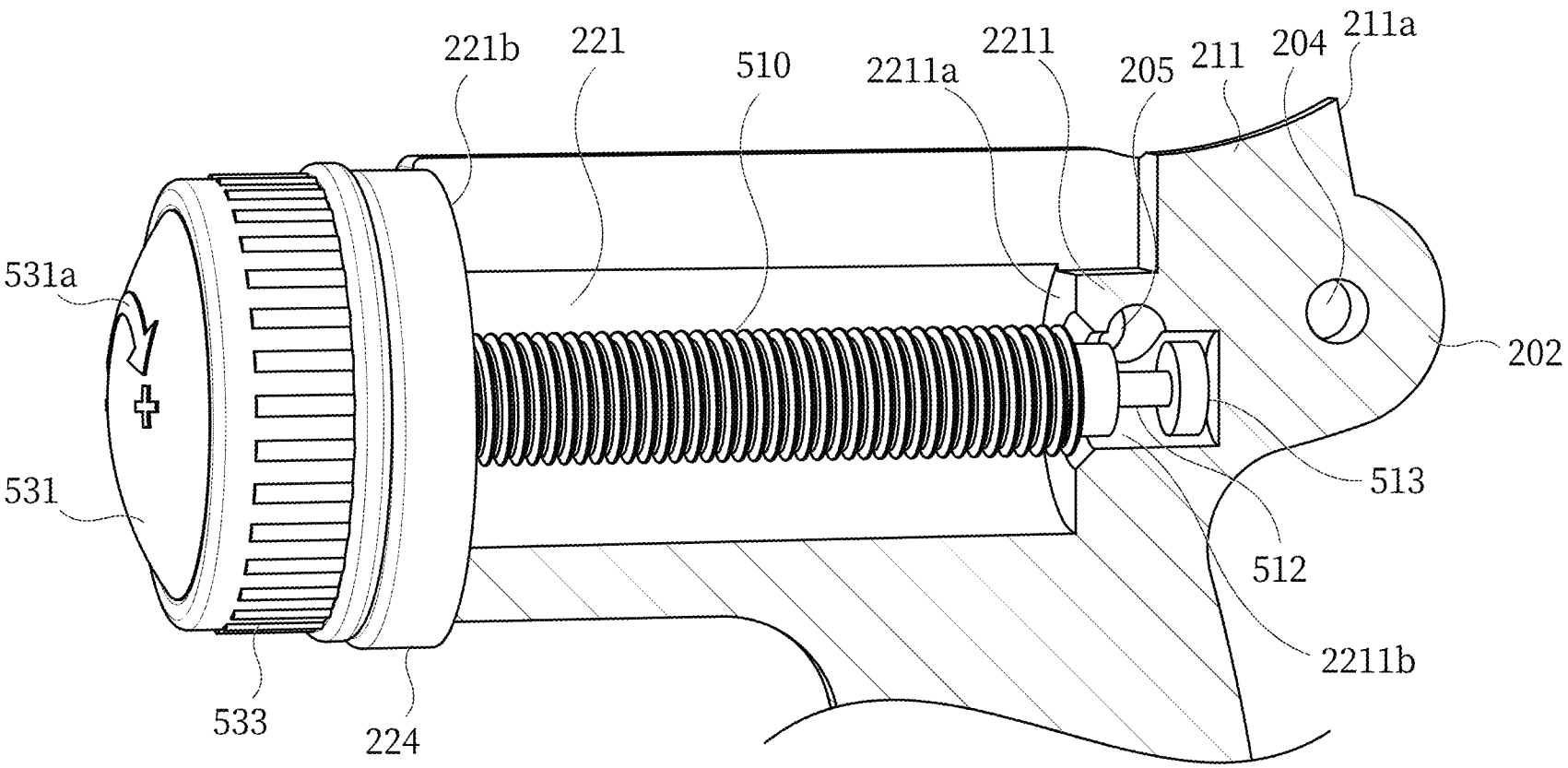
FIG. 10C is a schematic view of a structure of a base arm portion of the grip strength enhancement device according to an embodiment of the present disclosure.
Figure 11:
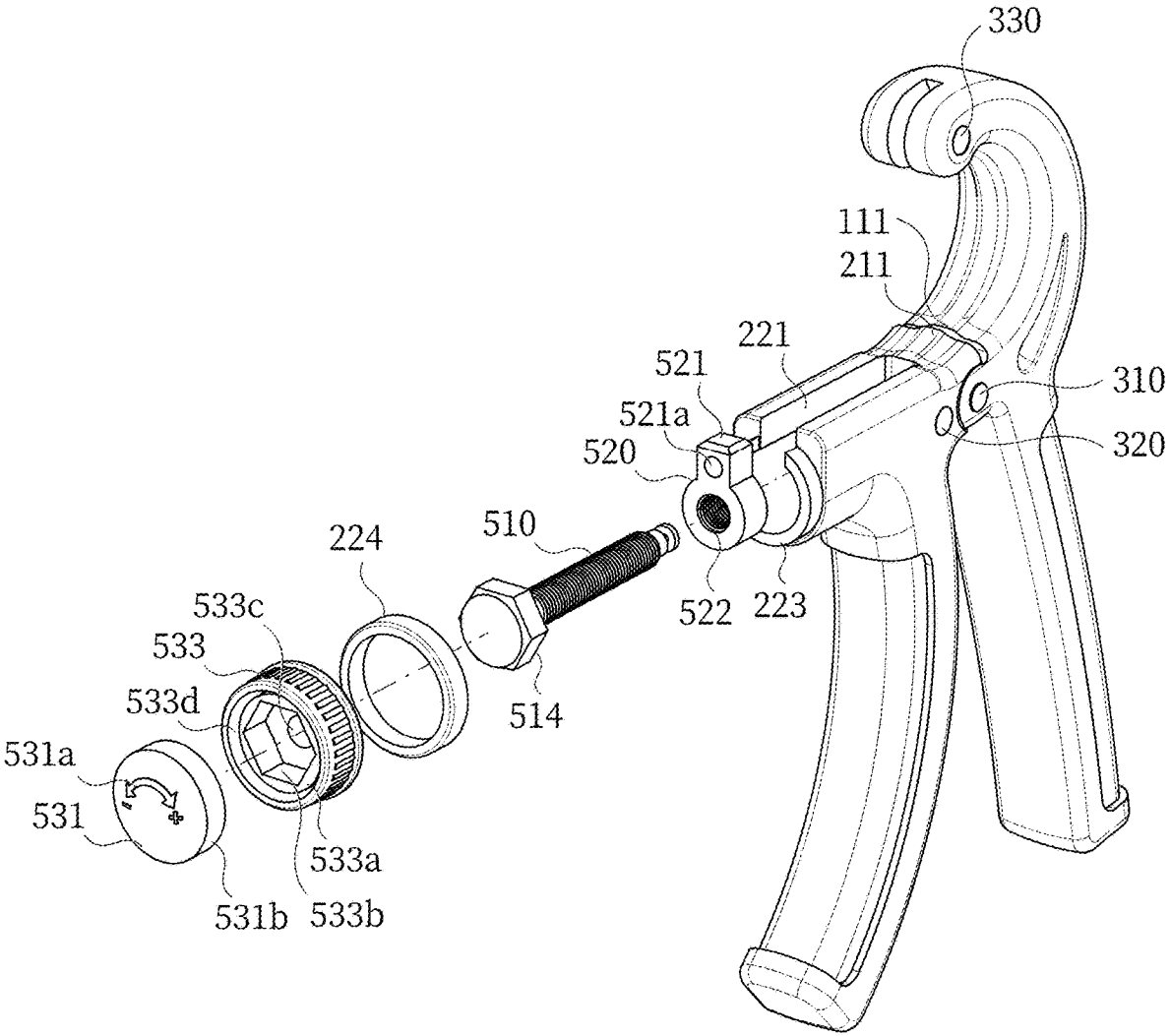
FIG. 11 is an exploded view of the threaded adjustment mechanism of the grip strength enhancement device according to an embodiment of the present disclosure.
Figure 12:
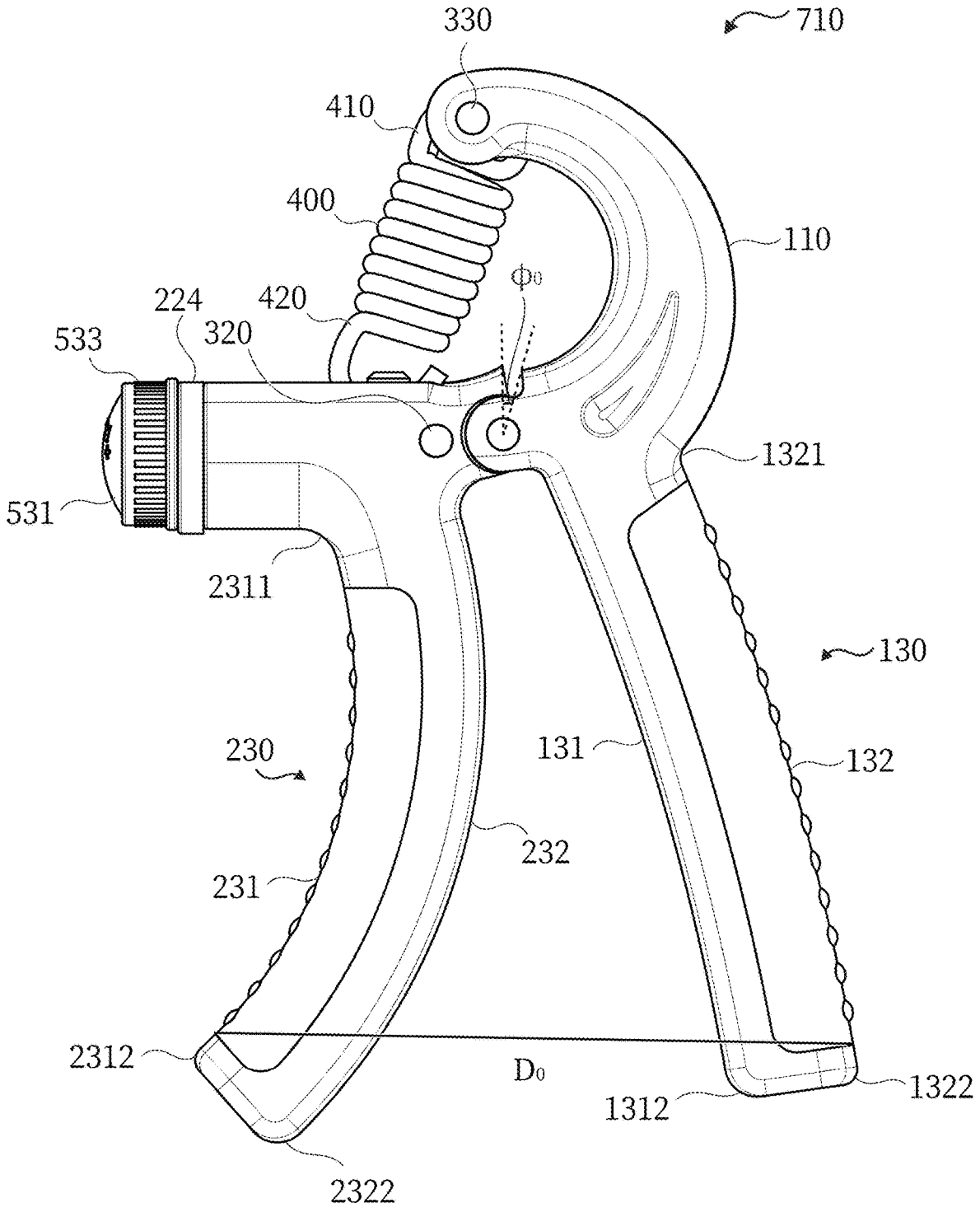
FIG. 12 is a side view of the grip strength enhancement device in a minimum setting-open state according to an embodiment of the present disclosure.

As shown in FIG. 1B and FIGS. 10-10C, a chamber 2211*b* is formed in the stepped portion 2211. A central axis of the chamber 2211*b* coincides with a central axis of the stepped portion 2211, that is, the chamber 2211*b* and the stepped portion 2211 are coaxially arranged. The chamber 2211*b* may be any columnar structure such as a cylinder or a rectangular prism, and is preferably a cylinder. One end of the chamber 2211*b* is open and communicates with the through slot 221, such that the above stop mechanism is receivable within the chamber 2211*b*.

The second pin hole 205 extends through the side wall of the base arm 210 and transversely passes through a lower region of the stepped portion 2211 (including a region in which the chamber 2211*b* is located). After the second pin 320 is inserted, a shank portion thereof transversely spans the chamber 2211*b* to form a lateral limiting pin. The stop shoulder 511 and the stop post 513 are respectively located on opposite sides of the second pin 320, thereby forming a "U"-shaped configuration around the second pin 320, so as to clamp and restrain the tail end of the screw 510 within the chamber 2211*b*, and to prevent the tail end from shifting along the screw axis or in a front-rear direction. Accordingly, cooperation between the "U"-shaped limiting structure and the chamber 2211*b* constrains the stop mechanism of the screw 510 within a relatively small physical space, effectively preventing deflection or wobbling of the screw 510 during adjustment, thereby ensuring smoothness and reliability of an adjustment process.

The nut 520 defines a threaded through hole 522 at a middle portion thereof, threads in the threaded through hole 522 being engaged with threads on an outer surface of the screw 510, and an upper end of the nut 520 is provided with a protruding portion 521. A width of the protruding portion 521 is slightly less than a width of the through slot 221, such that the nut 520 is constrained within the cavity to translate only along the screw axis and is prevented from rotating with the screw.

To establish an elastic connection, the hook 420 at a lower end of the spring 400 passes through a fixing hole 521*a* formed in the protruding portion 521. As shown in FIG. 8A, a hook tip 420*a* of the hook 420 is bent upwardly, so as to be reliably hooked and secured on the nut 520. With this configuration, when the nut 520 translates along the screw 510, the nut 520 correspondingly and precisely drives the hook 420 at the lower end of the spring 400 to move together therewith.

To ensure that the knob 530 can rotate smoothly during adjustment while maintaining an accurate axial position, a cooperative structure between the knob 530 and the limiting slot 220 is further optimized. Specifically, an annular flange 223 is provided at a front opening of the limiting slot 220. The annular flange 223 not only precisely defines the opening of the limiting slot 220, but also provides a critical supporting surface for the knob 530. Correspondingly, a cylindrical guide post 532 is fixedly disposed on a rear side of the knob 530 (i.e., a side facing the opening of the limiting slot 220). The guide post 532, the knob 530, and the screw 510 are coaxially secured, and an outer diameter of the guide post 532 is slightly smaller than an inner diameter of the annular flange 223, so that a precision rotary fit is formed therebetween.

When a user adjusts grip-training intensity, the user rotates the knob 530, and the knob 530 drives the screw 510 to rotate together therewith. Because the nut 520 is constrained by the limiting slot 220 and is prevented from rotating, a rotational motion of the screw 510 is converted, via a threaded pair, into an axial translational motion of the nut 520. This translation directly changes an initial installed length of the spring 400, thereby adjusting a pre-extension amount thereof. For example, when the nut 520 moves forward in a +x direction, an extension amount of the spring increases accordingly, such that an initial gripping force of the gripper and a resistance curve throughout a compression stroke increase correspondingly, and vice versa. Through such an intuitive rotation operation, the present device allows the user to conveniently achieve stepless resistance adjustment according to individual training needs.

Figure 1C:
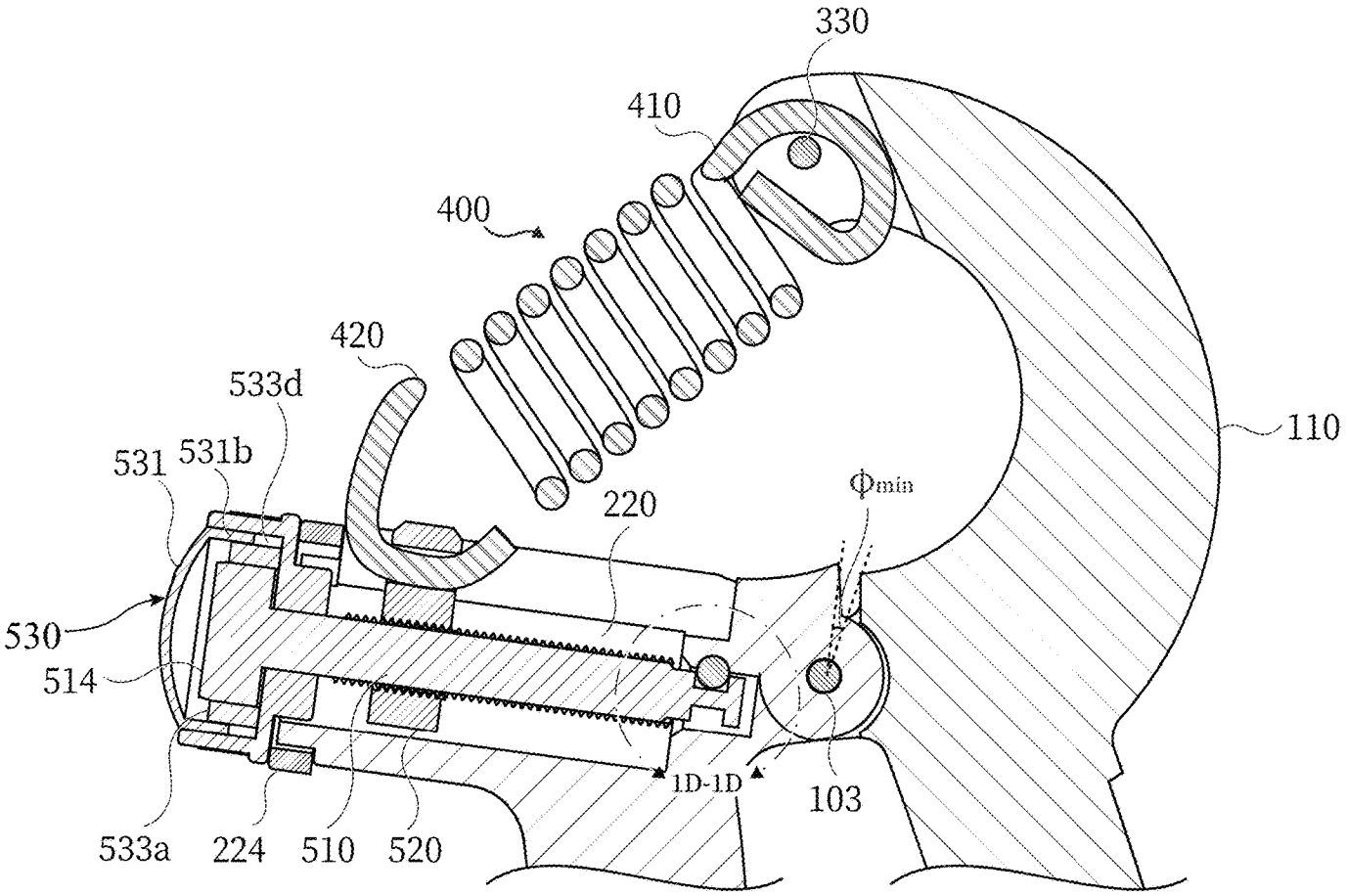
FIG. 1C is a partial sectional view of the grip strength enhancement device according to an embodiment of the present disclosure, showing the nut at a distal stop position.
Figure 1D:
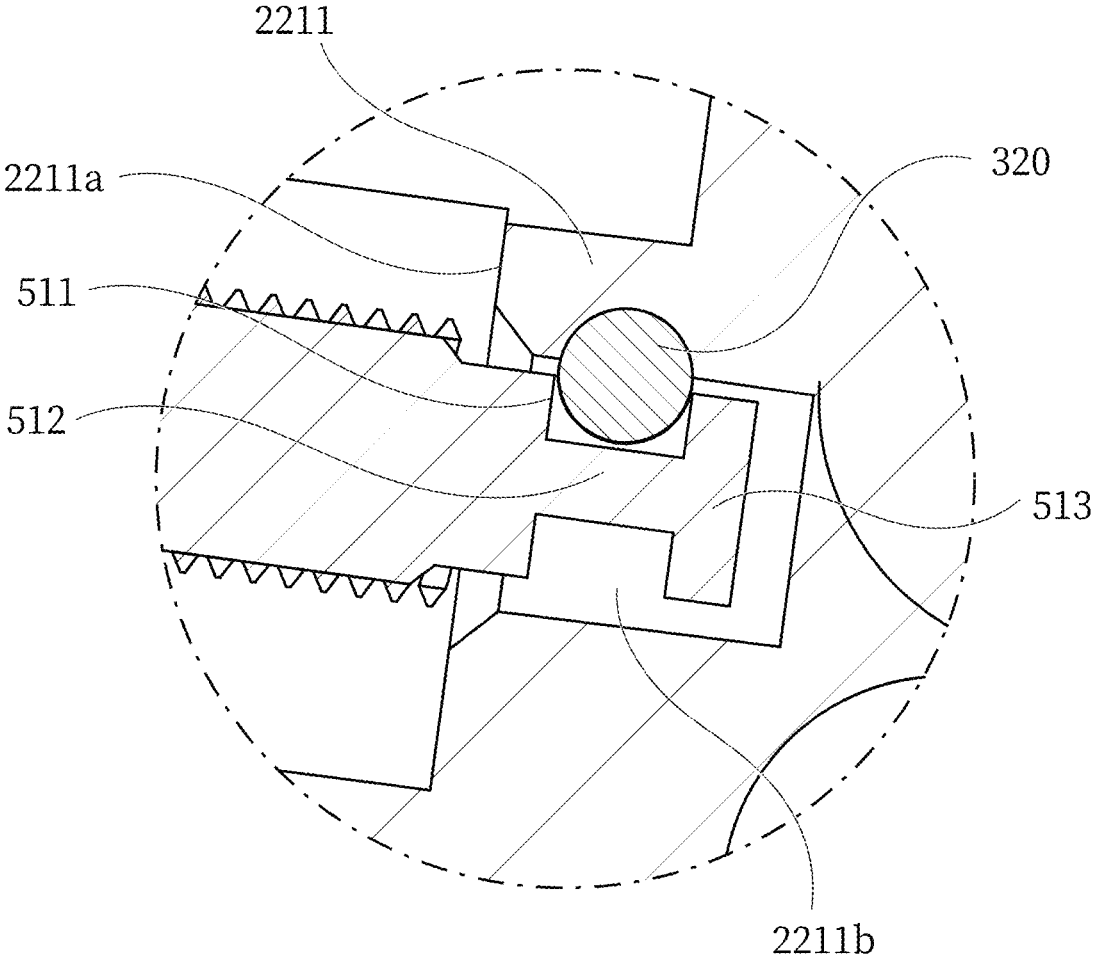
FIG. 1D is an enlarged view of a portion of the partial sectional view of FIG. 1C.

The first end stop surface 2211*a* and the second end stop surface 221*b* jointly limit a linear travel range of the nut 520. When the nut 520 moves in a +x direction to a distal stop position, as shown in FIG. 1C, the hook tip 420*a* of the spring 400 rigidly abuts against the second end stop surface 221*b*. This abutment not only limits an initial pre-extension amount of the spring to a maximum value (i.e., a maximum setting), but also prevents the nut from further moving forward. The user will perceive that the knob can no longer be rotated, thereby providing clear tactile feedback and preventing over-adjustment. Conversely, when the nut 520 moves in a-x direction to a proximal stop position, as shown in FIG. 1B, an outer edge of a body of the hook 420 abuts against the first end stop surface 2211*a*. This state limits the initial pre-extension amount of the spring to a minimum value (i.e., a minimum setting), and likewise prevents further reverse rotation of the knob by mechanical stopping, thereby avoiding disengagement or damage of the mechanism.

This integrated limiting and adjustment design provides significant technical advantages. First, in terms of safety and reliability, end stop surfaces at two ends of the limiting slot, together with the spring hook, define clear mechanical boundaries for an adjustment travel, fundamentally avoiding risks such as out-of-range movement of the nut, disengagement of the hook, or whipping caused by spring failure due to misuse. Second, repeatability and consistency of the design are high, because maximum and minimum settings are uniquely defined by physical component-to-component abutment, providing clear positioning that facilitates production inspection and subsequent traceability. Finally, the structure is simple and efficient, integrating the limiting function directly into a core load-transmission path without adding extra limit pins or resilient bumpers, thereby simplifying manufacturing, reducing tolerance stack-up, and ensuring long-term stability and durability of the adjustment mechanism.

Figure 8B:
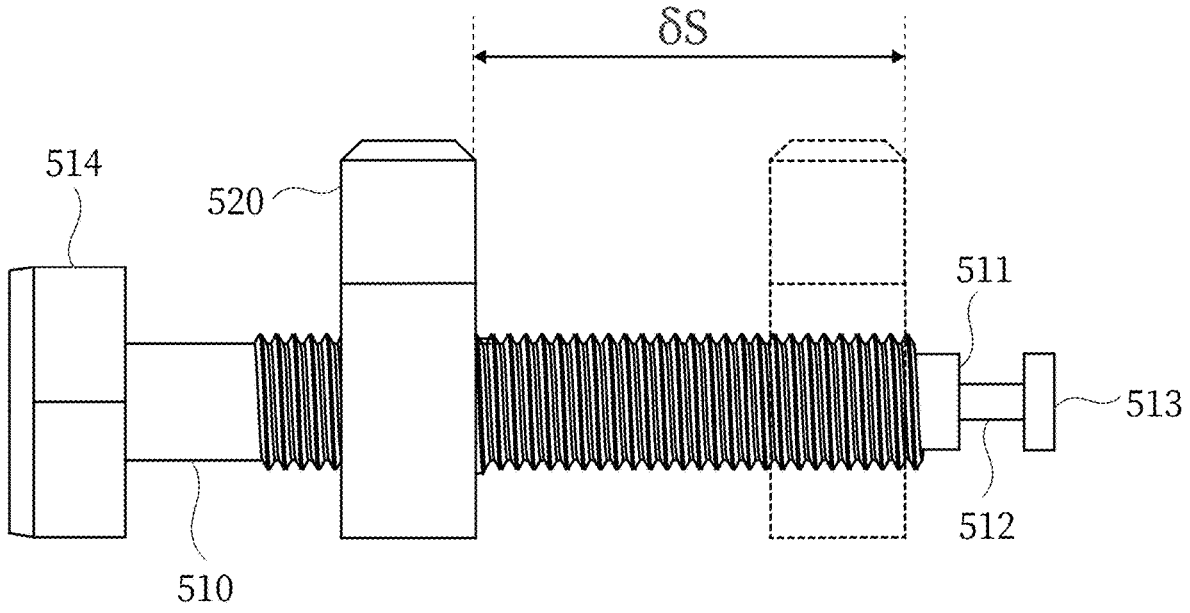
FIG. 8B is a schematic view of displacement of a nut on a screw of the grip strength enhancement device according to an embodiment of the present disclosure.
Figure 9:
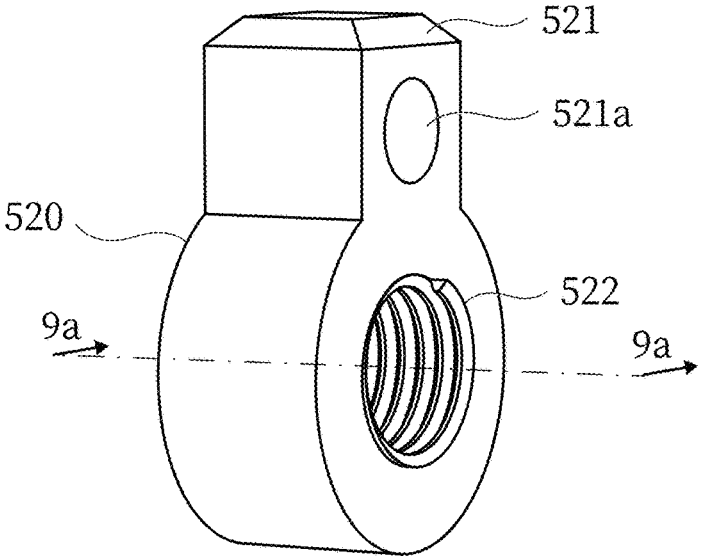
FIG. 9 is a perspective view of the nut of the grip strength enhancement device according to an embodiment of the present disclosure.
Figure 9A:
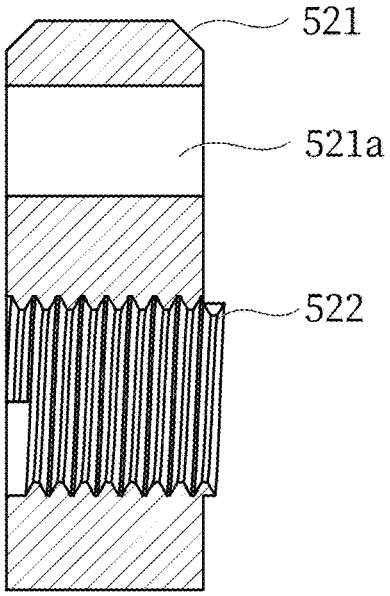
FIG. 9A is a sectional view of the nut of the grip strength enhancement device according to an embodiment of the present disclosure.

A total adjustment travel defined by the mechanical limits can be precisely quantified by an effective displacement distance 8S of the nut 520. As shown in FIG. 8B, the travel 8S is defined as a maximum linear displacement of the nut 520 between two limit positions. Specifically, when the nut 520 is at the proximal stop position, the nut abuts against the first end stop surface 2211*a*, and a reference plane (or axis) perpendicular to a moving direction may be selected on the nut as a reference position. When the nut 520 is adjusted to the distal stop position, the hook 420 of the spring 400 abuts against the second end stop surface 221*b*, and the reference plane correspondingly moves to a new position. The distance 8S is a straight-line distance traveled by the reference plane between the two limit positions along the moving direction. In this preferred embodiment, the total adjustment travel 8S may be 19~23 mm, preferably 20~22 mm, and more preferably 21 mm.

Accordingly, a value of the included angle φ can vary with a motion state of the first arm 100 and the second arm 200. Specifically, as shown in FIGS. 12-15, the grip strength enhancement device of the present disclosure may be defined in four representative use states.

Minimum setting-open state 710: This state is a minimum-resistance resting state of the device. In this state, the adjustment knob 530 has been rotated to move the nut 520 to the proximal stop position, and an initial pre-extension amount of the spring 400 is minimum. Under this setting, the first arm 100 and the second arm 200 remain naturally open under a tensile force of the spring 400, without an external force applied by the user. In this state, a value of φ is φ0, and φ0 may be 23°~26°, preferably 24°~25°, and more preferably 24°.

Minimum setting-closed state 720: This state is a maximum compression state of the device at the minimum resistance. The adjustment setting remains at the minimum setting (with the nut 520 at the proximal stop position). The user applies a gripping force to overcome a minimum spring resistance so that the first arm 100 and the second arm 200 move toward each other until opposite sides of the two handles contact each other or a maximum grip stroke is reached. In this state, a value of q is φmax, and φmax may be 44°~46°, preferably 45°~50°, and more preferably 45°.

Maximum setting-open state 730: This state is a maximum-resistance resting state of the device. In this state, the adjustment knob 530 has been rotated to move the nut 520 to the distal stop position, and an initial pre-extension amount of the spring 400 is maximum. Under this setting, the first arm 100 and the second arm 200 remain naturally open under a maximum initial tensile force applied by the spring 400. In this state, a value of φ is φmin, and φmin may be 0°~5°, preferably 0°~3°, and more preferably 0°.

Maximum setting-closed state 740: This state is a maximum compression state of the device at the maximum resistance. The adjustment setting remains at the maximum setting (with the nut 520 at the distal stop position). The user applies a gripping force to overcome a maximum spring resistance so that the first arm 100 and the second arm 200 move toward each other until opposite sides of the two handles contact each other or a maximum grip stroke is reached, and a value of φ is the same as φmax.

Figure 13:
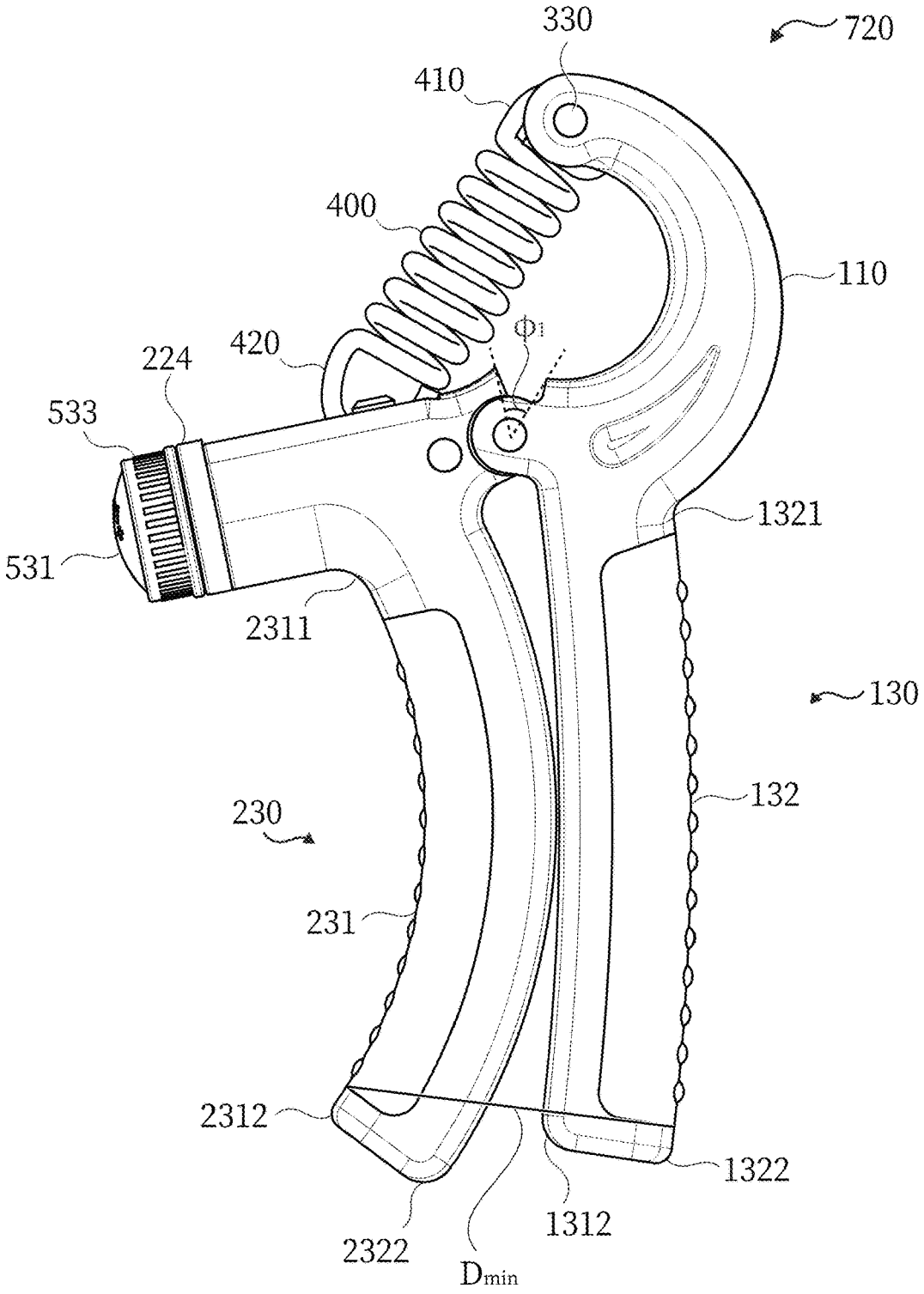
FIG. 13 is a side view of the grip strength enhancement device in the minimum setting-closed state according to an embodiment of the present disclosure.
Figure 14:
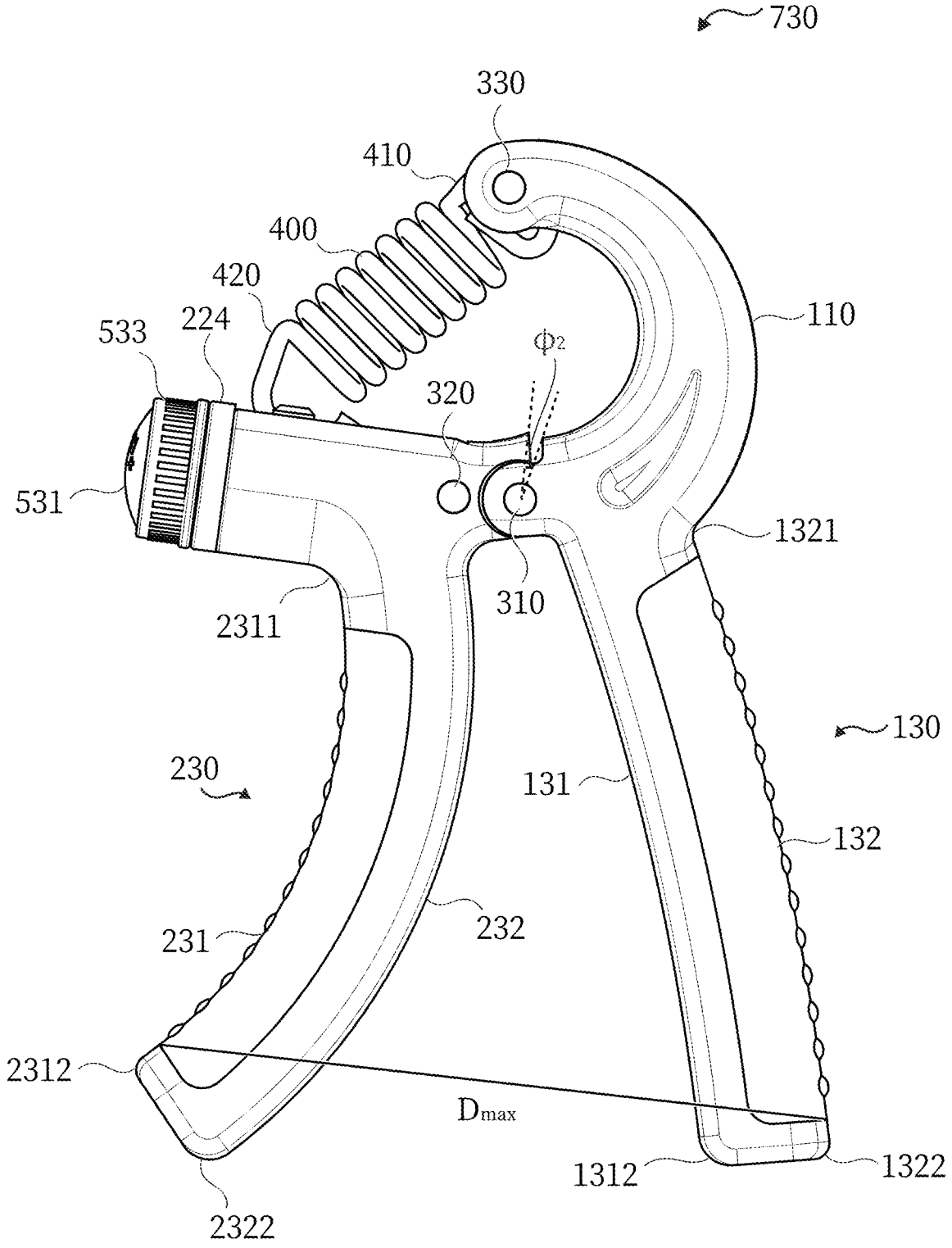
FIG. 14 is a side view of the grip strength enhancement device in a maximum setting-open state according to an embodiment of the present disclosure.
Figure 15:
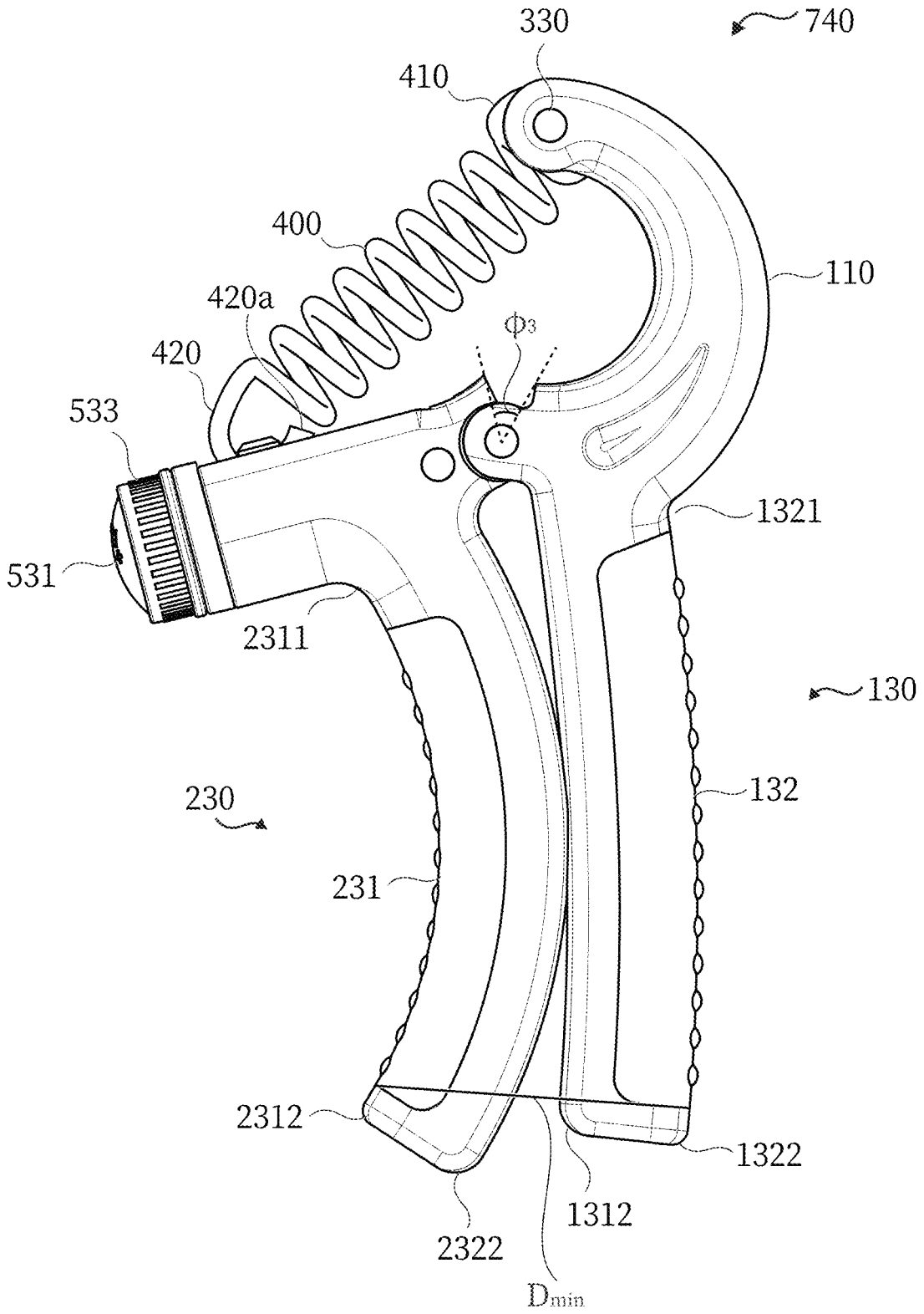
FIG. 15 is a side view of the grip strength enhancement device in the maximum setting-closed state according to an embodiment of the present disclosure.

As shown in FIG. 13 and FIG. 15, in an exemplary embodiment, a grip stroke SD of the present device can be quantified by measuring a straight-line distance between bottom portions of contact surfaces of the two handles. Specifically, a portion of the first elastic contact layer 140 on the bearing surface 132 is defined as a bearing-surface overmold segment 141, and a portion of the second elastic contact layer 240 on the gripping surface 231 is defined as a gripping-surface overmold segment 241. A grip distance Dx is defined as a straight-line distance between bottom ends of the two overmold segments 141 and 241. Based on this definition, a value of the grip distance Dx varies with the four representative states described above.

When the present device is in the minimum setting-open state 710, the grip distance Dx has an initial value DO. A range of DO may be 80~95 mm, preferably 82~90 mm, and more preferably 85 mm.

When the present device is in the maximum setting-open state 730, the grip distance Dx has a maximum open value Dmax. A range of Dmax may be 115~120 mm, preferably 116~118 mm, and more preferably 117 mm.

When the present device is in either closed state (i.e., the minimum setting-closed state 720 or the maximum setting-closed state 740), the grip distance Dx reaches a minimum value Dmin. A range of Dmin may be 40~45 mm, preferably 41~43 mm, and more preferably 42 mm.

Accordingly, the grip stroke 8D may be defined as a difference between the grip distance Dx in any open state and the minimum closed grip distance Dmin. For example, when the present device is in the minimum setting-open state 710, a corresponding grip stroke 8D is DO-Dmin. Using the more preferred values, the stroke is 85 mm−42 mm=43 mm.

The three key parameters δS, φ, and δD are not independent, but together form a precise mechanically coupled system. In the present device, an adjustment travel δS input by the user through the knob 530 serves as a core independent variable of the system. A change in the adjustment travel 8S directly changes an initial pre-extension amount of the spring 400, thereby causing a mechanical equilibrium point of the device in a resting state to shift. Such a shift is intuitively manifested in two precisely measurable geometric forms: first, a change in an initial stop angle φ between the minimum setting-open state 710 and the maximum setting-open state 730 (i.e., a difference between φ0 and φmin); and second, a change in the grip distance Dx between the two open states (i.e., a difference between DO and Dmax). This strong correlation between an "adjustment input (δS)" and "geometric outputs (φ and δD)" is a technical advantage of the present device. It ensures that adjustment of a resistance setting is not merely a change in spring preload, but is instead reflected in an initial geometry of the device in a predictable, quantifiable, and repeatable manner. Therefore, in the following description, the adjustment travel δS is used as an independent variable, and the initial stop angle q and the grip stroke δD are used as dependent variables, to further clarify specific numerical relationships therebetween.

Figure 20:
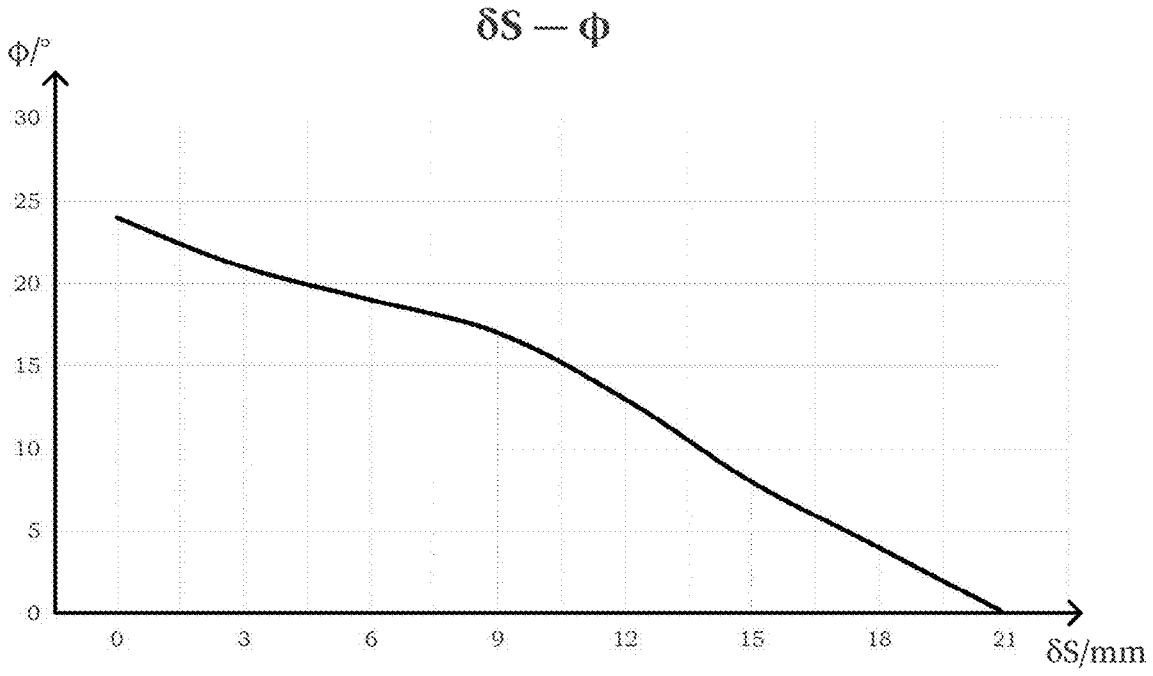
FIG. 20 is a schematic diagram showing a relationship between the adjustment travel and the initial stop angle of the grip strength enhancement device according to an embodiment of the present disclosure.
Figure 21:
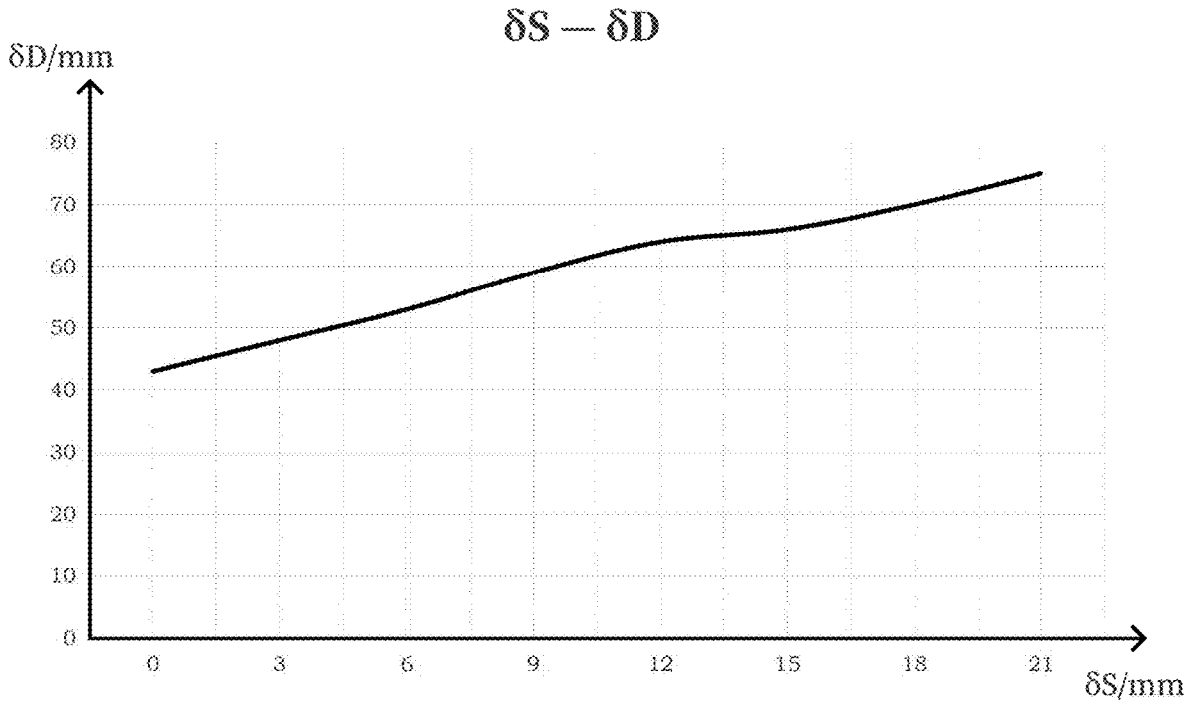
FIG. 21 is a schematic diagram showing a relationship between the adjustment travel and the grip travel of the grip strength enhancement device according to an embodiment of the present disclosure.

The present disclosure experimentally tested specific correlations among the adjustment travel δS (independent variable), and the initial stop angle q and the grip stroke δD (dependent variables). As shown in FIGS. 19-21, the system exhibits a clear and repeatable functional relationship. It should be noted that measured values shown in FIGS. 19-21 (in units of mm or °) have a measurement error of ±3 units.

First, regarding a relationship between δS and φ, as shown in FIG. 20, the initial stop angle q monotonically decreases as the adjustment travel δS increases. When δS is 0 mm (corresponding to a lowest resistance setting selectable by the user), the initial angle φ is at a maximum, which is 24°. As the user adjusts the knob and δS increases, spring preload increases and an opening amount of the two arms in a resting state decreases, causing q to decrease accordingly. For example, at δS=9 mm, φ decreases to 17°. When δS reaches a maximum travel of 21 mm (corresponding to a highest resistance setting), φ decreases to 0°. The curve exhibits an inflection point near δS=9 mm, indicating that a change rate of φ (i.e., adjustment sensitivity) gradually increases in a latter half of the adjustment travel.

Second, regarding a relationship between δS and δD, as shown in FIG. 21, the grip stroke δD correspondingly increases as the adjustment travel δS increases. This is mainly because an increase in δS causes an increase in an initial grip distance Dx (from 85 mm at δS=0 to 117 mm at δS=21). Since the minimum closed grip distance Dmin is a fixed value, the increase in the initial grip distance Dx directly translates into an increase in a total grip stroke δD. The data show that δD steadily increases from 43 mm at δS=0 to 75 mm at δS=21, thereby providing the user with a progressively increasing range of motion matched to different resistance settings.

In another exemplary embodiment, based on a geometric relationship between an adjustment travel δS and a grip distance Dx, and in combination with results of hand-ergonomics research, a grip-distance adjustment range and positions of respective settings can be biomechanically optimized.

Specifically, when the device is in an open state without an external force applied by a user, initial grip distances corresponding to a nut 520 being at a proximal stop position and a distal stop position are respectively denoted as A1 and A2, wherein A2>A1, and A1 and A2 can be obtained by measuring, in the side-view reference plane P described above, a straight-line distance between bottom ends of the overmold segments 141 and 241. To characterize an overall grip-distance adjustment width of the device, a total adjustable grip-distance span is defined in this embodiment as F=A2−A1.

Among a plurality of adjustment settings at which the device can stably remain, at least one "biomechanically optimized grip-distance setting" is preferably provided. At this setting, an initial grip distance of the device in the open state is denoted as A3, and satisfies A1<A3<A2, wherein A3 is within a range of 50 mm to 60 mm. Numerous ergonomic studies of hand tools indicate that, for adult users employing a power grip, a grip distance at which maximum grip force is produced and muscle activity and subjective discomfort are minimized generally lies within a range of 50 mm to 60 mm, and this has been repeatedly verified in experiments involving adjustable-span pliers, digital dynamometers, and similar tools. Accordingly, constraining A3 within the range of 50 mm to 60 mm helps the device, at this setting, place a distance between a thumb web space and opposing finger pads near a generally recognized optimal biomechanical leverage position, thereby maintaining relatively high grip-force output while reducing an average mechanical load on flexor muscle groups and tendons.

To facilitate description of a relative position of the biomechanically optimized grip-distance setting within the overall grip-distance adjustment interval [A1, A2], this embodiment further introduces a dimensionless position parameter λ, wherein λ=(A3−A1)/F. Preferably, λ is within a range of 0.3 to 0.7, such that the biomechanically optimized grip-distance setting is located in a middle portion of the overall grip-distance adjustment range, rather than near either extreme end. By placing A3 in the middle portion of the adjustment interval, on one hand, a plurality of smaller-grip-distance settings and a plurality of larger-grip-distance settings can still be retained near A3, facilitating selection of a more suitable initial grip distance for users having different hand sizes or being at different training stages; on the other hand, arranging the optimal grip distance near an endpoint can be avoided, thereby reducing a risk of fatigue damage of the adjustment mechanism and stop structures caused by long-term operation at an extreme position.

In practical design, a target biomechanically optimized grip distance A3 (for example, 52 mm, 55 mm, or 58 mm) may first be selected according to parameters of a target user group, such as hand length and a thumb web-space size, as well as an optimal grip-distance range provided in existing literature. Then, in combination with a handle profile and spring parameters, a minimum initial grip distance A1 and a maximum initial grip distance A2, and a corresponding total adjustment travel δS, are determined, such that (i) A1<A3<A2 and A3 is within the range of 50 mm to 60 mm, (ii) A2−A1, namely F, falls within a predetermined structurally feasible interval, and (iii) λ=(A3−A1)/F is controlled within the range of 0.3 to 0.7. For a person of ordinary skill in the art, it is sufficient to adjust a handle spacing or a nut travel in a CAD model according to the above geometric relationships to achieve such a grip-distance configuration, without requiring inventive effort.

Accordingly, by introducing explicitly measurable geometric parameters A1, A2, A3, F, and λ on the basis of a conventional "total adjustment travel δS," this embodiment achieves ergonomic optimization of a grip-distance adjustment range and setting layout, such that the device can operate, at least at one adjustment setting, within an optimal interval of grip distances commonly used by adults, and further ensures consistency and reproducibility of the optimization scheme across products of different specifications through parametric description.

Without changing the physical meaning of grip distance, the grip distance of the present disclosure may also be obtained through various equivalent geometric measurement methods, thereby facilitating use of a unified ergonomic evaluation metric in different application scenarios. In ergonomics literature, a grip span of a double-handle tool or a dynamometer is commonly defined as a straight-line distance between two handles, for example, a distance between a thumb 620 and fingers when the tool is open or closed, or a distance between inner sides of two handles. In view of structural features of the present device, in addition to the grip distance Dx defined above based on bottom ends of the overmold segments, the following equivalent measurement methods may also be used.

Measuring a midpoint-to-midpoint distance in the side-view reference plane P: in the plane P, a geometric midpoint or a mass centroid of the bearing-surface overmold segment 141 and a geometric midpoint or a mass centroid of the gripping-surface overmold segment 241 are respectively selected, and a straight-line distance between the two midpoints is defined as a grip distance Dm. For a same opening angle, Dm and the above Dx have a one-to-one correspondence, and may be correlated through a simple linear conversion, thereby enabling comparison with "handle center distance" data commonly used in existing hand-gripper studies.

Measuring a shortest distance between contact curved surfaces: in the plane P, based on the contour curve C132 of the bearing surface 132 of the first handle and the contour curve C231 of the gripping surface 231 of the second handle, a shortest distance Ds between the two curves is obtained, and Ds is used as another equivalent measure of grip distance. This definition is consistent with a method in some dynamometer literature that measures a shortest distance between two contact surfaces along a primary finger force direction, and can better reflect an actual lever-arm length between a thumb 620 web space and opposing finger pads.

Measuring a distance between inner side surfaces of the handles: for scenarios in which an overmold thickness needs to be ignored or comparison with other non-overmold tools is desired, in the plane P, based on inner-side geometric contours of the front side surface 131 of the first handle and the extension surface 232 of the second handle, a straight-line distance Di between the two inner side surfaces is measured at a predetermined height position (for example, a midpoint height of an effective gripping region of the handle), and Di is used as a structural grip distance. Because a thickness of the overmold layers is substantially constant, a difference between Di and Dx is a constant, thereby facilitating parameter unification among product versions or products made of different materials.

The above Dm, Ds, and Di may each be directly measured in the plane P using a vernier caliper, a coordinate measuring machine (CMM), or a two-dimensional projection measuring instrument, and are geometrically equivalent parameters with respect to the grip distance Dx defined in this embodiment. Therefore, when "grip distance" is mentioned in the present specification and claims, any one of the above measurement methods may be selected according to implementation needs, or a known conversion relationship may be used for conversion, without affecting technical-effect descriptions of resistance adjustment characteristics and a biomechanically optimized grip-distance setting of this embodiment.

In summary, technical advantages of the adjustment system described in this embodiment are reflected in multi-dimensional precision coupling.

1. Quantifiable intuitive feedback and clear definition: the system converts abstract "resistance adjustment" into user-perceivable geometric changes. Experimental data confirm that each adjustment of 8S immediately and predictably changes an initial grip distance Dx and an initial stop angle q. Without guessing a setting, a user can obtain clear visual and tactile feedback and clearly know a current training starting point through an initial opening angle of the handles (q changing from 24° to) 0° and a grip distance (Dx increasing from 85 mm to 117 mm).

2. Adaptive matching of training stroke: the design cleverly binds "resistance" with "stroke." When δS is relatively low, that is, when the device is configured at a low-resistance setting, the system provides a relatively short grip stroke (δD=43 mm), which is well suited for rehabilitation training or rapid explosive-force practice. As δS increases, that is, when the device is configured at a high-resistance setting, the grip stroke δD correspondingly increases to 75 mm. This characteristic of "high resistance matched with long stroke" conforms to biomechanical principles in strength training requiring a more complete range of motion (ROM), enabling the device to automatically adapt to needs of different training modes.

Figure 18:
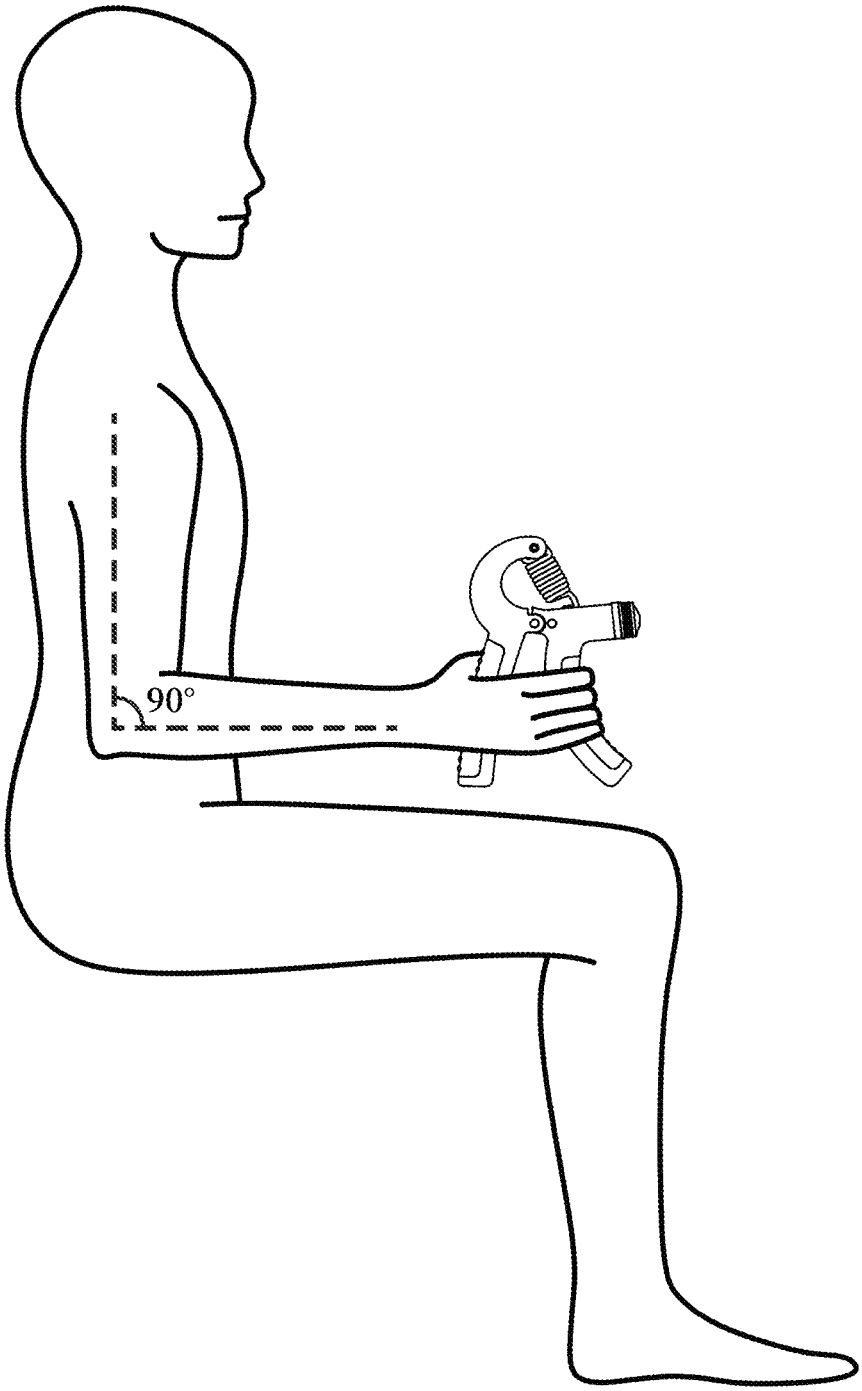
FIG. 18 is a schematic view showing a posture of a user measuring grip strength using the grip strength enhancement device according to an embodiment of the present disclosure.

3. Highly integrated transmission design: in this embodiment, a single screw-based adjustment mechanism simultaneously realizes synchronized control of three core variables, namely, an initial preload (resistance magnitude), an initial geometric configuration (φ and Dx), and a total motion stroke (δD). Such a highly integrated design is not only structurally simple and transmission-reliable, but also ensures coordinated variation of all parameters through an inherent functional relationship (as shown in FIG. 18 and FIG. 19), thereby avoiding complex multi-stage adjustment mechanisms.

4. Safety and reliability with clear boundaries: the entire adjustment function is strictly constrained between mechanical hard stops defined by δS=0 mm and δS=21 mm. Experimental data indicate that variations of all functional parameters (φ, δD) occur smoothly within this safe travel range, and reach a controllable saturation state at an end-point (φ=0), thereby forming a closed-loop adjustment and dynamic response system that is safe, reliable, and durable.

A resistance level of the grip strength enhancement device can be adjusted by a threaded adjustment mechanism 500. A specific resistance level may be 10 lbf to 300 lbf, and preferably 10 lbf to 160 lbf. A hand gripper within this resistance range can be more generally applicable to typical adult users.

A hand length of a human hand generally refers to a straight-line length from a distal wrist crease to a fingertip of a middle finger 632. A typical adult male hand length is 17 cm to 20 cm, and a typical adult female hand length is 15 cm to 18 cm. A spacing between the first handle 130 and the second handle 230 of the grip strength enhancement device may be 40% to 60% of the hand length.

The grip strength enhancement device includes a first handle 130 and a second handle 230 for being gripped by a human hand. The grip strength enhancement device can be configured in a first gripping mode and a second gripping mode. Compared with the second gripping mode, in the first gripping mode, a knob body 533 of the threaded adjustment mechanism 500 is farther from a user's arm.

Figure 17:
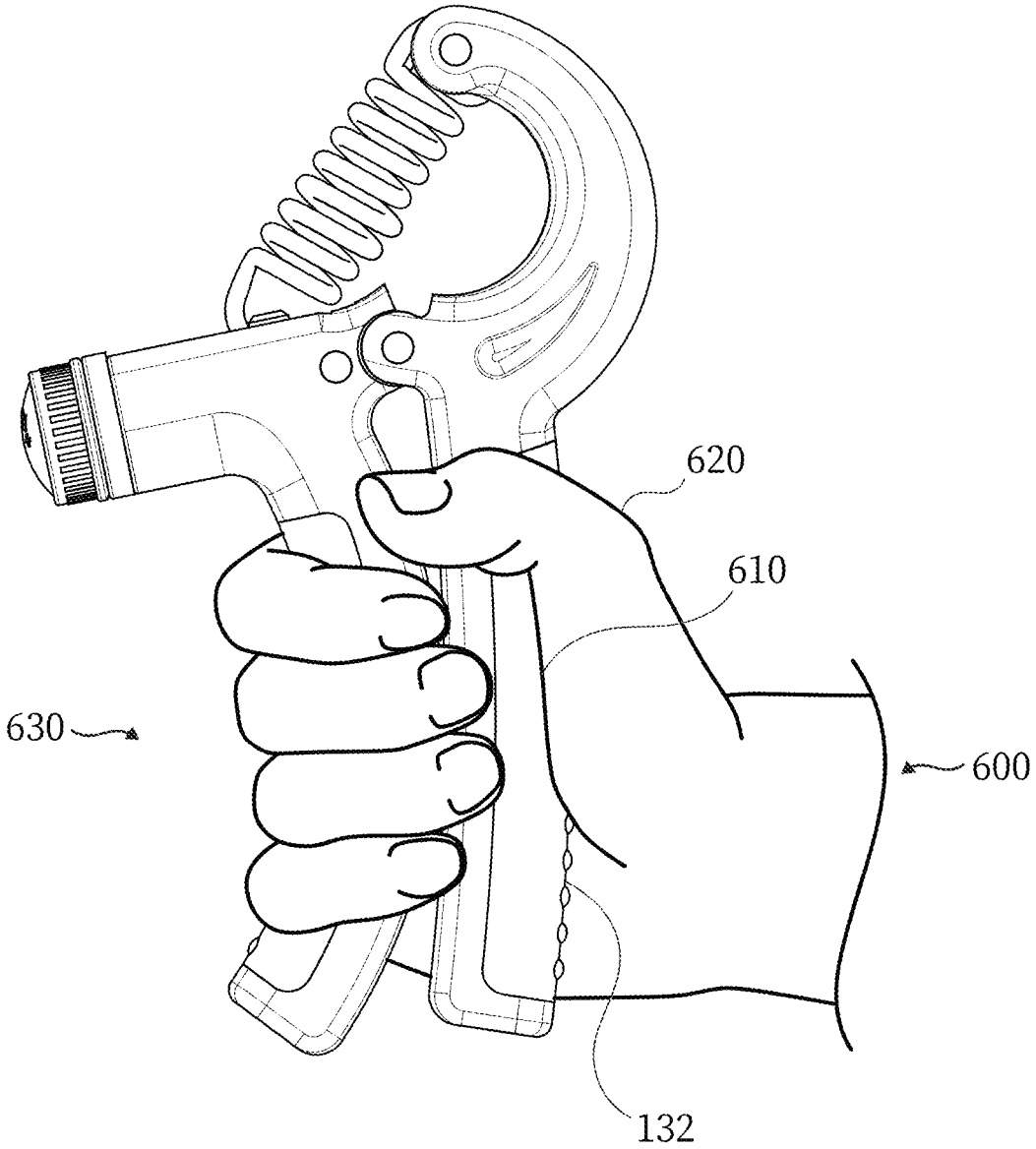
FIG. 17 is a schematic view showing the grip strength enhancement device configured by a user in a first grip mode, with a five-finger grip in a closed state, according to an embodiment of the present disclosure.
Figure 17A:
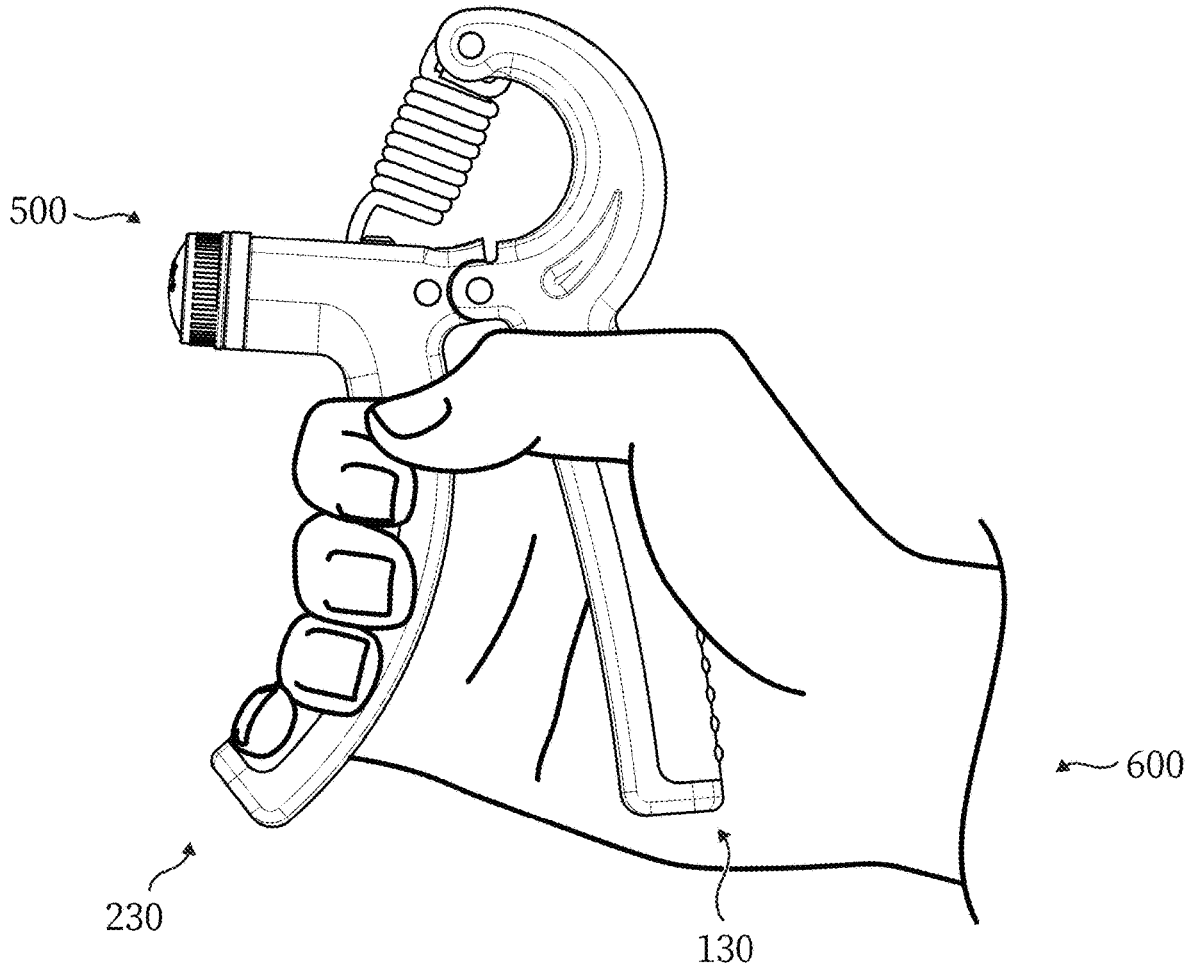
FIG. 17A is a schematic view showing the grip strength enhancement device configured by the user in the first grip mode, with the five-finger grip in an open state, according to an embodiment of the present disclosure.

As shown in FIG. 17A, when the grip strength enhancement device is configured by a user in the first gripping mode and is gripped by five fingers, the first handle 130 contacts a thenar muscle 610 of the user's palm, and the second handle 230 contacts four fingers 630 of the user. In this case, the bearing surface 132 of the first handle 130 naturally conforms to the thenar muscle, and thicknesses of the first handle 130 and the second handle 230 may optionally be between 19 mm and 22 mm. Such thickness can better increase a contact area between the second handle 230 and the user's fingers, so that the user can exert force more conveniently when gripping the grip strength enhancement device, and can further improve user comfort. During deformation of the grip strength enhancement device under a gripping force applied by the user, the device can train a flexor digitorum superficialis (FDS), a flexor digitorum profundus (FDP), and a flexor pollicis longus (FPL) of the user.

Figure 17B:
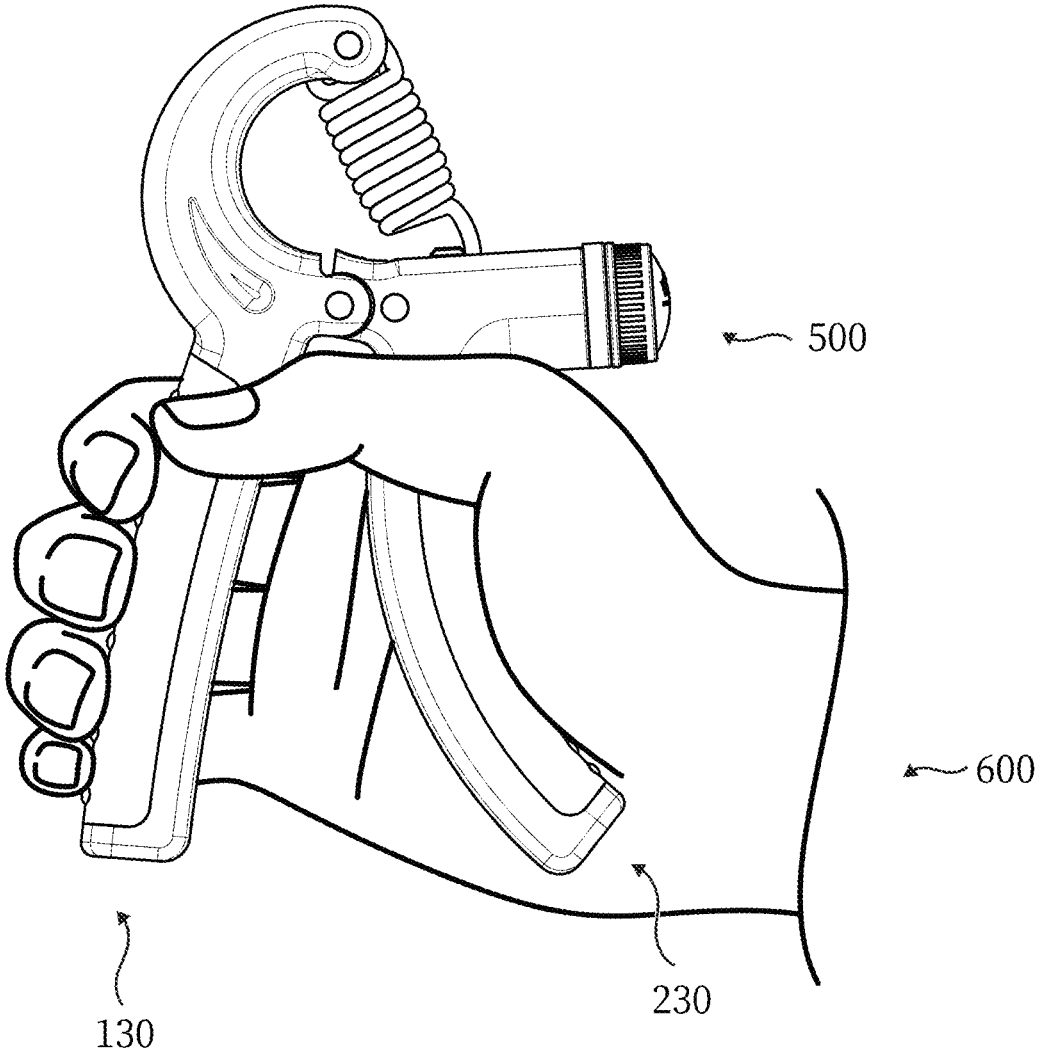
FIG. 17B is a schematic view showing the grip strength enhancement device configured by the user in a second grip mode, with the five-finger grip in an open state, according to an embodiment of the present disclosure.

As shown in FIG. 17B, when the grip strength enhancement device is configured by a user in the second gripping mode and is gripped by five fingers, the first handle 130 contacts the user's fingers, and the second handle 230 contacts the thenar muscle of the user's palm. Curvatures of the bearing surface 132 and the gripping surface 231 are adapted to a palmar arch of the user's palm, and the grip strength enhancement device can train the flexor digitorum superficialis (FDS), the flexor digitorum profundus (FDP), and the flexor pollicis longus (FPL) of the user.

In the first gripping mode and the second gripping mode, the grip strength enhancement device forms surface contact with the user's hand, rather than point contact or line contact, and the user's hand forms a stable arch in the first gripping mode and the second gripping mode. Further, a first elastic contact layer 140 covers a portion of a surface of the first handle 130, and a second elastic contact layer 240 covers a portion of a surface of the second handle 230. A material of the first elastic contact layer 140 is softer than a material of the first handle 130 and has lower hardness, and a material of the second elastic contact layer 240 is softer than a material of the second handle 230 and has lower hardness. When the grip strength enhancement device is deformed under a force indirectly applied by the user's hand to the first handle 130 and the second handle 230 through the first elastic contact layer 140 and the second elastic contact layer 240, comfort of the hand can be significantly improved.

Figure 17C:
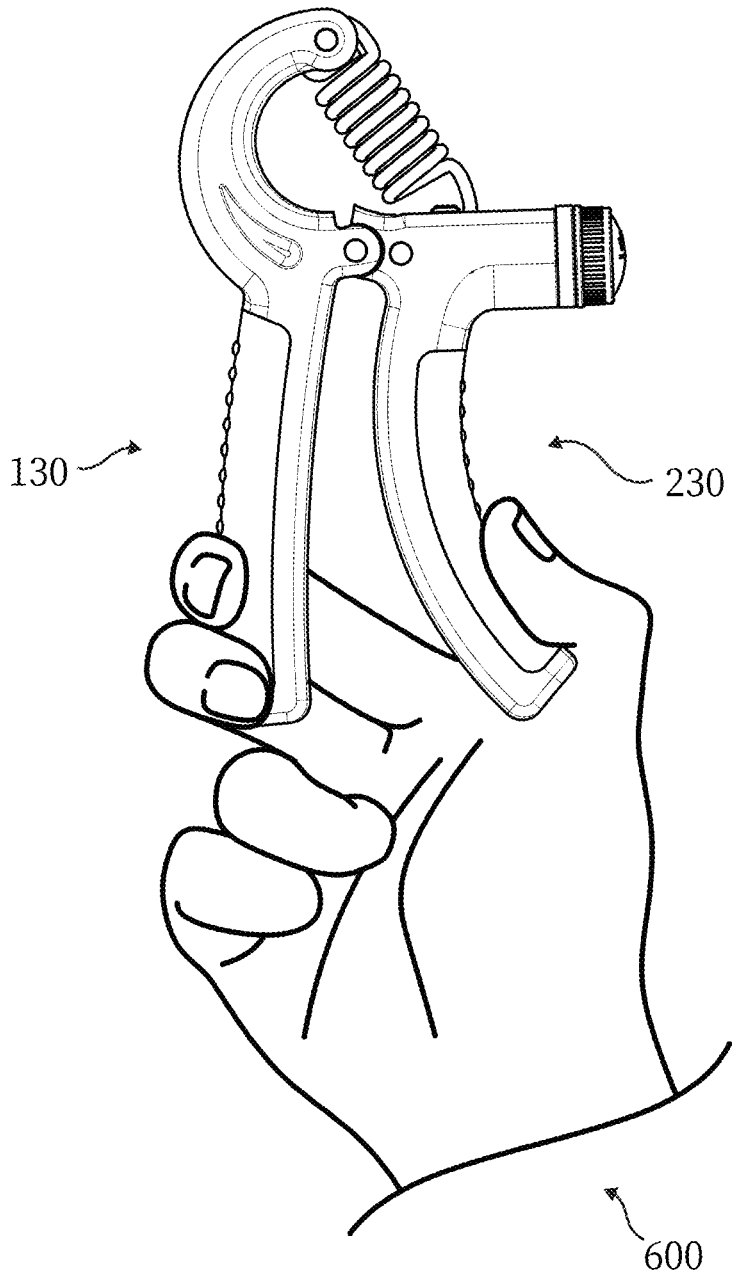
FIG. 17C is a schematic view showing the grip strength enhancement device configured by the user for a three-finger grip according to an embodiment of the present disclosure.

As shown in FIG. 17C, when the grip strength enhancement device is configured by a user for a three-finger grip, for example, a pinch grip using a thumb 620, an index finger 631, and a middle finger 632, the grip strength enhancement device can train an adductor pollicis (AP), an opponens pollicis (OP), a flexor pollicis brevis (FPB), and, for the index finger 631 and the middle finger 632, a flexor digitorum superficialis (FDS) and a flexor digitorum profundus (FDP) of the user.

Figure 17D:
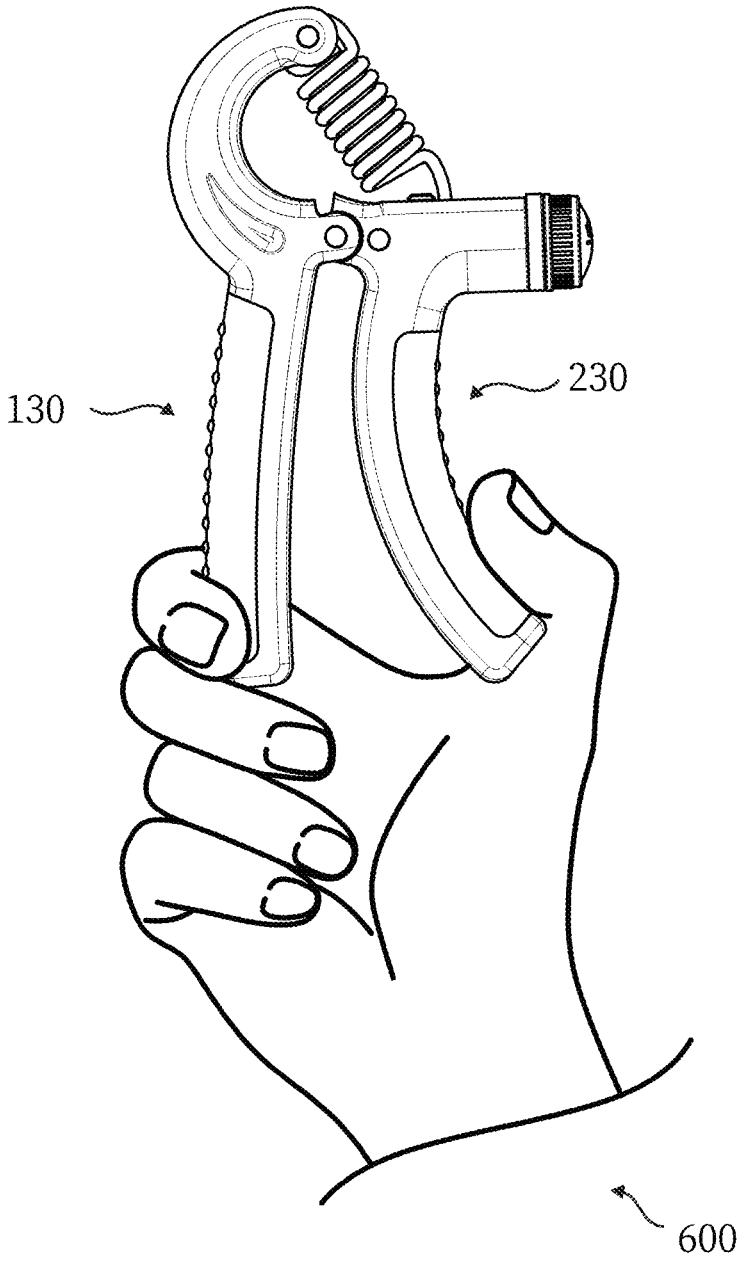
FIG. 17D is a schematic view showing the grip strength enhancement device configured by the user for a two-finger grip according to an embodiment of the present disclosure.

As shown in FIG. 17D, when the grip strength enhancement device is configured by a user for a two-finger grip, for example, a pinch grip between a thumb 620 and an index finger 631, the grip strength enhancement device can train an adductor pollicis (AP), a first dorsal interosseous (FDI), a flexor pollicis longus (FPL), and, for the index finger 631, a flexor digitorum superficialis (FDS) and a flexor digitorum profundus (FDP) of the user.

Figure 17E:
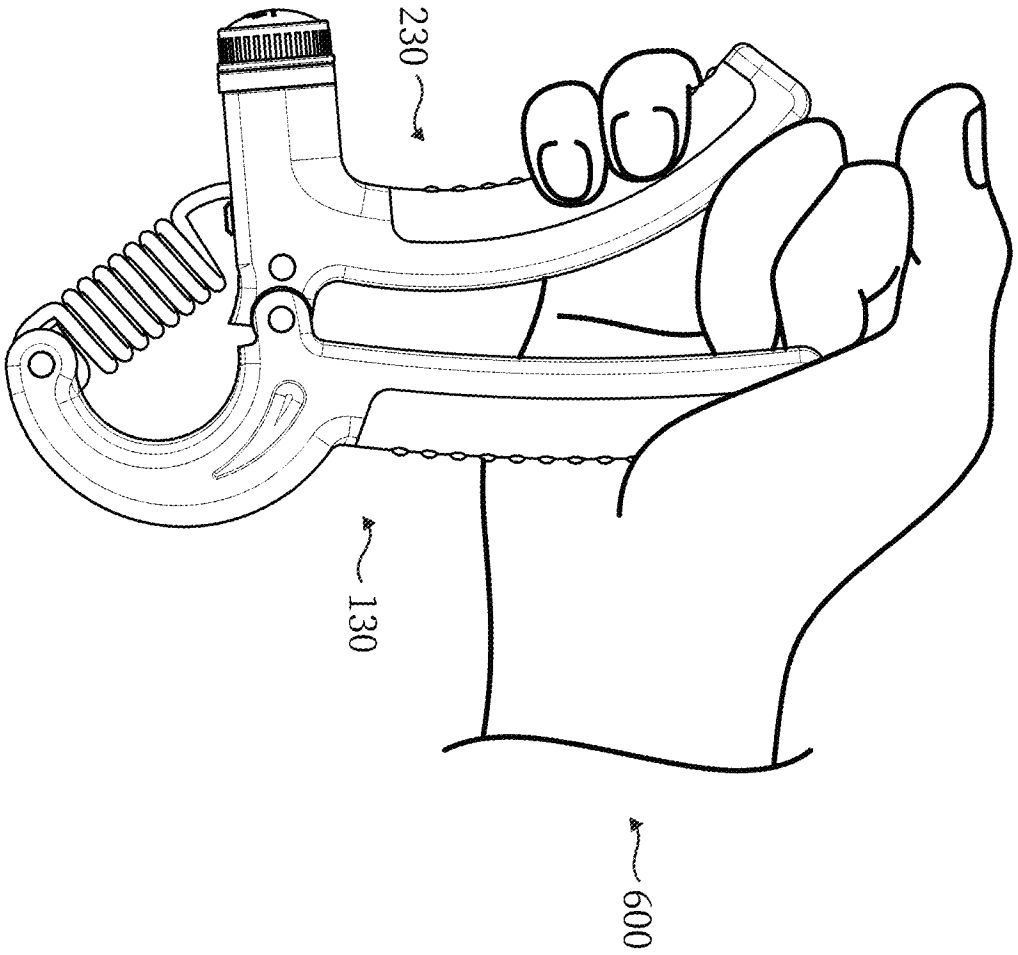
FIG. 17E is a schematic view showing the grip strength enhancement device configured by the user to be gripped using an ulnar side of the palm and a ring finger and/or a little finger according to an embodiment of the present disclosure.

As shown in FIG. 17E, when the grip strength enhancement device is configured by a user to be gripped using an ulnar side of the palm with a ring finger 633 and/or a little finger 634, the grip strength enhancement device can train, for the ring finger 633 and/or the little finger 634, a flexor digitorum profundus (FDP), a flexor carpi ulnaris (FCU), and hypothenar muscle groups of the user.

When the grip strength enhancement device is configured by a user for a combined grip using a thumb 620 and multiple fingers, the grip strength enhancement device can train an adductor pollicis (AP) and, for force-applying fingers including a middle finger 632, an index finger 631, a ring finger 633, and a little finger 634, a flexor digitorum superficialis (FDS) and a flexor digitorum profundus (FDP) of the user.

When the grip strength enhancement device is configured for any of a three-finger grip, a two-finger grip, a grip using an ulnar side of the palm with a ring finger 633 and/or a little finger 634, or a combined grip using a thumb 620 and multiple fingers, the grip strength enhancement device may further be configured in the first gripping mode or the second gripping mode.

When a user uses the grip strength enhancement device for training at an initial stage, the user may continuously squeeze the first handle 130 and the second handle 230 once or multiple times, and may train at a preset frequency. For example, the user may continuously squeeze the first handle 130 and the second handle 230 for 4 to 8 repetitions per set, and may perform one set or multiple sets per day at a predetermined time.

At an intermediate stage or an advanced stage, the user may gradually increase training intensity, for example, by increasing frequency of use and duration of use of the grip strength enhancement device. The user may also increase or decrease a resistance level of the grip strength enhancement device by adjusting the threaded adjustment mechanism 500.

A user may test the user's grip strength using the grip strength enhancement device. Specifically, testing may be performed under an American Society of Hand Therapists standardized position for grip strength testing. As shown in FIG. 18, the user is seated with both feet flat, thighs substantially parallel to the ground, and the body stabilized. The upper body is upright, with the back lightly supported by a chair back to maintain trunk stability. The shoulders are naturally relaxed in a neutral position, avoiding shrugging or forward protraction. An elbow is flexed at 90°, and a forearm is in a neutral position with the thumb 620 facing upward, thereby balancing muscle activation. A wrist is in a neutral position or slight extension (0° to 30°) to ensure that finger flexor tendons are at a desirable force-producing length. The user holds the grip strength enhancement device suspended throughout the test, without contacting the body or legs. In this posture, the user can test grip strength with relatively high accuracy.

The above embodiments are provided only to illustrate technical solutions of the present disclosure, and are not intended to limit the same. Although the present disclosure has been described in detail with reference to the foregoing embodiments, a person of ordinary skill in the art may still modify the technical solutions described in the foregoing embodiments, or make equivalent substitutions for some technical features thereof. Such modifications or substitutions do not cause an essence of corresponding technical solutions to depart from the spirit and scope of the technical solutions claimed in the present disclosure.

What is claimed is:

1. A grip strength enhancement device for hand strength training, comprising:

a first arm and a second arm pivotally coupled about an axis;

a first handle disposed at a lower end of the first arm and a second handle disposed at a lower end of the second arm, wherein the first handle comprises a bearing surface configured to conform to a thenar eminence of a user's palm and a front side surface opposite the bearing surface, and wherein the second handle comprises a gripping surface configured to conform to finger pads of the user and an extension surface opposite the gripping surface;

a spring having an upper end coupled, via a loop, to a third pin on an upper portion of the first arm, and having a lower end operatively coupled, via a hook, to a threaded adjustment mechanism disposed on the second arm, such that, in an absence of an externally applied force, the first arm and the second arm are urged by a tensile force of the spring to pivot relative to each other in an opening direction;

wherein the threaded adjustment mechanism is disposed on a base arm of the second arm, the base arm defines a limiting slot extending along a first direction, and the threaded adjustment mechanism comprises:

a screw disposed along the first direction of the limiting slot and a knob located at an outer end of the limiting slot, wherein an outer end of the screw is non-rotatably coupled to the knob for rotation with the knob, and an inner end of the screw is configured to be locked at an inner end of the limiting slot to restrict axial play of the screw while permitting circumferential rotation of the screw; and a nut threadably engaged with the screw, wherein the nut is constrained by the limiting slot and the screw to move only linearly along the first direction, the nut having a protruding portion received in the limiting slot, the protruding portion defining a fixing hole through which the hook extends; and wherein rotation of the knob drives rotation of the screw to reciprocally move the nut between a proximal stop position and a distal stop position, thereby changing an initial pre-extension amount of the spring;

wherein, when the nut is at the proximal stop position, the nut abuts a first end stop surface, and when the nut is at the distal stop position, the hook of the spring abuts a second end stop surface; and wherein an upper end of the limiting slot defines a through slot extending through the limiting slot, the through slot having a first end proximate to a pivot joint, the first end extending into the through slot to form a stepped portion, and an end face of the stepped portion proximate to the through slot forms the first end stop surface.

2. The grip strength enhancement device of claim 1, wherein the stepped portion defines a chamber, and the chamber is configured to receive a stopper.

3. The grip strength enhancement device of claim 2, wherein the stopper comprises a stop shoulder of the screw, a connecting post extending from an axial center at an end of the screw, and a stop post fixed to a distal end of the connecting post, to prevent axial play of a tail end of the screw.

4. The grip strength enhancement device of claim 3, wherein a second pin is installed in a second pin hole, and the second pin transversely passes through the stepped portion and the chamber.

5. The grip strength enhancement device of claim 4, wherein the stop shoulder and the stop post are respectively located on opposite sides of the second pin, thereby clamping and restraining the tail end of the screw within the chamber and preventing the tail end of the screw from shifting along a screw axis or in a front-rear direction during adjustment.

6. The grip strength enhancement device of claim 1, wherein the limiting slot extending along the first direction is configured to secure, receive, and guide the threaded adjustment mechanism.

7. The grip strength enhancement device of claim 6, wherein a retaining ring is mounted at an end of the limiting slot in the first direction, and an end face of the retaining ring facing a cavity of the limiting slot forms the second end stop surface.

* * * * *